US006675399B1

(12) United States Patent
Tomita et al.

(10) Patent No.: US 6,675,399 B1
(45) Date of Patent: Jan. 13, 2004

(54) TANKLESS TOILET, WESTERN-STYLE FLUSH TOILET, PRIVATE PART WASHING DEVICE AND SPUD FOR FLUSH TOILET

(75) Inventors: Katsunori Tomita, Tokoname (JP); Yasuhiro Shirai, Tokoname (JP); Koji Miwa, Tokoname (JP); Kenichi Ito, Tokoname (JP); Takanori Idota, Tokoname (JP); Masataka Mizutani, Tokoname (JP); Toshiaki Matushita, Tokoname (JP)

(73) Assignee: Inax Corporation, Tokoname (JP)

( * ) Notice: Subject to any disclaimer, the term of this patent is extended or adjusted under 35 U.S.C. 154(b) by 0 days.

(21) Appl. No.: 10/130,285

(22) PCT Filed: Nov. 24, 2000

(86) PCT No.: PCT/JP00/08309

§ 371 (c)(1),
(2), (4) Date: May 29, 2002

(87) PCT Pub. No.: WO01/40589

PCT Pub. Date: Jun. 7, 2001

(30) Foreign Application Priority Data

| | | |
|---|---|---|
| Nov. 29, 1999 | (JP) | 11-338505 |
| Dec. 3, 1999 | (JP) | 11-345093 |
| Jan. 11, 2000 | (JP) | 2000-2384 |
| Jun. 9, 2000 | (JP) | 2000-173040 |
| Jun. 9, 2000 | (JP) | 2000-173042 |
| Jul. 11, 2000 | (JP) | 2000-209692 |

(51) Int. Cl.[7] ..... E03D 9/08
(52) U.S. Cl. ..... 4/420.4; 4/420.2; 4/422
(58) Field of Search ..... 4/420.2, 420.4, 4/422, 423, 443, 447, 448

(56) References Cited

U.S. PATENT DOCUMENTS

| | | | | |
|---|---|---|---|---|
| 1,988,078 A | * | 1/1935 | Guidetti | 4/448 |
| 2,529,632 A | * | 11/1950 | Russell et al. | 4/422 |
| 3,044,076 A | * | 7/1962 | Martini | 4/420.4 |
| 3,467,966 A | * | 9/1969 | Gregori et al. | 4/447 |

FOREIGN PATENT DOCUMENTS

| | | |
|---|---|---|
| JP | 3-90723 | 4/1991 |
| JP | 3-253630 | 11/1991 |
| JP | 105181/1992 | 9/1992 |
| JP | 11-131559 | 5/1999 |

* cited by examiner

*Primary Examiner*—Robert M. Fetsuga
(74) *Attorney, Agent, or Firm*—Oblon, Spivak, McClelland, Maier & Neustadt, P.C.

(57) ABSTRACT

The present invention provides a tankless toilet which can realize the reduction of the manufacturing cost without deteriorating the washing ability of water in the inside of a rim channel. The western-style toilet body includes the rim channel which is formed in the inside of a rim and is capable of washing a toilet bowl with water, and a rim water guide passage which is concealed in a rear wall face of the western-style toilet body and is connected to the rim channel from behind. Further, a through hole which is communicated with the rim water guide passage is formed in the rear wall face of the western-style toilet body. A spud is engaged in the inside of the through hole. The rim conduit is communicated with the rim channel by a water supply passage of the spud without passing the rim water guide passage, while an atmosphere communication hole of a water supply device is communicated with the rim water guide passage by means of a water discharge passage of the spud through a tube.

5 Claims, 40 Drawing Sheets

TANKLESS TOILET, WESTERN-STYLE FLUSH TOILET, PRIVATE PART WASHING DEVICE AND SPUD FOR FLUSH TOILET

TECHNICAL FIELD

First, third to sixth inventions relate to a tankless toilet which has no water tank and directly feeds water supplied from a water supply pipe such as a city water service pipe or the like to a western-style toilet body so as to wash the western-style toilet body. A second invention relates to a tankless toilet provided with a toilet seat/toilet lid device and a toilet flushing device. A seventh invention relates to a western-style flush toilet including a tankless toilet. An eighth invention relates to a part washing device. A ninth invention relates to a spud for flush toilet. This spud for flush toilet is suitable as a rim nozzle which guides the water into a rim channel of a flushing western-style toilet body.

BACKGROUND ART

Conventionally, there has been known a western-style flush toilet which includes a western-style toilet body made of porcelain and a toilet flushing mechanism having a water tank such as a low tank made of porcelain which is mounted on a rear portion of the western-style toilet body and temporarily reserves water supplied from a water supply pipe such as a city water service pipe. The toilet flushing mechanism is capable of washing the western-style toilet body with the water reserved in the low tank. The water tank is mounted on a side wall of the toilet such that the tank is positioned outside the toilet body and has a large volume to spout a large amount of water into the toilet body at a time for ensuring the discharge of a waste from the western-style toilet body. Accordingly, such a western-style flush toilet generally requires a large space for mounting the water tank.

Accordingly, recently, from the viewpoint of effectively making use of the space of the toilet, a tankless toilet which is capable of directly supplying water fed from the water supply pipe to the western-style toilet body has been developed (Japanese Patent Laid-open No. 90723/1991, Japanese Patent Laid-open No. 253630/1991). In such a tankless toilet, a rim channel which is capable of flushing a bowl with water is formed in a rim of the western-style toilet body and a rim conduit is capable of supplying water to this rim channel by way of a rim water guide passage which is connected from a backside to the rim channel concealed in a wall face of the western-style toilet body. Further, as valve means, an open/close valve having an inlet port and an outlet port and a vacuum breaker having an atmosphere-communication hole are adopted. The water supply pipe is connected to the inlet port of the open/close valve by way of a conduit, while the rim conduit is connected to the outlet port. The atmosphere-communication hole of the vacuum breaker is communicated with the atmosphere above the uppermost surface of the rim channel. Further, this tankless toilet adopts the western-style toilet body having a support portion behind the rim and a fixed plate is fixedly mounted on the support portion of this western-style toilet body and the toilet flushing device is provided at the rear side of the fixed plate, and a toilet seat/toilet lid device is provided at the front side of a cover of the toilet flushing device such that the toilet seat/toilet lid device can be tilted upwardly and downwardly. The toilet seat/toilet lid device includes a toilet seat and a toilet lid.

In such a tankless toilet, water is fed to the inlet port of the open/close valve from the water supply pipe via the conduit, and then the water is fed to the rim channel of the western-style toilet body from the outlet port via the rim conduit due to the opening of an open/close valve. Accordingly, the water is spouted into the bowl so as to perform the flushing of the bowl. Further, the water jetted from a jet nozzle to a trap portion forcibly generates a siphon effect in the trap portion. Here, at this point of time, since the atmosphere-communication hole of the vacuum breaker has the downstream side of the vacuum breaker opened to the atmosphere, even when the water supply pipe, the conduit and the upstream side from these pipes become negative pressure, water in the rim channel is prevented from flowing backward to the valve means and the upstream side from the valve means.

Here, in the tankless toilet, the water flows in the rim channel at a high speed and hence, the rim conduit which is connected to the open/close valve is adopted to ensure the bowl washing ability. Further, from the viewpoint of enhancing the appearance, the rim conduit is concealed in the wall face. Further, in the tankless toilet, the water is jetted from the jet nozzle at a high speed and to ensure the generation of the effective siphon effect due to such a jetting of the water, a jet conduit which is connected to the open/close valve is adopted. Further, from the viewpoint of enhancing the appearance, the jet conduit is concealed in the wall face. Further, in this tankless toilet, because of the necessity to ensure the highly accurate contour dimensions, a base plate is interposed between the western-style toilet body and the open/close valve. Further, in view of the easiness of assembling, the rim conduit and the jet conduit are arranged such that they can be inserted into the open/close valve via the base plate. In this manner, the tankless toilet ensures the large flushing ability, the favorable appearance including the contour and the easiness of assembling.

Further, conventionally, there has been known a part washing device which includes a part washing mechanism which is mounted on the western-style toilet body and is capable of washing a part of a human body and a water supply device which is directly connected to a city water service pipe which supplies the water from outside and connects the city water service pipe and the part washing mechanism via a strainer.

Here, the strainer filters the foreign matters present in the water supplied from the city water service pipe to prevent the clogging of the part washing mechanism derived from the foreign matters present in the water. Then, in this part washing device, a cap is mounted on a lower end of the water supply device and the strainer disposed in the inside of the water supply device can be taken out by opening the cap. Further, the water supply device is concealed by a resin-made cover from the viewpoint of appearance and the cap of the water supply device is protruded downwardly so as to facilitate the take-out operation of the strainer disposed in the inside of the water supply device.

Further, a known spud for flush toilet is mounted on a through hole formed in a wall portion of the flush toilet body. In this manner, when this spud for flush toilet is mounted, for example, in the wall portion which faces the rim channel, the outlet port is positioned in the rim channel and can be used as a rim nozzle. In this rim nozzle, the water taken in through the inlet port is spouted in the rim channel from the outlet port.

DISCLOSURE OF THE INVENTION

First Invention

However, the western-style toilet body has a rim around a toilet bowl and the rim channel is formed in the rim. On the other hand, it is preferable that water is supplied through the rim conduit from a rear portion of the rim channel from an aesthetic point of view. With respect to this point, in the above-mentioned conventional tankless toilet, the western-style toilet body conceals the rim water guide passage leading to the rim channel in the wall face of the western-style toilet body and a through hole is formed above this rim water guide passage and the rim conduit is connected to the western-style toilet body by means of the through hole. In this case, water in the rim conduit reaches the rim channel after flowing through the inside of the rim water guide passage so that because of the resistance which water receives while flowing through the inside of the rim water guide passage, the force to spout water into the bowl becomes weak and hence, the washing ability of water may be deteriorated.

Further, water is liable to leak from the atmosphere communication hole of valve means and it is convenient to return such water to the inside of the bowl of the western-style toilet body. With respect to conventional tankless toilet, no consideration is made with respect to this point. Assuming a case that in the conventional tankless toilet, a pipe is connected to the atmosphere communication hole and the pipe is connected to the western-style toilet body, a through hole for such a pipe must be formed separately from the through hole for connecting the rim conduit to the western-style toilet body. In such a case, two through holes must be formed in the western-style toilet body made of porcelain so that the manufacture thereof becomes cumbersome and it pushes up the manufacturing cost.

The first invention has been made in view of the above circumstance and it is a first task to be solved to provide a tankless toilet which can realize the reduction of the manufacturing cost without deteriorating the washing ability of water in the rim channel.

With respect to the tankless toilet of the first invention, to solve such a first task, in a tankless toilet including a western-style toilet body having a rim channel which is formed in the inside of a rim and is capable of washing a bowl with water, a rim conduit which is capable of supplying water to the rim channel, and valve means having an inlet port thereof connected to a water supply pipe which supplies water, making an outlet port thereof supply water or stop the supply of water to the rim conduit and having an atmosphere communication hole which is communicated with the atmosphere above the uppermost surface of the rim channel, the improvement is characterized in that the western-style toilet body includes a rim water guide passage which is concealed in a wall surface of the western-style toilet body and is connected to the rim channel, a through hole which is communicated with the rim water guide passage is formed in the wall face of the western-style toilet body, and in the inside of the through hole, a spud having a water supply passage which makes the rim conduit communicate with the rim channel without passing the inside of the rim water guide passage and a water discharge passage which makes the atmosphere communication hole communicate with the rim water guide passage by way of pipe is engaged.

In the tankless toilet of the first invention, the western-style toilet body has the rim water guide passage which is connected to the rim channel concealed in the wall face of the western-style toilet body and hence, the tankless toilet exhibits the favorable appearance. Further, the through hole which is communicated with the rim water guide passage is formed in the wall face and the spud having the water supply passage and the water discharge passage is engaged in such a through hole.

In this manner, in this tankless toilet, the rim conduit is communicated with the rim channel through the water supply passage of the spud not by way of the inside of the rim water guide passage and hence, the water in the rim conduit reaches the rim channel due to the water supply passage of the spud without flowing through the inside of the rim water guide passage. Accordingly, the power to spout water into the inside of the bowl is maintained and there is no fear that the washing ability is deteriorated.

Further, since the atmosphere communication hole of the valve means is connected with the water discharge passage of the spud through the pipe and is communicated with the rim water guide passage through the water discharge passage, water which leaks from the atmosphere communication hole of the valve means flows into the rim water guide passage through the water discharge passage independent from the water supply passage relevant to the washing of the bowl by way of the pipe and then is returned to the inside of the bowl from the rim channel.

Further, in the tankless toilet of the first invention, by merely forming the through hole for mounting the spud in the western-style toilet body, the rim conduit and the pipe connected to the atmosphere communication hole can be connected to the western-style toilet body and hence, the tankless toilet can be easily manufactured and the manufacturing cost can be reduced.

Further, by forming the through hole in a rear wall face of the western-style toilet body, it becomes possible to make an upper surface of the western-style toilet body wide and hence, the tankless toilet exhibits a further favorable appearance due to the effective utilization of the space.

The spud can be constituted of a body portion which is engaged with the through hole, a first engaging portion formed on the body portion and is engaged with the rim conduit, a second engaging portion which is formed on the body portion and makes the pipe connected to the atmosphere communication hole engaged therewith, and a guide portion formed on the body portion and is extended into the inside of the rim channel. Here, the water supply passage which is communicated with the rim conduit is constituted of at least the first engaging portion and the guide portion. Further, the water discharge passage which is communicated with the pipe is constituted of at least the second engaging portion.

Here, when the guide portion includes water spout openings which make the water supply passage opened in one direction and the other direction of the rim channel, it becomes possible to spout the water into the rim channel from both directions and hence, even when the water spouting pressure is low, the bowl washing ability can be enhanced.

Second Invention

Further, in the conventional tankless toilet, a fixed plate is fixedly secured to a support portion and a toilet seat/toilet lid device is mounted on a cover for a toilet flushing device which is fixedly secured to the fixed plate. Accordingly, there arises a problem that the cleaning of the western-style toilet body is difficult. Particularly, with respect to this tankless toilet, it is necessary to firmly fix the fixed plate at front and rear portions of the western-style toilet body to prevent the mounting of the toilet seat/toilet lid device with a play and hence, the cleaning of the western-style toilet body becomes more difficult.

That is, in toilets including such a tankless toilet, urine or the like adheres to peripheries of the western-style toilet body and they give rise to stains. Particularly, when a child uses the toilet, such stains are liable to be generated. In such a tankless toilet, stains are generated in a minute gap formed between the western-style toilet body and the toilet seat/toilet lid device or the toilet flushing device. In performing the cleaning of the western-style toilet body, a cleaning person, first of all, removes the toilet seat/toilet lid device from the cover of the toilet flushing device, then removes the cover of the toilet flushing device, and further, removes the toilet flushing device from the western-style toilet body together with the fixed plate or removes the fixed plate from the western-style toilet body after removing the toilet flushing device from the fixed plate. In this manner, this tankless toilet requires many steps for cleaning the western-style toilet body and hence, it may be reasonable to say that the cleaning performance of the western-style toilet body is low. Particularly, in this tankless toilet, since the fixed plate is firmly fixed at the front and rear portions of the western-style toilet body at the time of removing the fixed plate, this tendency is large.

The second invention has been made in view of the above circumstance and it is a second task to be solved to provide a tankless toilet which can enhance the cleaning performance of the western-style toilet body.

According to the second invention, to solve the above-mentioned second task, in a tankless toilet including a western-style toilet body having a support portion in the rearward direction as viewed from a rim, a toilet seat/toilet lid device which is mounted on the support portion and has a toilet seat and a toilet lid, and a toilet flushing device which is mounted on the support portion and performs the washing of the western-style toilet body with water supplied from a water supply pipe, a fixed plate which has a toilet seat/toilet lid device mounting portion at a front side thereof and a toilet flushing device mounting portion at a rear side thereof is fixedly secured to the support portion, the toilet seat/toilet lid device is fixedly secured to the toilet seat/toilet lid device mounting portion, and toilet flushing device is fixedly mounted on the toilet flushing device mounting portion.

In this tankless toilet, the fixed plate is fixedly secured to the support portion of the western-style toilet body. The fixed plate has the toilet seat/toilet lid device mounting portion for mounting the toilet seat/toilet lid device at the front side thereof and the toilet flushing device mounting portion for mounting the toilet flushing device at the rear side thereof. Accordingly, when stains are generated in a minute gap formed between the western-style toilet body and the toilet seat/toilet lid device or the toilet flushing device and the cleaning of the western-style toilet body is to be performed, a cleaning person can remove the toilet seat/toilet lid device and the toilet flushing device from the western-style toilet body by removing the fixed plate from the support portion of the western-style toilet body.

Further, since the fixed plate is used as a common plate for mounting the toilet seat/toilet lid device and the toilet flushing device together on the western-style toilet body and hence, the mounting performance can be enhanced and the number of parts can be reduced.

With respect to the fixed plate, the toilet seat/toilet lid device mounting portion is tiltable in the upward and downward direction against the toilet flushing device mounting portion. It is preferable that toilet seat/toilet lid mounting holes for fixedly securing mounting bolts of the toilet seat/toilet lid device are formed in the toilet seat/toilet lid device mounting portion, and insertion holes for allowing the insertion of these mounting bolts thereinto and fixed plate mounting holes for fixedly securing the rear side of the fixed plate to the support portion of the fixed plate are formed in the support portion of the western-style toilet body. With such a constitution, only the toilet seat/toilet lid device can be tilted upwardly or downwardly relative to the western-style toilet body while holding the toilet seat/toilet lid device to the fixed plate and hence, the cleaning performance of the support portion of the western-style toilet body concealed at the front side of the fixed plate can be enhanced. Further, only the rear side of the fixed plate is fixedly secured to the western-style toilet body by the fixed plate mounting holes formed in the support portion and hence, the fixed plate can be easily removed together with the toilet seat/toilet lid device so that the advantageous effect of the present invention is enhanced.

Further, when the toilet flushing device is provided with valve means and a vacuum breaker, the fixed plate may have a guide passage which guides backflow water spouted from an intake opening of the vacuum breaker to the western-style toilet body. Here, the valve means is capable of supplying water into the western-style toilet body and stopping such a supply of water. Further, the vacuum breaker has the intake opening communicated with the atmosphere and prevents the backflow of water at the valve means. Due to such a constitution, the backflow water spouted from the intake opening of the vacuum breaker can be guided to the western-style toilet body through the guide passage formed in the fixed plate and hence, the contamination derived from the backflow water can be prevented without necessitating any special pipe.

Third Invention

Further, the above-mentioned conventional tankless toilet is only of a type which adopts a unitary-type toilet flushing device in which the toilet flushing device is mounted on the western-style toilet body unitarily with the toilet seat/toilet lid device and there has been no case that the conventional tankless toilet is of a type which adopts a separate type toilet flushing device in which the toilet flushing device is mounted on the western-style toilet body separately from the toilet seat/toilet lid device. Accordingly, at the time of purchasing, a purchaser of the tankless toilet who are considering the installment of the tankless toilet in a toilet room can only select the tankless toilet which is provided with the unitary-type toilet flushing device in which the toilet flushing device is mounted on the western-style toilet body unitarily with the toilet seat/toilet lid device. Accordingly, the free selection of the tankless toilet having the separate-type toilet flushing device which may become necessary due to a budget or the like is impossible.

Further, even if either the tankless toilet having the separate-type toilet flushing device or the tankless toilet having the unitary-type toilet flushing device is manufactured, so long as they do not use the common western-style toilet body, it is necessary to manufacture two kinds of western-style toilet body and hence, the efficiency of mass production is low and this pushes up the manufacturing cost of the western-style toilet body or the manufacturing cost of the tankless toilet.

The third invention has been made in view of the above circumstance and it is a third task to be solved by the invention to allow the purchaser to freely select the tankless toilet and to realize the reduction of the manufacturing cost of the tankless toilet.

With respect to a tankless toilet of the third invention, to solve the above-mentioned third task, in a tankless toilet including a western-style toilet body, a toilet seat/toilet lid device mounted on the western-style toilet body and a toilet flushing device which is mounted on the western-style toilet body, has no water tank and has a flushing mechanism capable of washing the western-style toilet body with water, the improvement is characterized in that the toilet flushing device is either a separate-type toilet flushing device which is mounted on the western-style toilet body separately from the toilet seat/toilet lid device or a unitary-type toilet flushing device which is mounted on the western-style toilet body integrally with the toilet seat/toilet lid device, and the western-style toilet body on which the separate-type toilet flushing device is mounted and the western-style toilet body on which the unitary-type toilet flushing device is mounted are used in common.

The tankless toilet of the third invention adopts either the separate-type toilet flushing device or the unitary-type toilet flushing device. Accordingly, a purchaser of a tankless toilet who is considering the installment of the tankless toilet in a toilet room can freely select the tankless toilet adopting the separate-type toilet flushing device or the tankless toilet adopting the unitary-type toilet flushing device depending on a budget or the like at the time of purchasing.

Further, with respect to the tankless toilet of the third invention, since the western-style toilet body is commonly used, it is sufficient to manufacture only one kind of western-style toilet body and hence, the highly-efficient mass production becomes possible whereby the reduction of the manufacturing cost of the western-style toilet body and eventually the reduction of the manufacturing cost of the tankless toilet can be realized.

It is preferable that the separate-type toilet flushing device and the unitary-type toilet flushing device use the common flushing mechanism. In this case, when the tankless toilet adopting the separate-type toilet flushing device as its toilet flushing device and the tankless toilet adopting the unitary-type toilet flushing device as its toilet flushing device are manufactured in a factory, their parts can be used in common so that the reduction of the manufacturing cost of the tankless toilet can be further enhanced.

Further, it is preferable that the separate-type toilet flushing device and the unitary-type toilet flushing device use the common base plate which is used for mounting the flushing mechanism to the western-style toilet body. In this case also, when the tankless toilet adopting the separate-type toilet flushing device as its toilet flushing device and the tankless toilet adopting the unitary-type toilet flushing device as its toilet flushing device are manufactured in a factory, their parts can be used in common so that the reduction of the manufacturing cost of the tankless toilet can be further enhanced. Further, at the time of mounting the separate-type toilet flushing device or the unitary-type toilet flushing device on the western-style toilet body, they can use the common manufacturing line until the flushing mechanism is mounted on the western-style toilet body by way of the base plate so that the reduction of the manufacturing cost of the tankless toilet can be further enhanced.

Further, it is preferable that the flushing mechanism is mounted on the western-style toilet body without interfering with other mechanism excluding the flushing mechanism in the unitary-type toilet flushing device. At the time of mounting the separate-type toilet flushing device or the unitary-type toilet flushing device on the western-style toilet body, provided that the flushing mechanism can be mounted on the western-style toilet body without interfering with other mechanism excluding the flushing mechanism in the unitary-type toilet flushing device, by mounting only the flushing mechanims to the western-style toilet body, the tankless toilet provided with only the flushing mechanism can be manufactured. On such a tankless toilet, a simple toilet seat/toilet lid device which only includes a toilet seat and a toilet lid can be mounted or alternatively, a toilet seat/toilet lid device which is provided with other mechanisms such as a part washing device which is capable of washing a part of a human body can be mounted. In this manner, the tankless toilet provided with the separate-type toilet flushing device can be manufactured. Further, by mounting other mechanisms except for the flushing mechanism after mounting the flushing mechanism, the tankless toilet provided with the unitary-type toilet flushing device can be manufactured. Accordingly, they can use the common manufacturing line until the flushing mechanism is mounted on the western-style toilet body so that the reduction of the manufacturing cost of the tankless toilet can be further enhanced. As other mechanism, a hot water tank of the part washing device or the like can be named.

The unitary-type toilet flushing device may include an inner cover which conceals the flushing mechanism and an outer cover which conceals the inner cover together with other mechanisms. Due to such a constitution, by concealing the flushing mechanism with the inner cover after mounting the flushing mechanism on the western-style toilet body, the tankless toilet provided with the separate-type toilet flushing device can be manufactured. Further, after mounting other mechanisms excluding the flushing mechanism, such other mechanisms can be concealed by the outer cover and hence, the tankless toilet provided with the unitary-type toilet flushing device can be manufactured. Accordingly, they can use the common manufacturing line until the flushing mechanism and the inner cover are mounted on the western-style toilet body so that the reduction of the manufacturing cost of the tankless toilet can be further enhanced.

When the western-style toilet body has toilet seat mounting holes which enable the mounting of the toilet seat/toilet lid device, the separate-type toilet flushing device can be mounted on the western-style toilet body at the rear side of the toilet seat/toilet lid device which is mounted with the toilet seat mounting holes. On the other hand, in this case, the unitary-type toilet flushing device is mounted on the western-style toilet body by means of at least toilet seat mounting holes.

It is preferable that the toilet seat mounting holes are designed such that a general toilet seat/toilet lid device can be mounted. The distance between these toilet seat mounting holes is prescribed by the JIS Standard in Japan, for example, such that the distance becomes 140 mm. Besides the above, the distance between the toilet seat mounting holes may be determined based on the standards of other countries such as United States of America or other nations.

Fourth and Fifth Inventions

Further, in the above-mentioned conventional tankless toilet, the rim conduit has one end thereof opened in the rim channel of the western-style toilet body, has the middle portion thereof exposed from the wall surface of the western-style toilet body, and has the other end fixedly secured to the base plate. Further, the other end of the rim conduit can be inserted into an open/close valve fixedly secured to the base plate. Similarly, in this tankless toilet, the jet conduit has one end thereof fixedly secured to the jet nozzle which is fixedly secured to the western-style toilet body and the other end fixedly secured to the base plate. Further, the other end of the jet conduit can be inserted into an open/close valve which is fixedly secured to the base plate.

Accordingly, in such a tankless toilet, since the rim conduit and the jet conduit are fixedly secured to the western-style toilet body by way of the base plate, at the time of assembling, it is impossible to mount the rim conduit and the jet conduit on the western-style toilet body in a stable manner until the base plate is fixedly secured to the western-style toilet body. Accordingly, such a tankless toilet has a drawback that the toilet cannot sufficiently exhibit the easiness of assembling.

The fourth and fifth inventions have been made in view of the above-mentioned conventional circumstance and their fourth and fifth tasks lie in the realization of the large washing ability, the appearance including the contour, and the assurance of the reliable easiness of assembling.

In the tankless toilet of the fourth invention, to solve the above-mentioned fourth task, in a tankless toilet including a western-style toilet body having a rim channel which is formed in the inside of a rim and is capable of washing a bowl with water, an open/close valve which is fixedly secured to the western-style toilet body by way of a base plate and is connected to a water supply pipe capable of supplying water, and a rim conduit which is concealed in a wall face of the western-style toilet body and is connected to the open/close valve and is capable of supplying the water to the rim channel, the improvement is characterized in that the rim conduit is fixedly secured to the wall face and the rim conduit and the open/close valve can be inserted into each other.

In the tankless toilet of the fourth invention, the rim conduit is fixedly secured to the wall face of the western-style toilet body and the rim conduit can be inserted into the open/close valve which is fixedly secured to the base plate. Due to such a constitution, at the time of assembling, it becomes possible to mount the rim conduit to the western-style toilet body in a stable manner even before fixing the base plate to the western-style toilet body and hence, the tankless toilet can sufficiently exhibit the easiness of assembling. Further, since the tankless toilet of the fourth invention adopts the rim conduit which is connected to the open/close valve, the water flows in the inside of the rim channel at a high speed thus ensuring the ability to wash the bowl. Further, since the rim conduit is concealed in the wall face, the appearance of the tankless toilet is enhanced. Further, since the base plate is interposed between the western-style toilet body and the open/close valve, the highly accurate contour dimensions can be ensured.

In the tankless toilet of the fifth invention, to solve the above-mentioned fifth task, in a tankless toilet including a western-style toilet body having a jet nozzle which is disposed in a trap portion and jets water to the trap portion so as to forcibly generate a siphon effect, an open/close valve which is fixedly secured to the western-style toilet body by way of a base plate and is connected to a water supply pipe capable of supplying the water, and a jet conduit which is concealed in a wall face of the western-style toilet body and is connected to the open/close valve and is capable of supplying the water to the jet nozzle, the improvement thereof is characterized in that the jet conduit is fixedly secured to the wall face and the jet conduit and the open/close valve can be inserted into each other.

In the tankless toilet of the fifth invention, jet conduit is fixedly secured to the wall face of the western-style toilet body and the jet conduit can be inserted into the open/close valve which is fixedly secured to the base plate. Accordingly, at the time of assembling, the jet conduit can be mounted on the western-style toilet body in a stable manner even before the base plate is fixedly secured to the western-style toilet body and hence, the tankless toilet can sufficiently exhibit the easiness of assembling.

Further, the tankless toilet of the fifth invention adopts the jet conduit connected to the open/close valve and hence, the water is jetted from the jet nozzle at a high speed thus ensuring the generation of the effective siphon effect. Further, since the jet conduit is concealed in the wall face, the appearance of the tankless toilet is enhanced. Further, since the base plate is interposed between the western-style toilet body and the open/close valve, the highly accurate contour dimensions can be ensured.

Sixth Invention

Further, in the above-mentioned conventional tankless toilet, only the toilet flushing device is mounted on the western-style toilet body and a toilet seat/toilet lid device including a part washing mechanism which is capable of washing a part of a human body is not mounted on the western-style toilet body. Accordingly, this tankless toilet cannot meet a demand of a user that the user wants to wash the part after passing stools.

Assuming a case in which a part washing mechanism is mounted on such a tankless toilet, when the part washing mechanism is simultaneously fixedly secured to a base plate which fixedly secures a toilet flushing mechanism to the western-style toilet body, the base plate becomes large-sized so that the tankless toilet also becomes large-sized whereby it is difficult to ensure the installation space. The same goes for a case in which other base plate to which a part washing mechanism is fixedly secured is fixedly secured to the western-style toilet body and a space for the part washing mechanism is to be ensured separately in the western-style toilet body.

The sixth invention has been made in view of the above circumstance and a sixth task to be solved is to provide a tankless toilet which facilitates the assurance of the installation space by miniaturization and can meet the demand of the user that the user wants to wash the part after passing stools.

In the tankless toilet of the sixth invention, to solve the above-mentioned sixth task, in a tankless toilet including a western-style toilet body and a toilet flushing device which is mounted on the western-style toilet body, has no water tank and has a flushing mechanism capable of washing the western-style toilet body with water, the improvement thereof is characterized in that in mounting a toilet seat/toilet lid device having a part washing mechanism capable of washing a part of human body on the western-style toilet body, as the toilet seat/toilet lid device, a toilet seat/toilet lid device having a toilet seat base plate on which the part washing mechanism is fixedly secured is adopted, as the toilet flushing device, a toilet flushing device having a toilet flushing base plate on which the toilet flushing mechanism is fixedly secured is adopted, the toilet seat base plate is mounted on the western-style toilet body using toilet seat mounting holes formed on the western-style toilet body, and the toilet flushing base plate is sandwiched between the toilet seat base plate and the western-style toilet body while obviating the interference between the part washing mechanism and the toilet flushing mechanism.

In the tankless toilet of the sixth invention, the toilet seat base plate of the toilet seat/toilet lid device is mounted on the western-style toilet body using the toilet seat mounting holes formed in the western-style toilet body and the toilet flushing base plate of the toilet flushing device is sandwiched between the toilet seat base plate and the western-style toilet body. Here, the interference between the part washing mechanism of the toilet seat/toilet lid device and the toilet flushing mechanism of the toilet flushing device is obviated. Accordingly, in this tankless toilet, the part washing mechanism of the toilet seat/toilet lid device is mounted on the western-style toilet body so that the demand of the user that the user wants to wash the part after passing stools or the like can be satisfied. Further, in this tankless toilet, when the part washing mechanism is mounted on the tankless toilet in such a manner, since the toilet seat base plate and the toilet flushing base plate are partially overlapped and hence, the tankless toilet can be miniaturized.

It is preferable that the toilet seat mounting holes are capable of mounting a toilet seat/toilet lid device for general use. Due to such a constitution, even when a purchaser of a tankless toilet who is considering the installation of the tankless toilet in a toilet room originally mounts a toilet seat/toilet lid device for general use due to a budget reason or the like at the time of purchasing the tankless toilet, the user can replace such a toilet seat/toilet lid device with a toilet seat/close lid device having a part washing mechanism without exchanging the western-style toilet body and other equipment. This mode can be carried out in a reverse manner. In this manner, the free selection of the purchaser can be ensured. Further, due to such a constitution, the western-style toilet body can be used in common so that the reduction of the manufacturing cost can be realized due to the highly efficient mass production. The distance between these toilet seat mounting holes is prescribed by the JIS Standard in Japan, for example, such that the distance becomes 140 mm. Besides the above, the distance between the toilet seat mounting holes may be determined based on the standards of other countries such as United States of America or other nations.

The toilet seat base plate may have a guide passage which guides water leaked from the toilet flushing mechanism to the inside of the western-style toilet body.

Further, when the toilet seat/toilet lid device has a cover which conceals a part washing mechanism, it may be constructed such that the toilet flushing mechanism of the toilet flushing device can be concealed by this cover.

Seventh Invention

Further, in the above-mentioned conventional general western-style flush toilet, a low tank which occupies a major portion of a toilet flushing mechanism is exposed. Accordingly, it is necessary to manufacture the low tank made of porcelain such that the low tank exhibits an excellent appearance and hence, the manufacture of the low tank becomes cumbersome whereby there is a limitation with respect to the reduction of the manufacturing cost.

In view of the above, it may be possible to simply conceal the toilet flushing mechanism such as the low tank with a cover made of resin. Due to such a constitution, even though the manufacturing cost may be pushed up by an amount of the cover, it is no more necessary to consider the appearance of the toilet flushing mechanism inside the cover so that the manufacturing of the toilet flushing mechanism is facilitated whereby the reduction of the manufacturing cost can be realized.

However, in the constitution which simply conceals the toilet flushing mechanism with the resin-made cover, when the cover is to be opened for inspection of the toilet flushing mechanism or the like, provided that the cover is divided into left and right halves, a division line spoils the appearance.

The seventh invention has been made in view of the above-mentioned conventional circumstance and it is a seventh task to be solved to provide a western-style flush toilet which can realize the reduction of the manufacturing cost and also can ensure the favorable appearance.

With respect to the western-style flush toilet of the seventh invention, to solve the above-mentioned seventh task, in a western-style flush toilet including a western-style toilet body, and a toilet flushing mechanism which is mounted on a rear portion of the western-style toilet body and is capable of washing the western-style toilet body with water, the improvement is characterized in that the toilet flushing mechanism is concealed by a resin-made upper cover and a resin-made under cover which can be divided into upper and lower halves.

In the western-style flush toilet of the seventh invention, although the toilet flushing mechanism is concealed by the resin-made upper cover and the under cover and hence, the manufacturing cost is pushed up by an amount corresponding to the upper cover and the under cover, since it is no more necessary to consider the appearance of the toilet flushing mechanism in the inside of the upper cover and the under cover, the manufacturing of the toilet flushing mechanism is facilitated so that the reduction of the manufacturing cost can be realized.

Further, in this western-style flush toilet, by dividing the upper cover and the under cover into upper and lower halves, the inspection of the toilet flushing mechanism and the like can be performed. In this case, since the division line between the upper cover and the under cover becomes a horizontal or approximately horizontal line, the division line hardly spoils the appearance of the western-style flush toilet.

When the part washing mechanism capable of washing the part of the human body is provided to a rear portion of the western-style toilet body, it is preferable that the part washing mechanism is also concealed by the upper cover and the under cover. Due to such a constitution, it is no more necessary to consider the appearance of the part washing mechanism and hence, the manufacture of the part washing mechanism is facilitated whereby the reduction of the manufacturing cost can be realized. Further, by dividing the upper cover and the under cover in the vertical direction, the inspection of the part washing mechanism or the like can be carried out.

It is preferable that the division line between the upper cover and the under cover is aligned with an upper surface of a rim of the western-style toilet body. Due to such a provision, the division line extending in the horizontal or approximately horizontal line exhibits the favorable appearance.

When a toilet flushing mechanism which is directly connected to a city water service pipe which supplies the water from outside and is capable of spouting water by the open/close operation of a valve is adopted as the toilet flushing mechanism, the advantageous effect of the present invention is enhanced. Since such a toilet flushing mechanism is not provided with a conventional low tank, the toilet flushing mechanism can be miniaturized. Accordingly, it becomes easy to conceal the toilet flushing mechanism with the upper cover and the under cover and the upper cover and the under covers can be also miniaturized so that the further reduction of the manufacturing cost can be realized.

When a toilet flushing mechanism which is connected to the other end of a flexible hose which has one end thereof connected to the city water service pipe is adopted as the toilet flushing mechanism, it is preferable that the other end of the flexibile hose is disposed at a position above an approximately center in the widthwise direction of the under cover. Due to such a constitution, even when the city water service pipe is arranged at either left or right side of the western-style flush toilet, the city water service pipe and the toilet flushing mechanism can be easily directly connected. Further, this advantageous effect eliminates the necessity to separate the western-style flush toilet in view of the left-side water supply and the right-side water supply. Accordingly, the number of types at the time of manufacturing and selling can be decreased so that the reduction of the manufacturing cost and the administration cost can be realized. Further, due to such a provision, the freedom of designing of a house is increased so that the selection of designing by a builder becomes easy. Further, since the flexible hose has a certain degree of flexibility, the installation of the toilet is facilitated.

It is preferable that the under cover has a guide which allows the flexible movement of the flexible hose. Since the flexible hose is flexible with a certain degree of curvature, when the under cover is provided with such a guide, an unnecessary gap is hardly generated or is not generated between the under cover and the flexible hose and hence, the appearance of the toilet is enhanced.

Eighth Invention

Further, there may be a case in which a part washing device once places a cover which incorporates a water supply device therein on a floor surface at the time of mounting the part washing device on the western-style toilet body. In this case, according to the above-mentioned conventional part washing device, since a cap of the water supply device is protruded downwardly from a lower surface of the cover, the cap interferes with the floor surface and there exists the possibility that the water supply device may be damaged.

The eighth invention has been made in view of the above-mentioned conventional circumstance and it is an eighth task to be solved to provide a part washing device which does not generate the rupture of a water supply device at the time of mounting the part washing device on a western-style toilet body.

With respect to the part washing device of the eighth invention, to solve the above-mentioned eighth task, in a part washing device including a part washing mechanism which is mounted on a western-style toilet body and is capable of washing a part of a human body, and a water supply device which is directly connected to a city water service pipe which supplies water from outside and connects the city water service pipe and the part washing mechanism by way of a strainer, wherein a cap which allows the take-out of the strainer is provided to a lower end of the water supply device, and the water supply device is concealed by a cover in a state that the cap is protruded downwardly, the improvement is characterized in that a rib which is protruded downwardly while exceeding the protruding length of the cap is formed on a lower surface of the cover.

In the part washing device of the eighth invention, since the rib is formed on the lower surface of the cover which incorporates the water supply device therein and the rib is protruded downwardly while exceeding the protruding length of the cap, even when the cover is once placed on a floor surface at the time of mounting the part washing device on a western-style toilet body, the cap is prevented from interfering with the floor surface.

Ninth Invention

Further, most of conventional spuds for flush toilets exhibit poor mounting performance to a through hole formed in a wall portion. On the other hand, spuds for flush toilets which enhance the mounting performance exhibit problems with respect to their sealing performance between the spud and the through hole formed in the wall portion and hence, there is a possibility that water taken in through an inlet port leaks in the vicinity of the through hole.

The ninth invention has been made in view of the above circumstance and it is a ninth task to be solved to provide a spud for flush toilet which can satisfy both of the mounting performance and the sealing performance.

With respect to the spud for flush toilet of the ninth invention, to solve the above-mentioned ninth task, in a spud for flush toilet which is mounted in a through hole formed in a wall portion of a flush toilet body and spouts water taken therein through an inlet port from an outlet port, the improvement is characterized in that the spud for flush toilet includes a cylindrical member being made of resin having resiliency and being formed in a cylindrical shape, the cylindrical member having one end formed into an outlet port or the inlet port, and the cylindrical member being inserted into the through hole, a female thread member provided with first flanges which are protruded radially outwardly in at last two directions on an outer surface thereof, the female thread member having a female thread formed on an inner surface thereof, the female thread member being formed in the small-diameter state and inserted into the inside of the cylindrical member in the inside of the through hole from one end or the other end thereof, and the female thread member being formed in the large-diameter state and bringing the first flange come into contact with one surface of the wall portion by way of the cylindrical member, and a male thread member having a male thread which is engaged with the female thread and forms the female thread member in the large-diameter state formed in an outer surface of a front end side thereof, the male thread member forming a second flange which faces the first flange in an opposed manner and is brought into contact with the other surface of the wall portion by way of the cylindrical member on an outer surface of a rear end side thereof, and the male thread member forming a water passage which is extended in the axial direction and forms the inlet port or the outlet port at a rear end thereof in the inside thereof.

In mounting the spud for flush toilet of the ninth invention in the through hole formed in the wall portion, first of all, the cylindrical member is fitted into the through hole. Here, since the cylindrical member is formed of the resin having resiliency, this operation can be easily performed.

Then, the first flange of the female thread member is pushed into the cylindrical member to form the female thread member in the small-diameter state, and then the female thread member is inserted into the inside of the cylindrical member in the through hole from one end or the other end thereof.

Thereafter, the front end of the male thread member is inserted into the inside of the female thread member and the male thread of the male thread member is engaged with the female thread of the female thread member. When the thread engagement between the female thread of the female thread member and the male thread of the male thread member progresses, the female thread member is held in the large-diameter state. Further, the first flange of the female thread member is brought into contact with one surface of the wall portion by way of the cylindrical member and the second flange of the male thread member is brought into contact with the other surface of the wall portion by way of the cylindrical member while facing the first flange in an opposed manner. In this manner, the spud for flush toilet can be easily and firmly mounted in the through hole formed in the wall portion.

In this spud for flush toilet, the inlet port or the outlet port formed at the rear end of the male thread member and the outlet port or the inlet port formed at one end of the cylindrical member are communicated with each other by the water passage formed in the male thread member. Accordingly, in the spud for flush toilet, the water taken therein from the inlet port is spouted from the outlet port.

Here, since the cylindrical member is formed in a cylindrical shape in the through hole formed in the wall portion, the sealing performance between the through hole and the cylindrical member is ensured. Further, since the first flange and the second flange are brought into contact with one surface and the other surface of the wall portion in the state that the first flange and the second flange sandwich the cylindrical member made of resin having resiliency, the sealing performance between the through hole and the male thread member is also ensured. Accordingly, the water taken in through the inlet port does not leak in the vicinity of the through hole and can be spouted from the outlet port.

Since the first flange of the female thread member is radially outwardly protruded, there may be a case that the cylindrical member makes the first flange thereof exposed outside. However, in the spud for flush toilet of the present invention, it is preferable that the cylindrical member surrounds the first flange of the female thread member. Due to such a constitution, a gap between the cylindrical member and the female thread member is completely sealed and hence, the sealing performance is further enhanced.

In the spud for flush toilet of the ninth invention, it is preferable that a third flange which is aligned with the second flange of the male thread member is formed on the other end of the cylindrical member. Due to such a constitution, the second flange of the male thread member is brought into contact with the other surface of the wall portion by way of the third flange of the cylindrical member. Accordingly, the water which leaks through the gap formed between the female thread of the female thread member and the male thread of the male thread member hardly enters the gap formed between the second flange of the male thread member and the third flange of the cylindrical member so that the sealing performance can be further enhanced.

Further, in the spud for flush toilet of the ninth invention, it is preferable that a packing is mounted on a wall portion side of the third flange. Due to such a constitution, the second flange of the male thread member is brought into contact with the other surface of the wall portion by way of the third flange of the cylindrical member and the packing. Accordingly, even when a cylindrical member having a thin wall thickness is used as the cylindrical member for enhancing the mounting performance, due to the resiliency of the packing, the water which leaks from the gap formed between the female thread of the female thread member and the male thread of the male thread member hardly passes through the gap formed between the second flange of the male thread member and the third flange of the cylindrical member so that the sealing performance can be enhanced. Further, due to such a constitution, since the spud for flush toilet can be firmly mounted in the through hole formed in the wall portion by making use of the resiliency of the packing, the spud for flush toilet hardly vibrates relative to the flush toilet body and hence, the sealing performance relative to other members which are connected to the inlet port is enhanced.

In the spud for flush toilet of the ninth invention, it is preferable that a fourth flange which is brought into contact with the inner surface of the through hole is formed on the cylindrical member. Due to such a constitution, the cylindrical member is firmly held in the through hole and the spud for flush toilet hardly vibrates relative to the flush toilet body and the sealing performance relative to other members which are connected to the inlet port is enhanced.

One end of the cylindrical member may be formed into an outlet port protruded into the inside of the rim channel of the flush toilet body and the rear end of the male thread member may be formed into the inlet port. Due to such a constitution, the spud for flush toilet works as a rim nozzle which guides the water into the rim channel of the flush toilet body.

BEST MODE FOR CARRYING OUT THE INVENTION

First Invention

Embodiments 1–4 which embody the first invention are explained hereinafter in conjunction with drawings.

Embodiment 1

Figure 1:
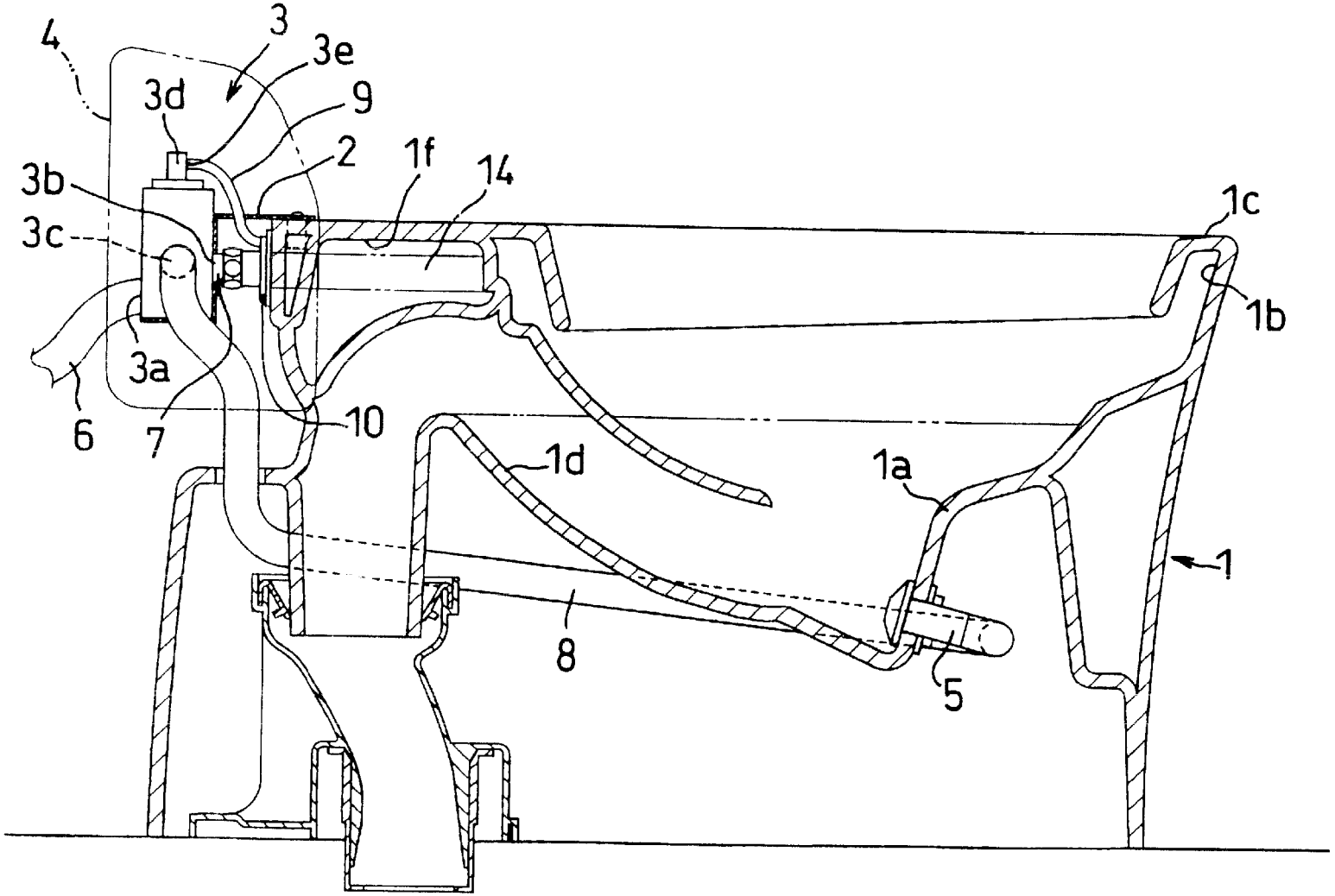
FIG. 1 is a longitudinal cross-sectional view of a tankless toilet of an embodiment 1 in the first invention.

As shown in FIG. 1, in a tankless toilet of the embodiment 1, a water supply device 3 which works as valve means is incorporated into a rear portion of a western-style toilet body 1 by way of a base plate 2 and the water supply device 3 is concealed by a cover 4.

Figure 3:
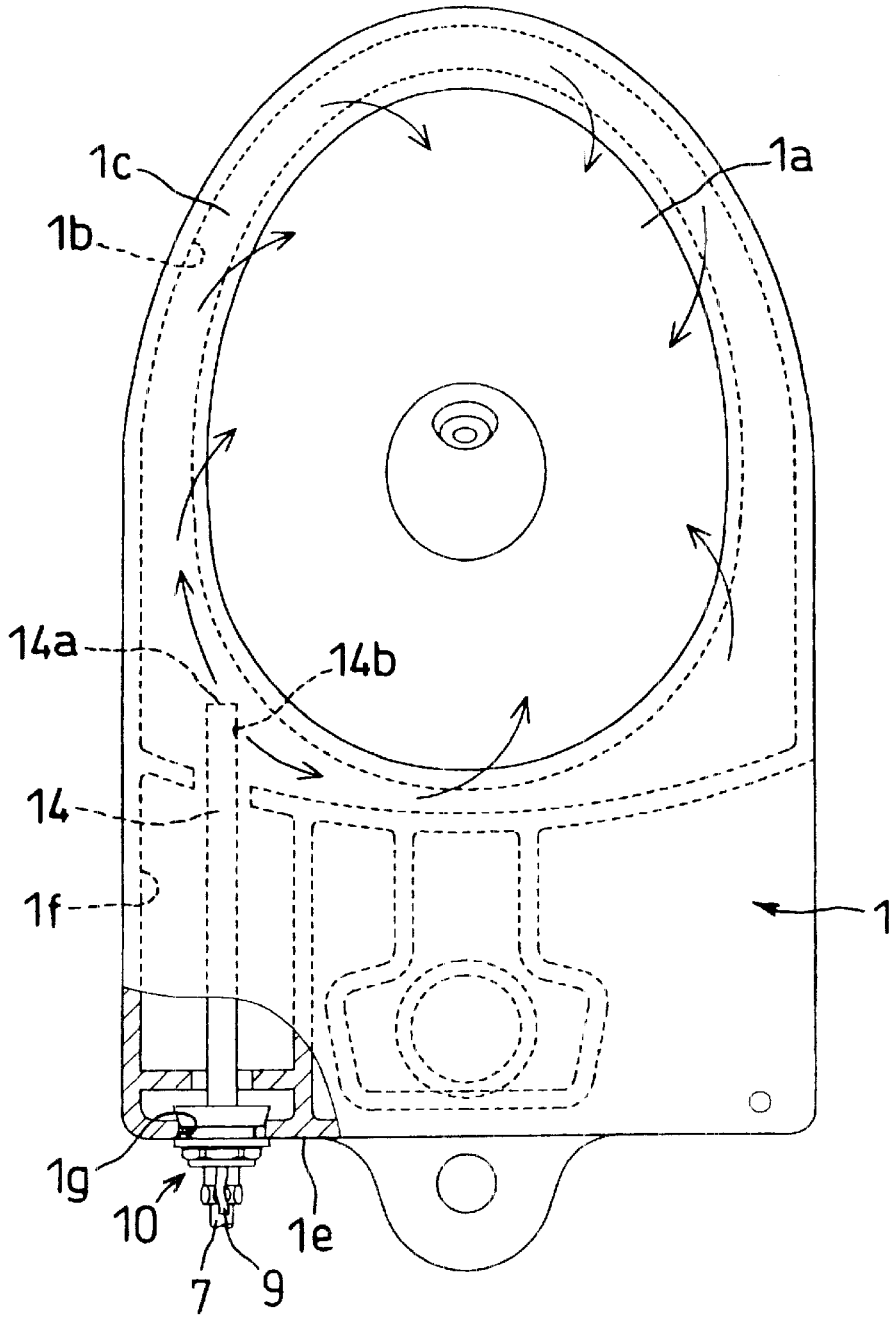
FIG. 3 is a plan view with a part in cross section of a tankless toilet of an embodiment 1 in the first invention.
Figure 4:
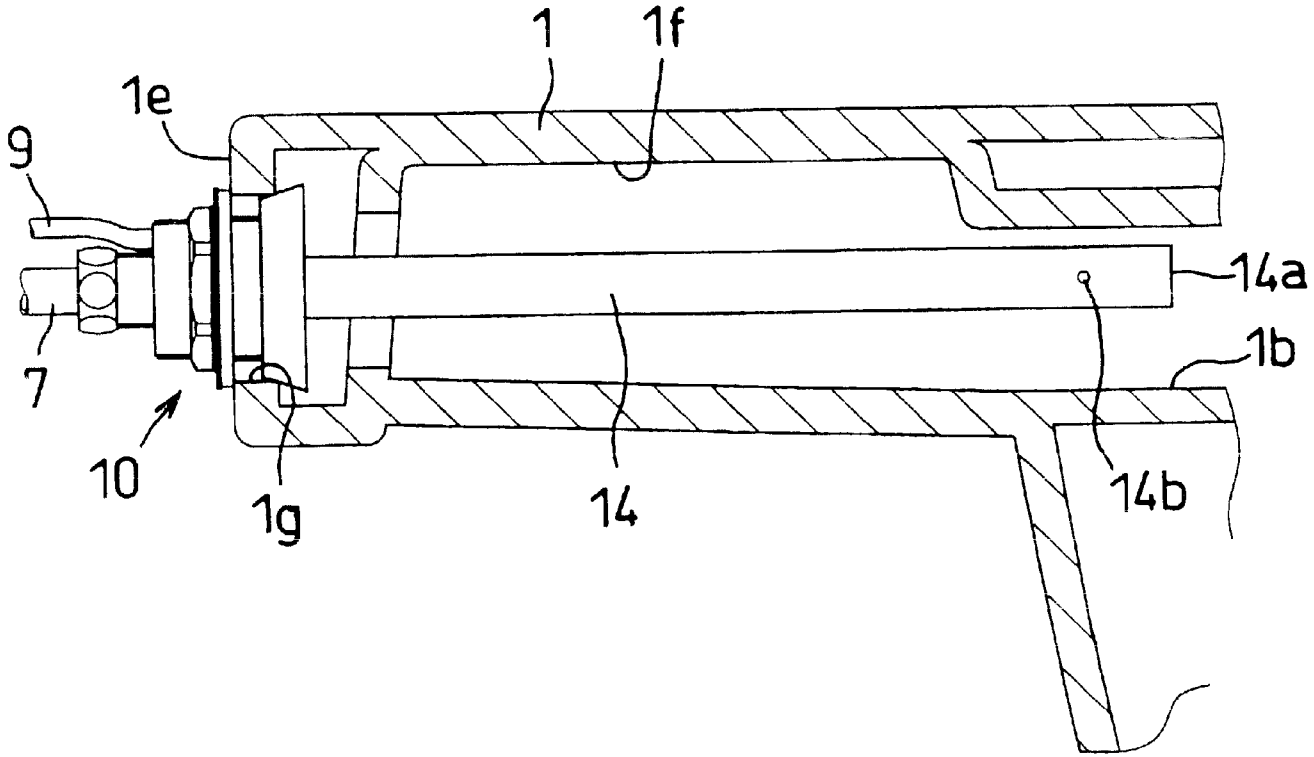
FIG. 4 is a longitudinal cross-sectional view in an enlarged form of an essential portion of a tankless toilet of an embodiment 1 in the first invention.

As shown in FIG. 3, the western-style toilet body 1 includes a bowl 1*a* which receives a waste, a rim 1*c* which is formed around an upper periphery of the bowl 1*a* and is provided with a rim channel 1*b* in the inside thereof and a trap 1*d* which is communicated with a bottom of the bowl 1*a* and drains the waste as shown in FIG. 1. As shown in FIG. 3 and FIG. 4, the rim channel 1*b* is connected to a rim water guide passage 1*f* concealed in a rear wall face 1*e* of the western-style toilet body 1 from behind. Further, as shown in FIG. 1, a jet nozzle 5 is mounted on an inlet of the trap 1*d*, here, a toilet seat and a toilet lid are omitted from the drawings.

The water supply device 3 includes an inlet port 3*a*, a first outlet port 3*b* and a second outlet port 3*c*, wherein water which is taken in through the inlet port 3*a* can be selectively supplied to the first outlet port 3*b* or second outlet port 3*c* and also such a supply of water to the first outlet port 3*b* and the second outlet port 3*c* can be selectively stopped. A flexible hose 6 which is connected to a water supply pipe such a city water service pipe or the like is connected to the inlet port 3*a* by way of a stop valve not shown in the drawings. A rim conduit 7 is connected to the first outlet port 3*b* and a jet conduit 8 is connected to the second outlet port 3*c*. Further, the water supply device 3 includes a vacuum breaker 3*d* and a tube 9 which works as a pipe is connected to an atmosphere-communication hole 3*e* of the vacuum breaker 3*d*. An intake opening not shown in the drawing which is communicated with the atmosphere above the uppermost surface of the rim channel 1*b* of the western-style toilet body 1 is formed in the tube 9 as a through hole.

Figure 2:
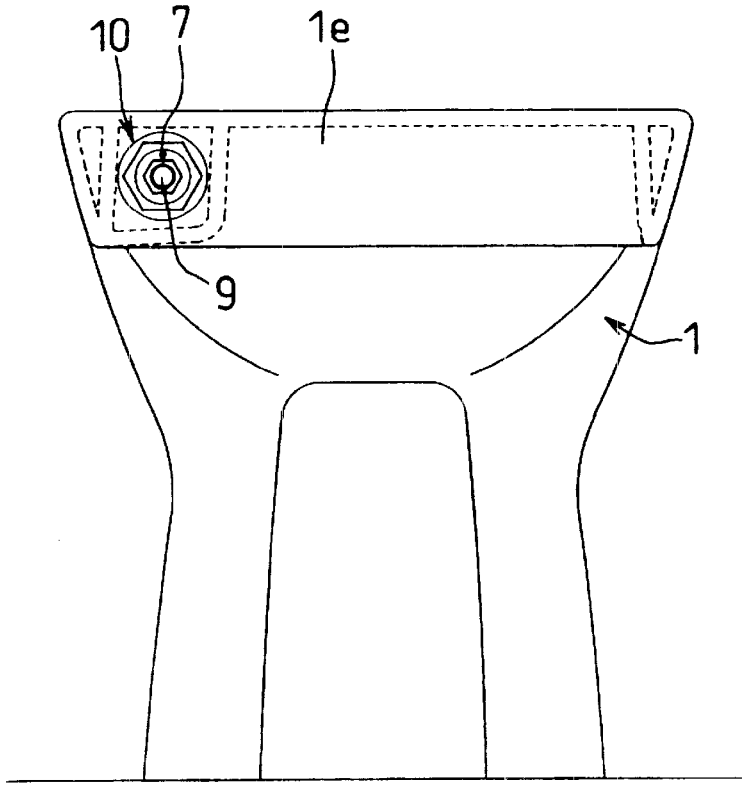
FIG. 2 is a back view of a tankless toilet of an embodiment 1 in the first invention.

As shown in FIGS. 2–4, the rim conduit 7 of the water supply device 3 is connected to the western-style toilet body 1 by a spud 10. That is, as shown in FIG. 3, a through hole 1*g* which is communicated with the rim water guide passage 1*f* is formed in the rear wall face 1*e* of the western-style toilet body 1 and the spud 10 is engaged in this through hole 1*g*.

Figure 5:
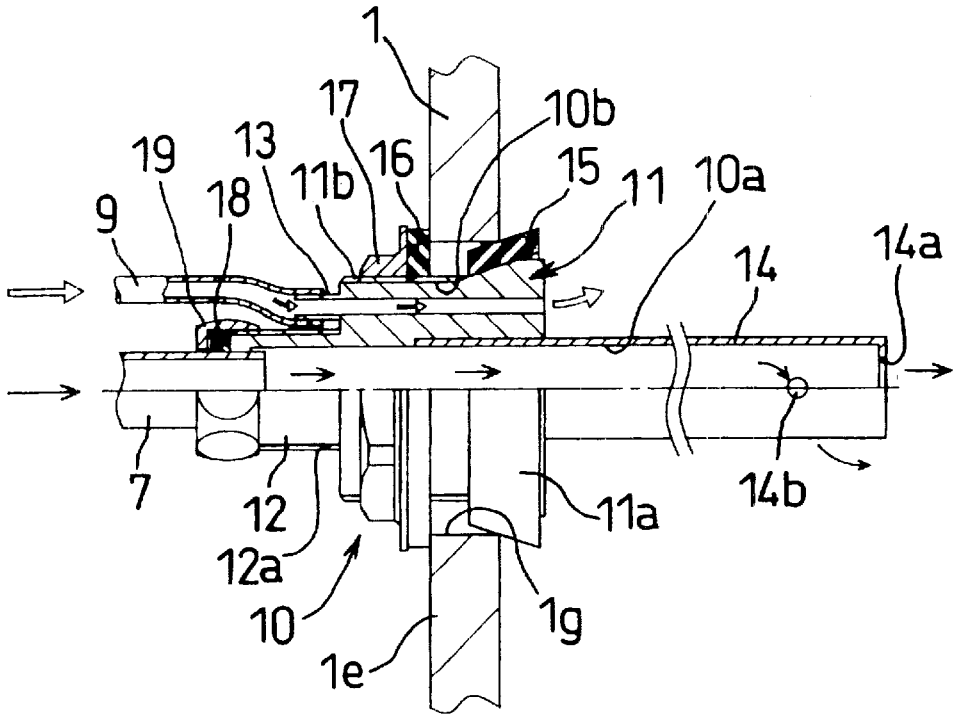
FIG. 5 is a cross-sectional view of a spud and the like according to a tankless toilet of an embodiment 1 in the first invention.
Figure 6:
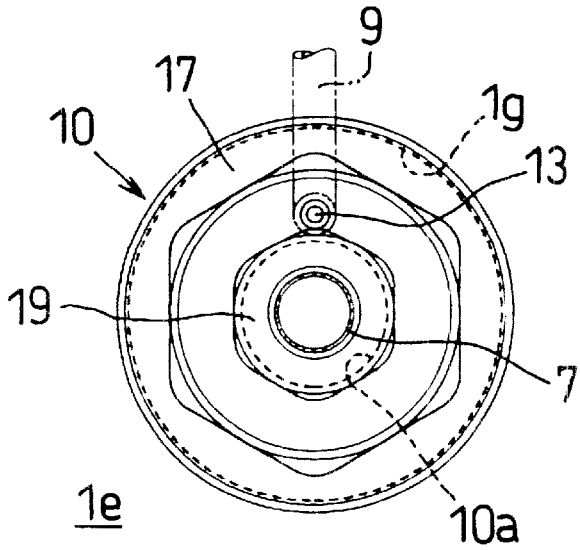
FIG. 6 is a back view of a spud according to a tankless toilet of an embodiment 1 in the first invention.

As shown in FIG. 5 and FIG. 6, the spud 10 includes a body portion 11 which is engaged with the through hole 1*g*, a first engaging portion 12 which is integrally formed with the body portion 11 and is engaged with the rim conduit 7, a second engaging portion 13 which is integrally formed with the body portion 11 and is engaged with the tube 9, and a guide portion 14 which is integrally formed with the body portion 11 and is extended into the inside of the rim channel 1*b*. A water supply passage 10*a* which is communicated with the rim conduit 7 is formed in the body portion 11, the first engaging portion 12 and the guide portion 14. Further, a water discharge passage 10*b* which is communicated with the tube 9 is formed in the inside of the body portion 11 and the second engaging portion 13.

A tapered surface 11*a* expanding outwardly toward the inner end side is formed on an outer periphery at the inner side of the body portion 11 and a male thread 11*b* is formed on an outer periphery of the body portion 11 at the outer end side from the tapered surface 11*a*. The first engaging portion 12 is formed on the outer end side of the body portion 11 such that the first engaging portion 12 is protruded from the body portion 11. A male thread 12*a* having a diameter smaller than that of the male thread 11*b* is formed on the outer periphery of the first engaging portion 12. Further, a cylindrical guide portion 14 is inserted into the inner end side of the body portion 11 under pressure. As shown in FIG. 3 and FIG. 4, the guide portion 14 is provided with a water spout opening 14*a* which makes the water supply passage 10*a* opened in one direction of the rim channel 1*b* and a water spout opening 14*b* which makes the water supply passage 10*a* opened in other direction of the rim channel 1*b*. A second engaging portion 13 is formed at the outer end side of the body portion 11 parallel to the first engaging portion 12.

Such a spud 10 is engaged with the through hole 1*g* of the western-style toilet body 1 as described hereinafter. First of all, a skirt packing 15 is fitted onto the outer side of the tapered surface 11*a* of the body portion 11 and the spud 10 is inserted into the inside of the through hole 1*g* of the western-style toilet body 1 from the inside of the rear wall face 1*e* together with the skirt packing 15. Thereafter, while sandwiching the rear end surface 1*e*, a flat packing 16 and a slip washer not shown in the drawing are fitted on the body portion 11 and a nut 17 with washer face is engaged with the male thread 11*b*. Subsequently, the rim conduit 7 is inserted into the water supply passage 10*a* of the first engaging portion 12 and an adjust packing 18 and a slip washer not shown in the drawing are fitted on the male thread 12*a* and a cap nut 19 is engaged with the male thread 12*a*. Thereafter, the tube 9 is fitted on the outer peripheral surface of the second engaging portion 13.

In the tankless toilet having the above-mentioned constitution, as shown in FIG. 1 and FIG. 3, water is supplied from the water supply pipe to the inlet port 3*a* of the water supply device 3 by way of the stop valve and the flexible hose 6. By opening the first outlet port 3*b* of the water supply device 3, this water is supplied from the first outlet port 3*b* to the rim channel 1*b* of the western-style toilet body 1 by way of the rim conduit 7. Accordingly, water is spouted into the bowl 1*a* so that the washing of the bowl 1*a* is performed. Further, by opening the second outlet port 3*c* of the water supply device 3, water is supplied from the second outlet 3*c* to the jet nozzle 5 by way of the jet conduit 8. Accordingly, a siphon action is forcibly generated in the trap 1*d*. At this point of time, since the atmosphere-communication hole 3*e* of the vacuum breaker 3*d* has the downstream side from the vacuum breaker 3*d* opened to the atmosphere through the intake opening and hence, even when the water supply pipe, the stop valve, the flexible hose 6 and the upstream side from these parts become negative pressure, it becomes possible to prevent the back flow of water in the rim channel 1*b* to the water supply device 3 and the upstream side from this part.

Further, in this tankless toilet, the western-style toilet body 1 includes the rim water guide passage 1*f* which is connected to the rim passage 1*b* from behind such that the rim water guide passage 1*f* is concealed in the rear wall surface 1*e* thus exhibiting the favorable appearance. Then, as shown in FIG. 5, the through hole 1*g* which is communicated with the rim water guide passage 1*f* is formed in the rear wall face 1*e* and the spud 10 having the water supply passage 10*a* and the water discharge passage 10*b* is engaged with the through hole 1*g*.

Accordingly, as shown in FIG. 4, in this tankless toilet, since the rim conduit 7 is communicated with the rim channel 1*b* without passing through the rim water guide passage 1*f* due to the water supply passage 10*a* of the spud 10, the water in the rim conduit 7 reaches the rim channel 1*b* through the water supply passage 10*a* of the spud 10 without flowing through the inside of the rim water guide passage 1*f*. Accordingly, the water spouting force toward the inside of the bowl 1*a* shown in FIG. 1 is maintained so that there is no fear that the washing ability is deteriorated.

Further, the atmosphere communication hole 3*e* of the water supply device 3 is connected with the water discharge passage 10*b* of the spud 10 by way of the tube 9 and is communicated with the rim water guide passage if by the water discharge passage 10*b* and hence, water leaked from the atmosphere-communication hole 3*e* of the water supply device 3 flows into the rim water guide passage if around the guide portion 14 of the spud 10 by means of the discharge water passage 10*b* which is independent from the water supply passage 10*a* relevant to the washing of the bowl 1*a* by way of the tube 9 and is made to return into the bowl 1*a* from the rim channel 1*b*.

Then, in this tankless toilet, by merely forming the through hole 1*g* for mounting the spud 10 in the western-style toilet body 1, the rim conduit 7 and the tube 9 connected to the atmosphere communication hole 3*e* can be connected to the western-style toilet body 1 and hence, the manufacturing becomes easy so that the manufacturing cost can be reduced.

Accordingly, with respect to this tankless toilet, the reduction of the manufacturing cost can be realized without deteriorating the washing ability of water in the rim channel 1*b*.

Further, in this tankless toilet, since the through hole 1*g* is formed in the rear wall face 1*e* of the western-style toilet body 1 and hence, the upper surface of the western-style toilet body 1 can ensure a wide area so that the tankless toilet can exhibit the further favorable appearance along with the effective utilization of the space.

Further, in this tankless toilet, since the guide portion 14 of the spud 10 is provided with a pair of water spout openings 14*a*, 14*b* through which water can be spouted into the rim channel 1*b* from both directions, even when the water pouring pressure is relatively low, the ability to wash the bowl 1*a* can be enhanced.

Embodiment 2

Figure 7:
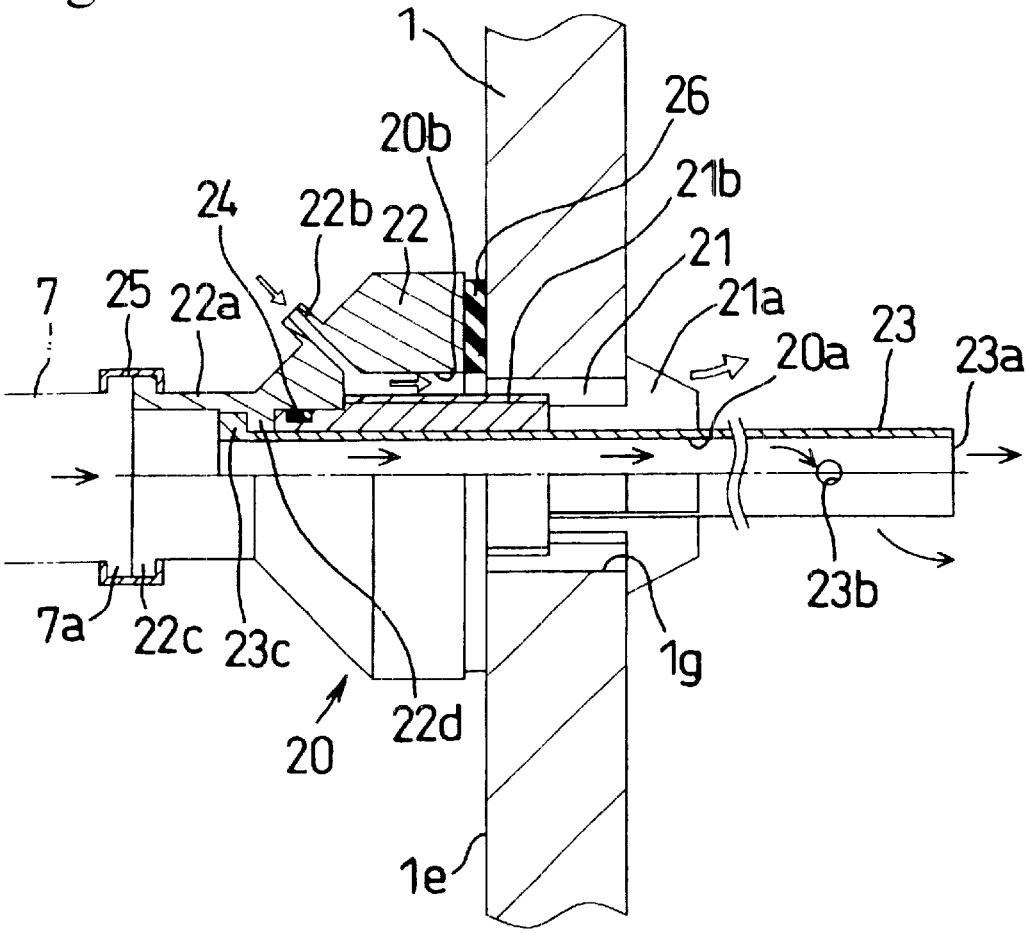
FIG. 7 is a cross-sectional view of a spud and the like according to a tankless toilet of an embodiment 2 in the first invention.
Figure 8:
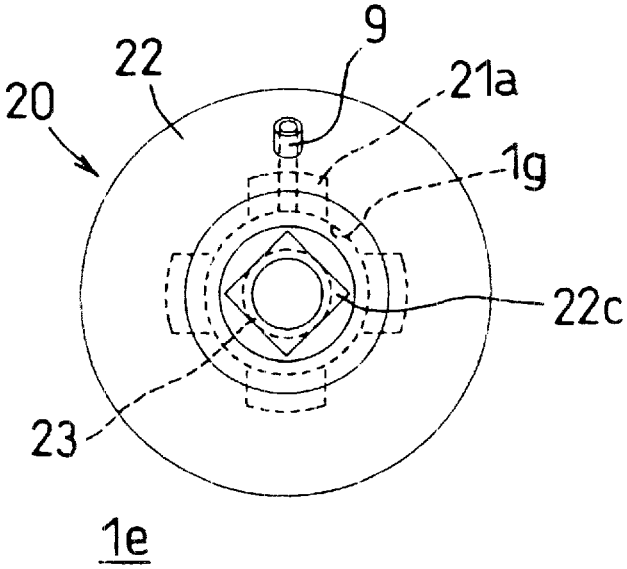
FIG. 8 is a back view of a spud according to a tankless toilet of an embodiment 2 in the first invention.

The tankless toilet of the second embodiment 2 adopts a spud 20 shown in FIG. 7 and FIG. 8. The other constitutions are identical to those of the embodiment 1.

The spud 20 includes a body portion 21 which is engaged with the through hole 1*g*, a housing 22 which is formed on the body portion 21 and a guide portion 23 which is mounted in the inside of the body portion 21 and the housing 22 and is extended into the inside of the rim channel 1*b*. A first engaging portion 22*a* which is engaged with the rim conduit 7 and a second engaging portion 22*b* which is engaged with the tube 9 are formed on the housing 22. A water supply passage 20*a* which is communicated with the rim conduit 7 is formed in the inside of the body portion 21, the housing 22 and the guide portion 23. Further, a water discharge passage 20*b* which is communicated with the tube 9 is formed between an outer surface of the body portion 21 and an inner surface of the housing 22.

A collet 21*a* having a distal end side thereof tapered and being divided into four pieces in a circumferential direction is formed on the inward side of the body portion 21 and a male thread 21*b* is formed on the outer periphery of outer end side as viewed from the collet 21*a*.

The housing 22 is engaged with a male thread 21*b* by way of an O ring 24 disposed at an outer end side of the body portion 21. The first engaging portion 22*a* is coaxially formed on the outer end of the housing 22 in a protruding manner and the second engaging portion 22*b* is formed on the outer periphery of the first engaging portion 22*a* in an inclined manner. A flange 22*c* is formed on the first engaging portion 22*a*.

Further, into the inner end side of the body portion 21, a cylindrical guide portion 23 having a flange 23*c* at the outer end thereof is inserted. The guide portion 23 includes a water spout opening 23*a* which makes the water supply passage 20*a* opened in one direction of the rim channel 1*b* and a water spout opening 23*b* which makes the water supply passage 20*a* opened in the other direction of the rim channel 1*b*.

The spud 20 is engaged with the through hole 1*g* of the western-style toilet body 1 as follows. First of all, the collet 21*a* of the body portion 21 has the diameter thereof narrowed and the body portion 21 is inserted into the through hole 1*g* of the western-style toilet body 1 from the outside of the rear wall face 1*e*. Thereafter, while inserting a packing 26 between the body portion 21 and the rear wall face 1*e*, the housing 22 is engaged with the male thread 21*b* of the body portion 21. Subsequently, the guide portion 23 is inserted into the inside of the water supply passage 20*a* of the first engaging portion 22*a* until the flange 23*c* is brought into contact with a shoulder portion 22*d* of the housing 22. Then, the flange 22*c* of the first engaging portion 22*a* and the flange 7*a* of the rim conduit 7 are engaged with each other by a clip 25 so that the rim conduit 7 is engaged with the first engaging portion 22*a*. Further, the tube 9 is fitted on the outer peripheral surface of the second engaging portion 22*b*.

With the tankless toilet having the above-mentioned constitution, the operation and the advantageous effect similar to those of the embodiment 1 can be also achieved.

Embodiment 3

Figure 9:
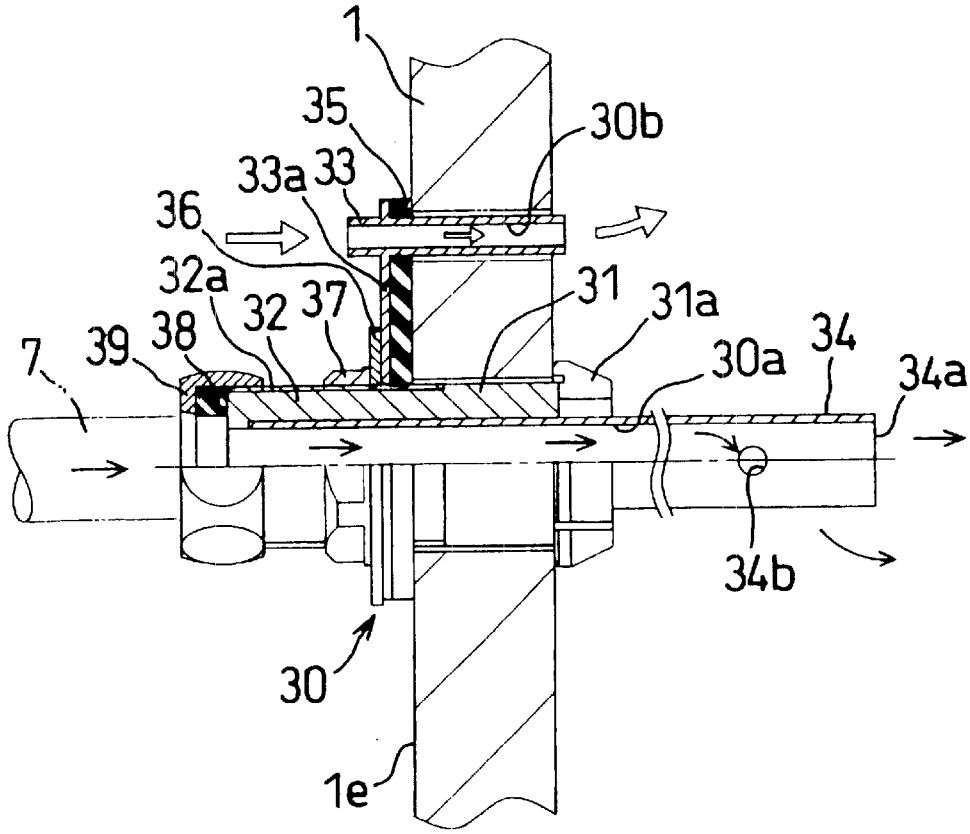
FIG. 9 is a cross-sectional view of a spud and the like according to a tankless toilet of an embodiment 3 in the first invention.
Figure 10:
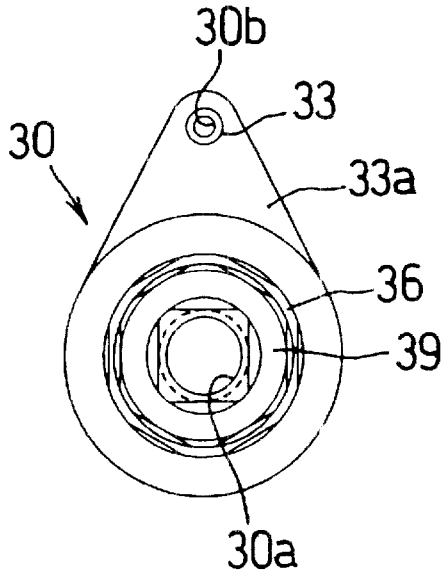
FIG. 10 is a back view of a spud according to a tankless toilet of an embodiment 3 in the first invention.

The tankless toilet of the third embodiment adopts a spud 30 shown in FIG. 9 and FIG. 10. Other constitutions are identical to those of the embodiment 1.

The spud 30 includes a body portion 31 which is engaged with a through hole 1*g*, a first engaging portion 32 which is formed integrally with the body portion 31 and is engaged with a rim conduit 7, a second engaging portion 33 which is formed in the body portion 31 and is engaged with a tube 9, and a guide portion 34 which is integrally formed with the body portion 31 and is extended into the inside of a rim channel 1*b*. A water supply passage 30*a* which is communicated with the rim conduit 7 is formed in the inside of the body portion 31, the first engaging portion 32 and the guide portion 34. Further, a water discharge passage 30*b* which is communicated with the tube 9 is formed in the inside of the second engaging portion 33.

A collet 31*a* having a distal end side thereof tapered and being divided into four pieces in a circumferential direction is formed on the inward side of the body portion 31. A male thread 32*a* is formed on the outer periphery of the second engaging portion 32 which is integrally formed with the body portion 31. Further, a cylindrical guide portion 34 is inserted into the body portion 31 under pressure. The guide portion 34 has a water spout opening 34*a* which makes the water supply passage 30*a* opened in one direction of the rim channel 1*b* and a water spout opening 34*b* which makes the water supply passage 30*a* opened in other direction of the rim channel 1*b*. Further, a flange 33*a* of the second engaging portion 33 is fitted into the body portion 31.

The spud 30 is engaged with the through hole 1*g* of a western-style toilet body 1 in a following manner. First of all, the body portion 31 and the first engaging portion 32 are inserted into the inside of the through hole 1*g* of the western-style toilet body 1 from the outside of a rear wall face 1*e* while narrowing the diameter of the collet 31*a* of the body portion 31. Thereafter, a flange 33*a* of the second engaging portion 33 is fitted on a male thread 32*a* of the body portion 31 while mounting a packing 35 between the flange 33*a* and a rear wall face 1*e* and a nut 37 is engaged with male thread 32*a* by way of a washer 36. Subsequently, the rim conduit 7 is inserted into the inside of the water supply passage 30*a* of the first engaging portion 32, an adjustment packing 38 and a slip washer not shown in the drawing are fitted on the rim conduit 7, and then a cap nut 39 is engaged with the male thread 32*a*. Thereafter, the tube 9 is fitted on the outer peripheral surface of the second engaging portion 33.

In the tankless toilet having the above-mentioned constitution, the same operation and advantageous effect as those of the embodiment 1 can be obtained.

Embodiment 4

Figure 11:
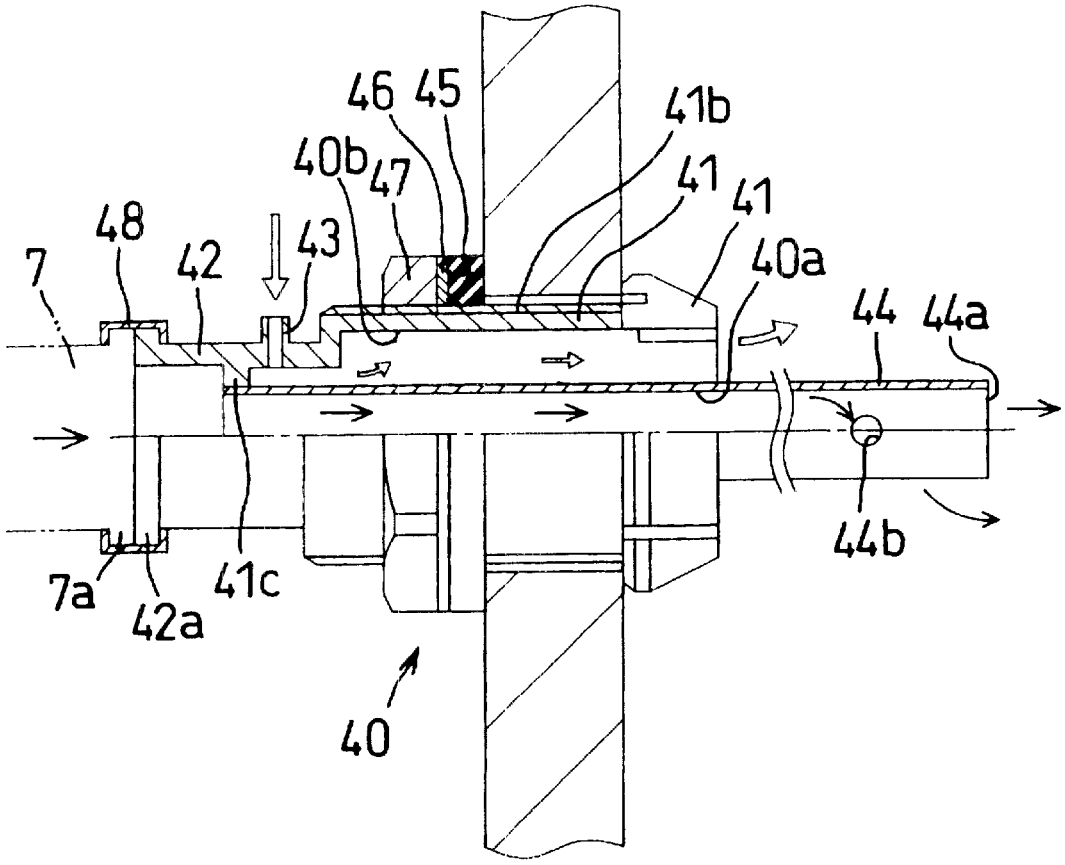
FIG. 11 is a cross-sectional view of a spud and the like according to a tankless toilet of an embodiment 4 in the first invention.
Figure 12:
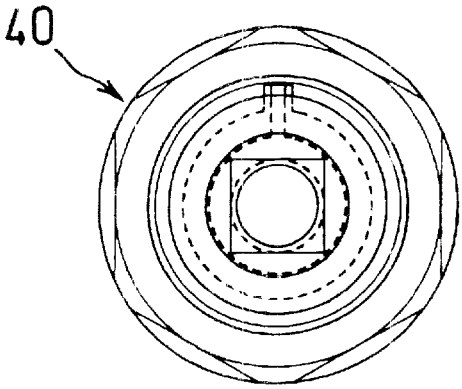
FIG. 12 is a back view of a spud according to a tankless toilet of an embodiment 4 in the first invention.

The tankless toilet of the fourth embodiment adopts a spud 40 shown in FIG. 11 and FIG. 12. Other constitutions are identical to those of the embodiment 1.

The spud 40 includes a body portion 41 which is engaged with a through hole 1*g*, a first engaging portion 42 which is formed integrally with the body portion 41 and is engaged with a rim conduit 7, a second engaging portion 43 which is integrally formed with the body portion 41 and is engaged with a tube 9, and a guide portion 44 which is integrally formed with the body portion 41 and is extended into the inside of a rim channel 1*b*. A water supply passage 40*a* which is communicated with the rim conduit 7 is formed in the inside of the first engaging portion 42 and the guide portion 44. Further, a water discharge passage 40*b* which is communicated with the tube 9 is formed by a space between the body portion 41 and the guide portion 44 and by the second engaging portion 43.

A collet 41*a* having a distal end side thereof tapered and being divided into four pieces in a circumferential direction is formed in the inward side of the body portion 41. A male thread 41*b* is formed on the outer periphery of the body portion 41 disposed at the outer end side as viewed from the collet 49*a*. Further, a shoulder portion 41*c* is formed on the inside of the body portion 41 and a cylindrical guide portion 44 is inserted into the shoulder portion 41*c* under pressure. In this manner, a water discharge passage 40*b* is formed by an inner surface of the main body 41 excluding the shoulder portion 41*c* and an outer surface of the guide portion 44. The guide portion 44 has a water spout opening 44*a* which makes the water supply passage 40*a* opened in one direction of the rim channel 1*b* and a water spout opening 44*b* which makes the water supply passage 40*a* opened in other direction of the rim channel 1*b*. A flange 42*a* is formed in the first engaging portion 42 which is formed integrally with the body portion 41. Further, between the body portion 41 and the first engaging portion 42, the second engaging portion 43 which is integrally formed with the body portion 41 and the first engaging portion 42 is protruded in the radial direction.

The spud 40 is engaged with the through hole 1*g* of a western-style toilet body 1 in a following manner. First of all, the body portion 41 and the first engaging portion 42 are inserted into the inside of the through hole 1*g* of the western-style toilet body 1 from the outside of a rearwall surface 1*e* while narrowing the diameter of the collet 41*a* of the body portion 41. Thereafter, a nut 47 is engaged with the male thread 41*b* by interposing a packing 45 and a washer 46 between the nut 47 and the rear wall surface 1*e*. Then, a flange 42*c* of the first engaging portion 42*a* and a flange 7*a* of the rim conduit 7 are clamped by a clip 48 so as to engage the rim conduit 7 with the first engaging portion 42. Further, the tube 9 is fitted on the outer peripheral surface of the second engaging portion 43. In the tankless toilet having the above-mentioned constitution, the same operation and advantageous effect as those of the embodiment 1 can be obtained.

Second Invention

An embodiment which embodies the second invention is explained in conjunction with drawings.

Figure 13:
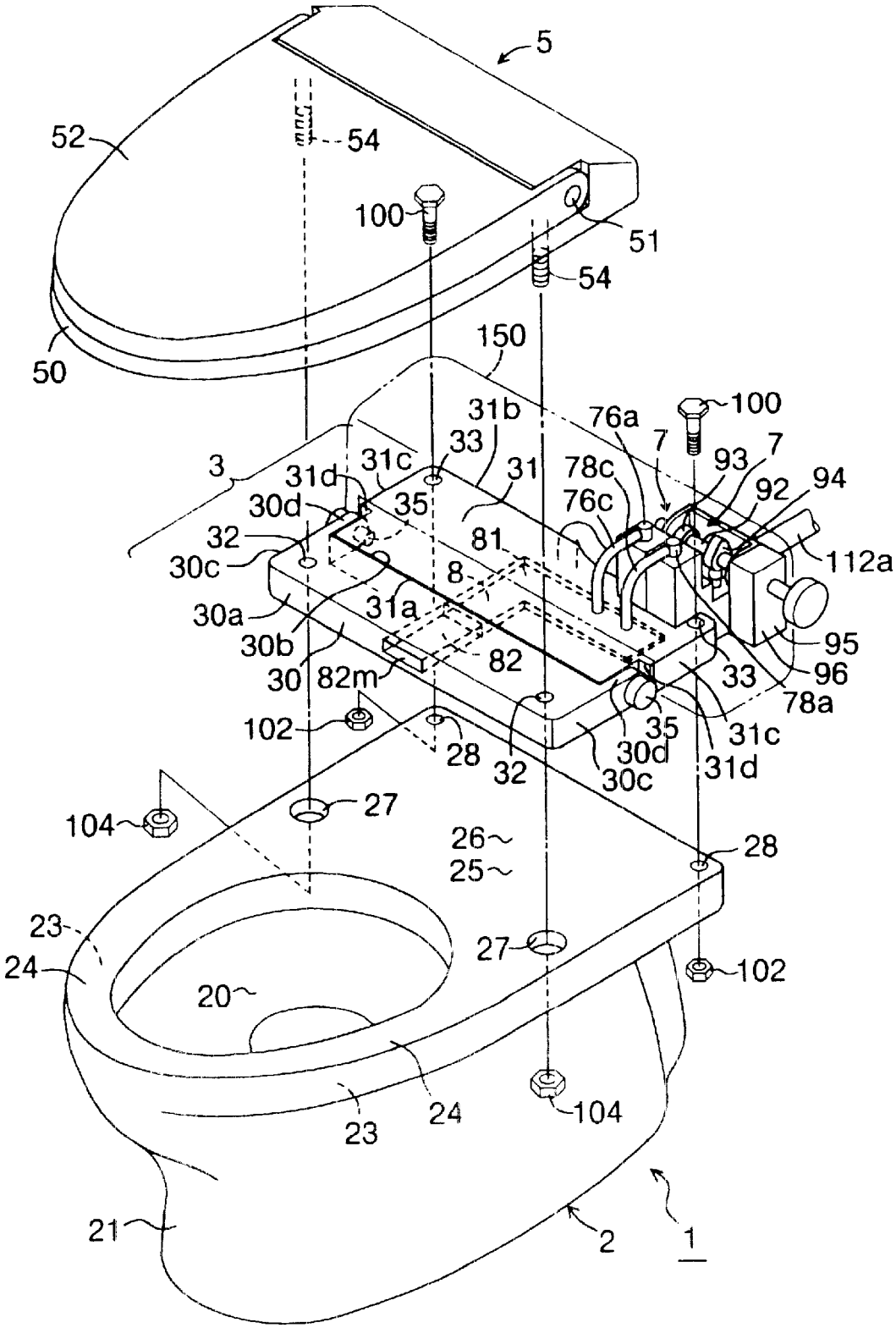
FIG. 13 is an exploded perspective view of a tankless toilet according to an embodiment in the second invention.

As shown in FIG. 13, the tankless toilet 1 according to the embodiment is of a tankless type which is not provided with a water tank such as a low tank and includes a western-style toilet body 2, a toilet seat/toilet lid device 5 and a toilet flushing device 7.

The western-style toilet body 2 is made of porcelain and includes a toilet bowl 21 having a bowl portion 20 which receives a waste, a rim 24 which is formed around an upper periphery of a front side of the toilet bowl 21 and defines a rim channel 23 in the inside thereof and a support portion 25 which is integrally formed with the toilet bowl 21 at a position behind the rim 24. A jet nozzle not shown in the drawing is provided in the vicinity of a bottom of the bowl portion 20. The support portion 25 is extended rearwardly in a plate form at the rear portion of the western-style toilet body 2 and is provided with a flattened support surface 26 having an approximately same height as that of the rim 24. A fixed plate 3 made of hard resin is detachably fixedly secured to the support portion 25.

The fixed plate 3 has a quadrangular shape and is provided with a toilet seat/toilet lid device mounting portion 30 at the front side thereof and a toilet flushing device mounting portion 31 at the rear side thereof. The fixed plate 3 works as a common plate for mounting a toilet seat/toilet lid device 5 and a toilet flushing device 7 in common.

Figure 14:
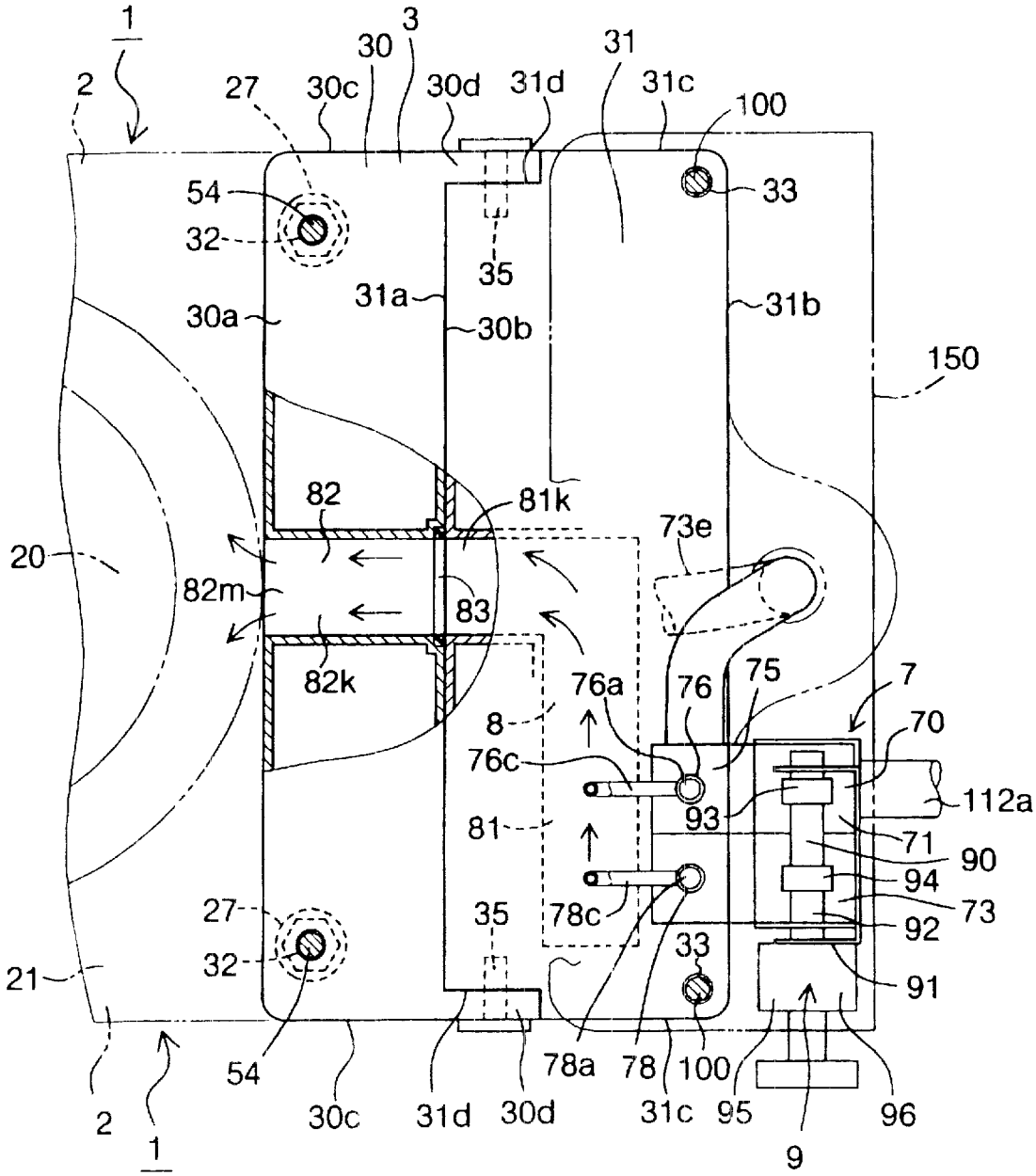
FIG. 14 is a plan view of an essential part in the vicinity of a fixed plate of a tankless toilet according to an embodiment in the second invention.

As shown in FIG. 14, the toilet seat/toilet lid device mounting portion 30 of the fixed plate 3 has an approximately quadrangular plate shape with flat upper and lower surfaces thereof and is provided with a front side portion 30*a* and a rear side portion 30*b* which are parallel to each other, lateral side portions 30*c* which are parallel to each other and protruding portions 30*d* which are protruded rearwardly from both sides of the widthwise direction.

Further, the toilet flushing device mounting portion 31 of the fixed plate 3 has an approximately quadrangular plate shape with flat upper and lower surfaces thereof and includes a front side portion 31*a* and a rear side portion 31*b* which are parallel to each other, lateral side portions 31*c* which are parallel to each other and recessed portions 31*d* which are formed on the lateral side portions 31*c* and into which the protruding portions 30*d* of the toilet seat/toilet lid mounting portion 30 is fitted.

In a boundary region between the toilet seat/toilet lid device mounting portion 30 and the toilet flushing device mounting portion 31 which constitute the fixed plate 3, pivot shaft portions 35 having axes along the lateral direction which are two in total are provided to both ends of the widthwise direction. The pivot shaft portions 35 function as hinge means and hence, the toilet seat/toilet lid device mounting portion 30 and the toilet flushing device mounting portion 31 which constitute the fixed plate 3 are made tiltable in the vertical direction. That is, the fixed plate 3 is tiltable in the vertical direction and hence is foldable. Due to such a constitution, the toilet seat/toilet lid device mounting portion 30 which constitutes the front side of the fixed plate 3 is tiltable in the vertical direction relative to the toilet flushing device mounting portion 31 which constitutes the rear side of the fixed plate 3.

With respect to the front portion of the toilet seat/toilet lid device mounting portion 30 of the fixed plate 3, toilet seat/toilet lid mounting holes 32 which are two in total are formed in both end sides of the widthwise direction such that they penetrate the end sides in the vertical direction. Further, with respect to the rear portion of the toilet flushing device mounting portion 31 of the fixed plate 3, mounting holes 33 which are two in total are formed in both end sides of the widthwise direction such that they penetrate the both sides in the vertical direction.

As shown in FIG. 13, the toilet seat/toilet lid device 5 includes a toilet seat 50 having a shape which follows the rim 24 of the western-style toilet body 2, a toilet lid 52 which is titably provided above the toilet seat 50 by means of support shafts 51 and mounting bolts 54 which are formed on the toilet seat 50 in a downwardly protruding manner such that the mounting bolts 54 are protruded downwardly from the toilet seat 50. The mounting bolts 54 function as mounting means and have male thread portions at distal ends thereof. The mounting bolts 54 which are two in total are provided at both sides of the widthwise direction of the toilet seat/toilet lid device 5.

With respect to the above-mentioned support portion 25 of the western-style toilet body 2, at the bowl portion 20 side thereof, through holes 27 which are two in total and penetrate the western-style toilet body 2 in the vertical direction are provided at both side of the widthwise direction. The position of the through holes 27 of the western-style toilet body 2, the position of the mounting bolt 54 of the toilet seat/toilet lid device 5 and the position of the toilet seat/toilet lid mounting holes 32 of the fixed plate 3 are arranged at corresponding positions such that they can be overlapped or aligned with each other. The bore diameter of the through holes 27 is set larger than the bore diameter of the toilet seat/toilet lid mounting holes 32 of the fixed plate 3 and the diameter of the male thread portions of the mounting bolts 54. Due to such a constitution, the position of the mounting bolts 54 of the toilet seat/toilet lid device 5 which are inserted into the through holes 27 can be adjusted in the planar direction of the support surface 26.

As shown in FIG. 13 and FIG. 14, the toilet flushing device 7 is fixedly secured to one side of the toilet flushing device mounting portion 31 of the fixed plate 3. The toilet flushing device 7 is provided for supplying water to wash the bowl portion 20 of the toilet bowl 21 and includes valve means 70 having an open/close function and a vacuum breaker 75 which suppresses backflow water due to the reduced pressure derived from the open/close manipulation of the valve means 70.

Figure 15:
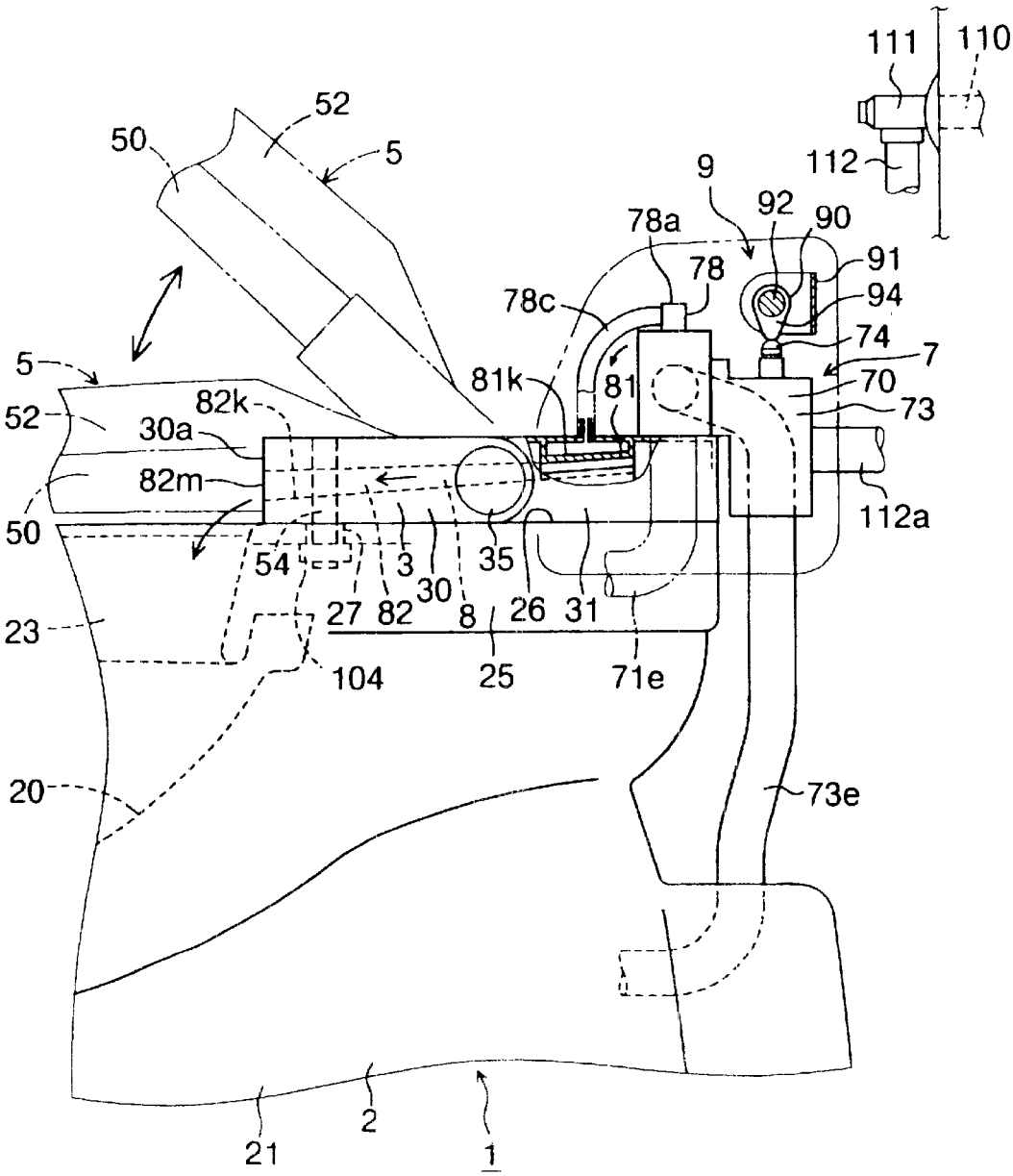
FIG. 15 is a side view of an essential part in the vicinity of a fixed plate of a tankless toilet according to an embodiment in the second invention.

The valve means 70 is provided for supplying water to the inside of the toilet bowl 21 of the western-style toilet body 2 for washing the toilet bowl 21 and for stopping such a supply of water. The valve means 70 is constituted of a rim open/close valve 71 and a jet open/close valve 73 which are arranged adjacent to each other. As shown in FIG. 15, an outlet port of the rim open/close valve 71 is connected to the rim channel 23 by way of a rim conduit 71*e* so as to supply water to the rim channel 23. An outlet port of the jet open/close valve 73 is connected to the jet nozzle by way of a jet conduit 73*e* so as to supply water to the jet nozzle.

The vacuum breaker 75 is provided to the valve means 70 for preventing the backflow of water in the above-mentioned valve means 70 and includes a first vacuum breaker 76 which is mounted on the rim open/close valve 71 and a second vacuum breaker 78 which is mounted on the jet open/close valve 73. The first vacuum breaker 76 includes a first intake opening 76*a* which is communicated with the atmosphere and a first discharge pipe 76*c* which allows the back flow water to flow there through. The second vacuum breaker 78 includes a second intake opening 78*a* which is communicated with the atmosphere and a secoond discharge pipe 78*c* which allows the backflow water to flow therethrough.

As shown in FIG. 14, in the inside of the fixed plate 3, a guide passage 8 which functions as a guide unit which guides the backflow water from the vacuum breaker 75 to the inside of the bowl portion 20 of the western-style toilet body 2 is formed. The guide passage 8 includes a first guide passage 81 which is formed in the inside of the toilet flushing device mounting portion 31 of the fixed plate 3 and a second guide passage 82 which is formed in the inside of the toilet seat/toilet lid device mounting portion 30 of the fixed plate 3 such that the second guide passage 82 is communicated with the first guide passage 81 and has a front end opening 82*m* facing the bowl portion 20. A first bottom surface 81*k* of the first guide passage 81 and a second bottom surface 82*k* of the second guide passage 82 are both gradually inclined in a descending manner toward the bowl portion 20 so as to make the backflow water flow downwardly toward the bowl portion 20.

The first guide passage 81 is communicated with a front end of the first discharge pipe 76*c* and a front end of the second discharge pipe 78*c* and hence, even when the backflow water is generated, the backflow water is made to flow through the first guide passage 81 by way of the first discharge pipe 76*c* and the second discharge pipe 78*c* and then is made to flow down through the second guide passage 82 and then is discharged into the inside of the bowl portion 20 of the western-style toilet body 2 from a front end opening 82*m*.

As shown in FIG. 14, the first guide passage 81 has a plan shape formed in an L-shape and the second guide passage 82 has a plan shape formed in a straight shape. At a boundary region between the first guide passage 81 and the second guide passage 82, a seal member 83 made of resilient material such as rubber or soft resin or the like which suppresses the leakage of water is provided.

As shown in FIG. 13 to FIG. 15, the toilet flushing device 7 fixedly secured to the toilet flushing device mounting portion 31 of the fixed plate 3 is provided with a drive device 9 which performs the opening/closing of the valve means 70. The drive device 9 is provided for performing the opening/closing of the rim open/close valve 71 and the opening/closing of the jet open/close valve 73 and includes a cam device 90 and a motor device 95 which drives the cam device 90. The cam device 90 is disposed above the valve means 70 and includes a rotary shaft 92 which is rotatably held in a horizontal state on a mounting lug 91 held on the toilet flushing device mounting portion 31 of the fixed plate 3 and a first cam 93 and a second cam 94 which are juxtaposed on the rotary shaft 92 such that these cams are protruded in the direction perpendicular to the axis of the rotary shaft 92. The rotary shaft 92 is formed in an extended manner along the widthwise direction of the western-style toilet body 2.

The motor device 95 is fixedly secured to the mounting lug 91 and incorporates a motor 96 and reduction gears which transmit a rotational force of the motor 96 to the rotary shaft 92. The rotary shaft 92 is rotatably driven based on a control by a controller not shown in the drawing. When the rotary shaft 92 is rotated by the motor device 95, the first cam 93 and the second cam 94 are rotated.

Subsequently, the manner of assembling the fixed plate 3 to the western-style toilet body 2 is explained. As can be understood from FIG. 13, in the tankless toilet 1, the toilet flushing device 7 is preliminarily mounted on the toilet flushing device mounting portion 31 of the fixed plate 3. Under such a condition, the fixed plate 3 is mounted on the support portion 25 of the western-style toilet body 2 in the state that the mounting holes 33 of the fixed plate 3 face the fixed plate mounting holes 28 of the western-style toilet body 2 in an opposed manner. Further, bolt members 100 which constitute mounting means are made to pass through the mounting holes 33 and the fixed plate mounting holes 28 and first nut members 102 are fastened to male thread portions of the bolt members 100 whereby the toilet flushing device mounting portion 31 of the fixed plate 3 can be detachably fixedly secured to the support surface 26 of the support portion 25 of the western-style toilet body 2.

Further, the mounting bolts 54 of the toilet seat/toilet lid device 5 are made to sequentially pass through the toilet seat/toilet lid mounting holes 32 of the toilet seat/toilet lid device mounting portion 30 of the fixed plate 3 and the through holes 27 of the western-style toilet body 2. In this state, second nut members 104 are fastened to the male thread portions formed on the front ends of the mounting bolts 54. In this manner, while detachably fixing the toilet seat/toilet lid device 5 to the toilet seat/toilet lid device mounting portion 30 of the fixed plate 3, the toilet seat/toilet lid device mounting portion 30 of the fixed plate 3 is detachably fixedly secured to the support portion 25 of the western-style toilet body 2. Then, a cover 150 is detachably mounted on the toilet flushing device 7 and the like to cover the toilet flushing device 7 and the like.

As shown in FIG. 15, a water supply pipe 110 such as a city water service pipe or the like which constitutes a water supply source is mounted in a wall of a room in which the tankless toilet 1 is installed. A flexible hose 112 led from a stop valve 111 mounted on the water supply pipe 110 has a front end portion 112*a* thereof connected to the inlet port of the valve means 70 of the toilet flushing device 7. Due to such a constitution, water supplied from the water supply pipe 110 is supplied to the rim open/close valve 71 and the jet open/close valve 73.

Subsequently, the manner of washing the bowl portion 20 of the western-style toilet body 2 is explained hereinafter. In this tankless toilet 1, based on the switch manipulation by a user, the motor 96 of the drive device 9 is driven in response to a signal from the controller so that the rotary shaft 92 is rotatably driven. Accordingly, the first rim water-flow manipulation is performed. That is, a cam surface of the first cam 93 pushes a shaft not shown in the drawing of the rim open/close valve 71 downwardly so as to open the rim open/close valve 71. Accordingly, water is supplied to the rim conduit 71*e* by way of the outlet port of the rim open/close valve 71 and then is supplied to the rim channel 23 whereby an inner wall surface of the bowl portion 20 is washed.

Along with the continuing drive of the cam device 90, the first cam 93 no more pushes the shaft of the rim open/close valve 71 downwardly so that the rim open/close valve 71 is closed by a return spring omitted from the drawing. Thereafter, the second cam 94 pushes a shaft not shown in the drawing of the jet open/close valve 73 downwardly so as to open the jet open/close valve 73. Accordingly, the jet water-flow manipulation is performed. That is, a cam surface of the second cam 94 pushes the shaft of the jet open/close valve 73 downwardly so as to open the jet open/close valve 73. Accordingly, the water is supplied to the jet conduit 73*e* by way of the outlet port of the jet open/close valve 73 and then is supplied to the jet nozzle whereby the siphon action is forcibly generated.

Subsequently, along with the continuing drive of the cam device 90, the cam surface of the second cam 94 no more pushes the shaft of the jet open/close valve 73 so that the jet open/close valve 73 is closed by a return spring omitted from the drawing. Thereafter, the cam surface of the first cam 93 again pushes the shaft of the rim open/close valve 71 downwardly so as to open the rim open/close valve 71 again. Accordingly, the second rim water-flow manipulation is performed. That is, the water is supplied to the rim channel 23 by way of the rim open/close valve 71 and then the water is made to flow downwardly along the inner wall surface of the bowl portion 20. Accordingly, the bowl portion 20 is sealed with water and the washing of the bowl portion 20 is completed.

Then, the manner of cleaning the tankless toilet is explained hereinafter. With respect to this tankless toilet 1, when stains are generated in a minute gap between the western-style toilet body 2 and the toilet seat/toilet lid device 5 or the toilet flushing device 7 and a cleaning person wants to clean the western-style toilet body 2, the cleaning person can remove the toilet seat/toilet lid device 5 and the toilet flushing device 7 from the western-style toilet body 2 by removing the fixed plate 3 from the support portion 25 of the western-style toilet body 2. In this manner, this tankless toilet 1 does not require many steps to clean the western-style toilet body 2 and hence, the tankless toilet 1 exhibits the high cleaning performance of the western-style toilet body 2. Particularly, in this tankless toilet 1, only the toilet seat/toilet lid device 5 can be tilted vertically relative to the western-style toilet body 2 while fixing the toilet seat/toilet lid device 5 to the fixed plate 3 and hence, the cleaning performance of the support portion 25 of the western-style toilet body 2 concealed at the front side of the fixed plate 3 can be enhanced. Further, in this tankless toilet 1, since only the rear side of the fixed plate 3 is fixedly secured to the western-style toilet body 2 by means of the fixed plate mounting holes 28 of the support portion 25, the fixed plate 3 can be easily removed together with the toilet seat/toilet lid device 5 so that the tankless toilet 1 can exhibit the high cleaning performance of the western-style toilet body 2.

Further, in this tankless toilet 1, since the fixed plate 3 can be used as a common plate which mounts both of the toilet seat/toilet lid device 5 and the toilet flushing device 7 together on the western-style toilet body 2, the mounting performance is enhanced and the number of parts can be reduced.

Further, in this tankless toilet 1, since the backflow water discharged from the first and second intake openings 76*a*, 78*a* of the first and second vacuum breakers 76, 78 can be guided into the western-style toilet body 2 by means of the first and second guide passages 81, 82 formed in the inside of the fixed plate 3, the contamination derived from the backflow water can be prevented without necessitating a special pipe.

Third Invention

An embodiment which embodies the third invention is explained hereinafter in conjunction with drawings.

Figure 16:
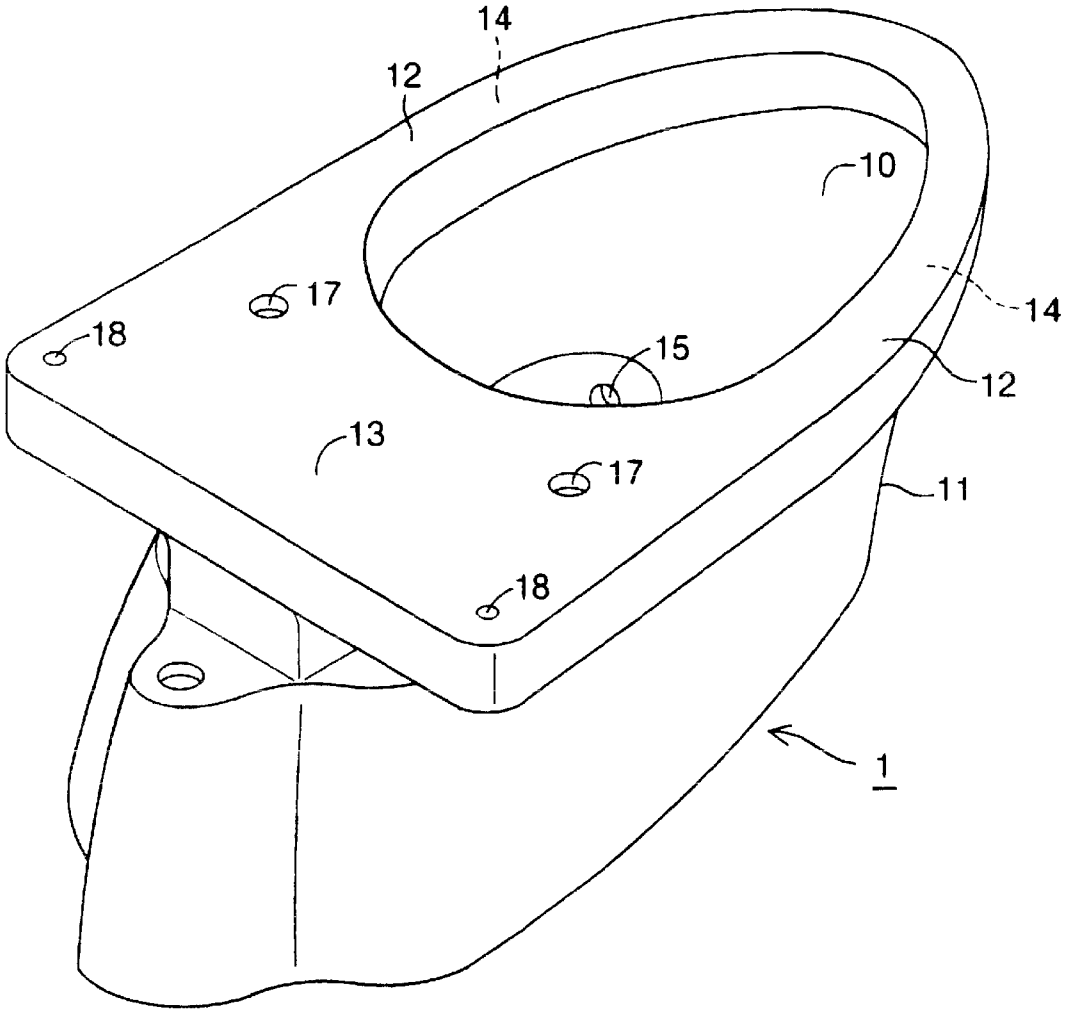
FIG. 16 is a perspective view showing a western-style toilet body of a tankless toilet according to an embodiment in the third invention.

The tankless toilet according to this embodiment is a western-style flush toilet having no water tank and is provided with a western-style toilet body 1 which features this embodiment as shown in FIG. 16.

This western-style toilet body 1 is made of porcelain. This western-style toilet body 1 includes a toilet bowl portion 11 having a bowl portion 10 which receives a waste, a flat rim 12 which is formed in an approximately U shape on an upper peripheral portion of the front side of the toilet bowl portion 11 and a mounting surface 13 which is formed of a flat horizontal surface having a wide area at the rear side of the toilet bowl portion 11. A jet nozzle mounting hole 15 is formed in a bottom of the bowl portion 10. A rim channel 14 which supplies water into the inside of the bowl portion 10 is formed in the inside of the rim 12. As will be understood from the description made later, on the mounting surface 13, a separate-type toilet flushing device 2 (see FIG. 17 and the like) can be mounted or a unitary-type toilet flushing device 8 (see FIG. 21) which constitutes a separate type can be mounted. Accordingly, the mounting surface 13 functions as a common mounting surface.

A plurality of, that is, a pair of toilet seat mounting holes 17 are formed in the mounting surface 13 of the western-style toilet body 1 such that these holes 17 penetrate the mounting surface 13 in the vertical direction. The distance between these toilet mounting holes 17 is set to 140 mm. At the rear portion of the mounting surface 13 of the western-style toilet body 1, a plurality of, that is, a pair of toilet flushing device mounting holes 18 are formed such that these holes 18 penetrate the mounting surface 13 in the vertical direction. In the western-style toilet body 1, the toilet flushing device mounting holes 18 are formed behind the toilet seat mounting holes 17. As will be understood from the description made later, with use of the toilet flushing device mounting holes 18, the separate-type toilet flushing device 2 (see FIG. 17 and the like) can be mounted by way of the common base plate 3 and the unitary-type toilet flushing device 8 (see FIG. 21) which constitutes a separate-type can be mounted by way of the common base plate 3 and hence, the toilet flushing device mounting holes 18 function as common mounting holes.

Figure 17:
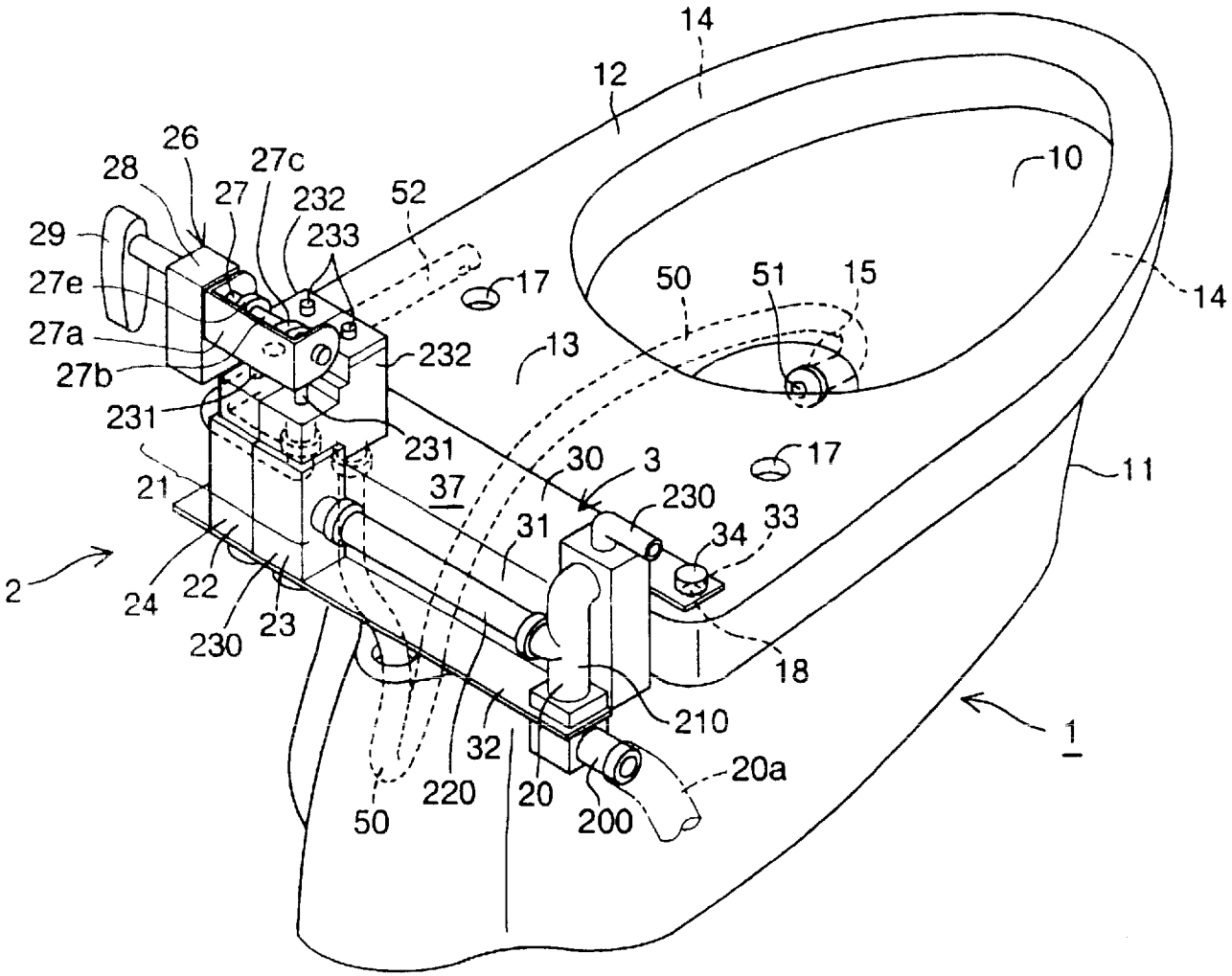
FIG. 17 is a perspective view showing a state in which a separate-type toilet flushing device is mounted on a western-style toilet body of a tankless toilet according to an embodiment in the third invention.
Figure 18:
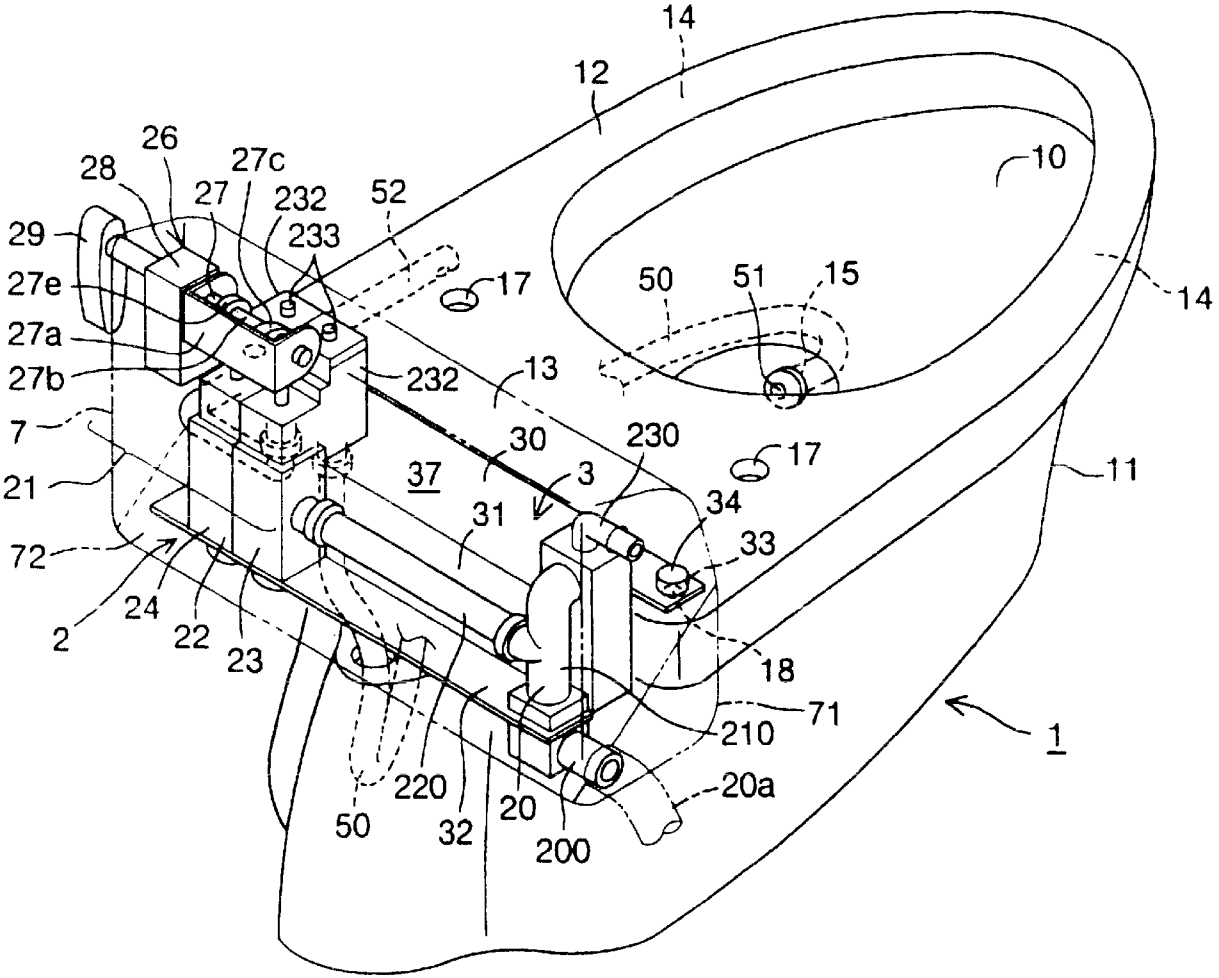
FIG. 18 is a perspective view showing a state in which an inner cover covers a separate-type toilet flushing device which is mounted on a western-style toilet body of a tankless toilet according to an embodiment in the third invention.

FIG. 17 and FIG. 18 show the state in which the separate-type toilet flushing device 2 is mounted on the western-style toilet body 1 by way of the common base plate 3. The separate-type toilet cleaning device 2 is a toilet flushing device of a type which can be mounted on the western-style toilet body 1 separately from the toilet seat/toilet lid device 4 (see FIG. 19). Further, the common base plate 3 includes an upper horizontal plate portion 30 which is formed in an extended manner in the horizontal direction on the upper surface of the rear portion of the western-style toilet body 1 and has bolt through holes 33 at end portions, a longitudinal plate portion 31 which is formed in an extended manner in the vertical direction from the upper horizontal plate portion 30 and is arranged along a side surface of the rear portion of the western-style toilet body 1, and a lower horizontal plate portion 32 which is formed in an extended manner in the horizontal direction at the lower portion of the longitudinal plate portion 31. First mounting bolts 34 are made to pass through the toilet flushing device mounting holes 18 of the western-style toilet body 1 by way of the bolt through holes 33 and nuts not shown in the drawings are engaged with the first mounting bolt 34 so that the common base plate 3 is fixedly secured to the western-style toilet body 1. In this manner, the common base plate 3 and eventually the separate-type toilet flushing device 2 can be detachably mounted on the western-style toilet body 1. Above the upper horizontal plate portion 30 of the common base plate 3, a tank housing space 37 which can house a hot water tank 44 (see FIG. 20) which constitutes other mechanism is formed.

The separate-type toilet flushing device 2 is mounted on the common base plate 3. This separate type toilet flushing device 2 includes a branch water supply device 20 which is connected to a stop valve not shown in the drawing which is connected to a water supply pipe such as a city water service pipe or the like not shown in the drawing by way of a flexible hose 20*a* and a flushing mechanism 21 which receives the supply of water from the branch water supply device 20 and is capable of washing the bowl portion 10.

The branch water supply device 20 includes a main pipe 210 which is provided with a water supply opening 200 which is connected to the flexible hose 20*a* having flexibility, a main conduit 220 which connects the main pipe 210 and the flushing mechanism 21 and is interposed between the main pipe 210 and the flushing mechanism 21 so as to supply the water to the flushing mechanism 21 and a branch pipe 230 which is usually closed and is opened at the time of use for allowing the branching of the water flow.

The flushing mechanism 21 includes valve means 22 which is arranged at one end side of the common base plate 3 and a drive device 26 which drives the valve means 22. The valve means 22 which constitutes a major component of the flushing mechanism 21 is formed by integrally assembling a first open/close valve 23 for jetting which performs the supply of water to a jet nozzle 51 and the stop of such a supply of water and a second open/close valve 24 for rim which performs the supply of water to a rim channel 14 or the stop of such a supply of water in a juxtaposed manner.

The first open/close valve 23 for jetting includes a housing 230 having a piston chamber not shown in the drawing in the inside thereof, a vertical-type rod 231 connected to an upper portion of a piston not shown in the drawing which is slidably held in the piston chamber, a connecting member 232 which is connected to the front side of the housing 230 and a vacuum breaker 233 which is mounted on an upper end of the connecting member 232. The vacuum breaker 233 is communicated with the atmosphere and is provided for suppressing the generation of negative pressure which is brought about along with the opening and closing of the first open/close valve 23 thus preventing the backflow of water derived from the generation of the negative pressure.

The second open/close valve 24 for rim has substantially the same constitution as that of the first open/close valve 23 for jetting and includes a housing 230, a vertical-type rod 231, a connecting member 232 and a vacuum breaker 233. A piston chamber of the second open/close valve 24 is communicated with the piston chamber of the first open/close valve 23 by way of a communication port not shown in the drawing and water is supplied to the second open/close valve 24 from the main conduit 220 of the branch water supply device 20 by way of the first open/close valve 23.

The drive device 26 is provided for opening or closing both of open/close valves 23, 24. This drive device 26 is constituted of a cam device 27 which is arranged above both open/close valves 23, 24 and a motor device 28 which operates the cam device 27. The cam device 27 includes a bracket 27*a* which has both ends thereof protruded in the frontward direction, a rotary shaft 27*b* which is rotatably held on the bracket 27*a* in the horizontal state and a first cam 27*c* and a second cam 27*e* which are fixedly secured to the rotary shaft 27*b*. The motor device 28 incorporates a motor and transmission gears which reduce the rotational speed of the motor therein. When the first cam 27*c* pushes the rod 231 of the first open/close valve 23 downwardly, the first open/close valve 23 is opened. When the second cam 27*e* pushes the rod 231 of the second open/close valve 24, the second open/close valve 24 is opened. When the pushing force is released, the first open/close valve 23 and the second open/close valve 24 are automatically closed due to return springs incorporated in these valves. A manually operating handle 29 is mounted on the drive device 26 so that the rotary shaft 27*b* of the cam device 27 is manually rotated at the time of power failure or when desired so that the first open/close valve 23 and the second open/close valve 24 can be manually opened or closed.

Between an outlet port of the first open/close valve 23 of the flushing mechanism 21 and the jet nozzle mounting hole 15, a jet conduit 50 is arranged such that the conduit passes through the inside of the western-style toilet body 1 and a jet nozzle 51 is mounted on a front end portion of the jet conduit 50. Due to such a constitution, water in the first open/close valve 23 is supplied to the jet nozzle 51 by way of the jet conduit 50.

A rim conduit 52 is arranged between an outlet port of the second open/close valve 24 of the flushing mechanism 21 and the rim channel 14. Due to such a constitution, the water in the second open/close valve 24 can be supplied to the rim channel 14 by way of the rim conduit 52.

Figure 19:
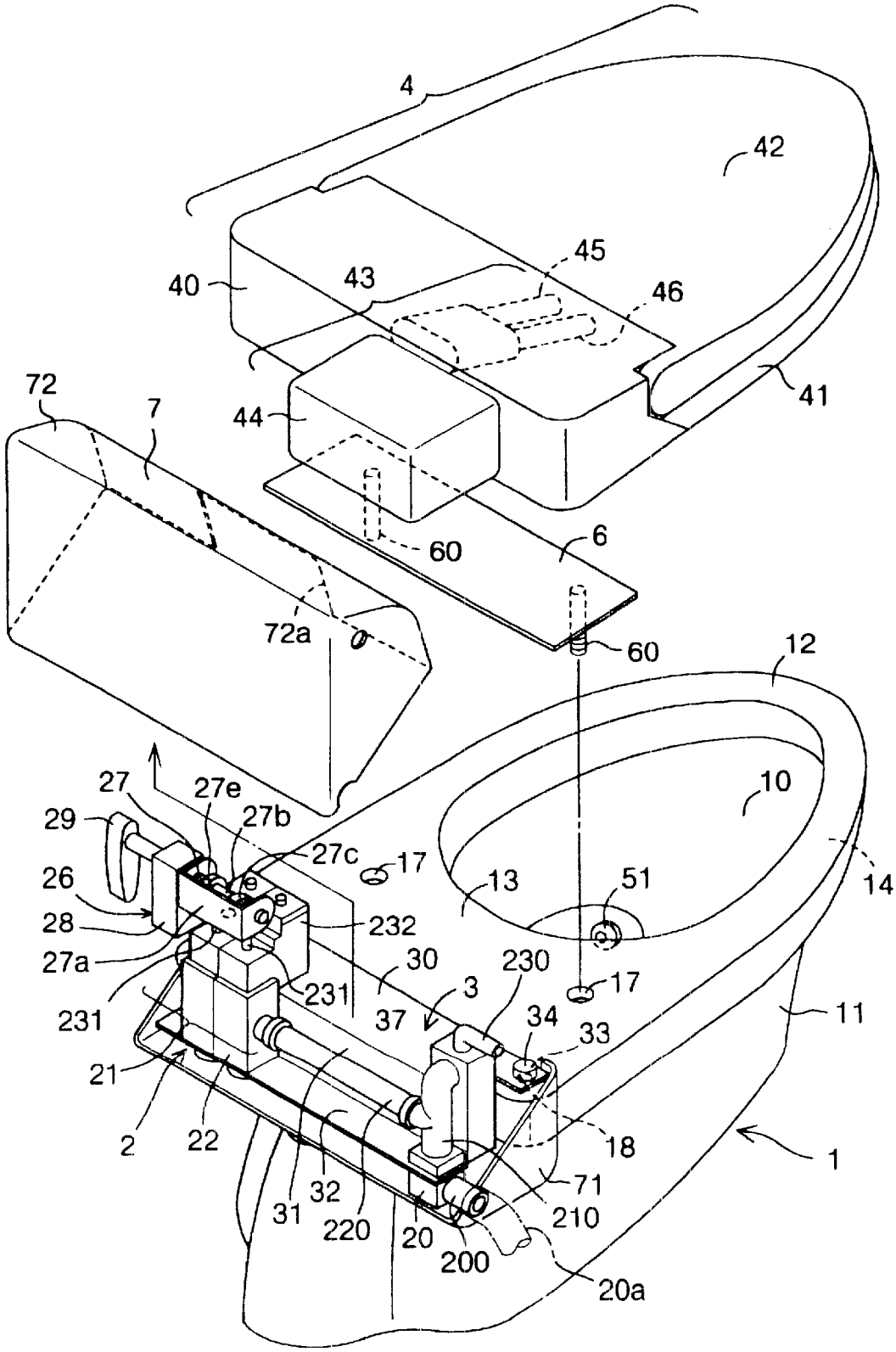
FIG. 19 is a perspective view showing a state in which a toilet seat/toilet lid device is mounted on a western-style toilet body on which a separate-type toilet flushing device is mounted according to an embodiment in the third invention.

In this manner, the separate-type toilet flushing device 2 mounted on the western-style toilet body 1 is concealed by an inner cover 7 as shown in FIG. 18 and FIG. 19. The inner cover 7 has a box shape and is made of resin. This inner cover 7 is constituted of a detachable under cover portion 71 which covers the separate-type toilet flushing device 2 from the lower side and a detachable upper cover portion 72 which is detachably engaged with the under cover portion 71 and covers the separate type toilet flushing device 2 from the above side. A notch 72*a* which obviates the interference with the hot water tank 44 is formed on a front portion of the upper cover portion 72. When the inner cover portion 7 is mounted on the separate-type toilet flushing device 2, the handle 29 is exposed from the side surface of the inner cover 7 to allow the manual manipulation thereof.

As shown in FIG. 19, the toilet seat/toilet lid device 4 is provided separately from the separate-type toilet flushing device 2. This toilet seat/toilet lid device 4 includes a box-like base portion 40, a toilet seat 41 which is tiltably held on the base portion 40 and on which a user sits and a toilet lid 42 which is positioned above the toilet seat 41 and is capable of opening or closing an upper surface opening of the bowl portion 10 while being tiltably held on the base portion 40. Further, this toilet seat/toilet lid device 4 is provided with a part washing device 43 which is integrally held at a rear portion of the base portion 40. The part washing device 43 is provided for washing a part of a human body and includes a hot water tank 44 which is mounted on the base portion 40 as other mechanism provided with a built-in heater for generating hot water and a plurality of blow-off nozzles 45, 46 which are telescopically formed and are capable of blowing off hot water in the hot water tank 44 to the parts of the human body along with the extension thereof.

A plurality of second mounting bolts 60 which are formed in an extended manner downwardly from a base plate 6 for mounting toilet seat and toilet lid are respectively made to pass through toilet seat mounting holes 17 formed in the western-style toilet body 1 and nuts not shown in the drawings are fastened to these second mounting bolts 60 whereby the toilet seat/toilet lid device 4 can be detachably mounted on the mounting surface 13 of the western-style toilet body 1.

Figure 20:
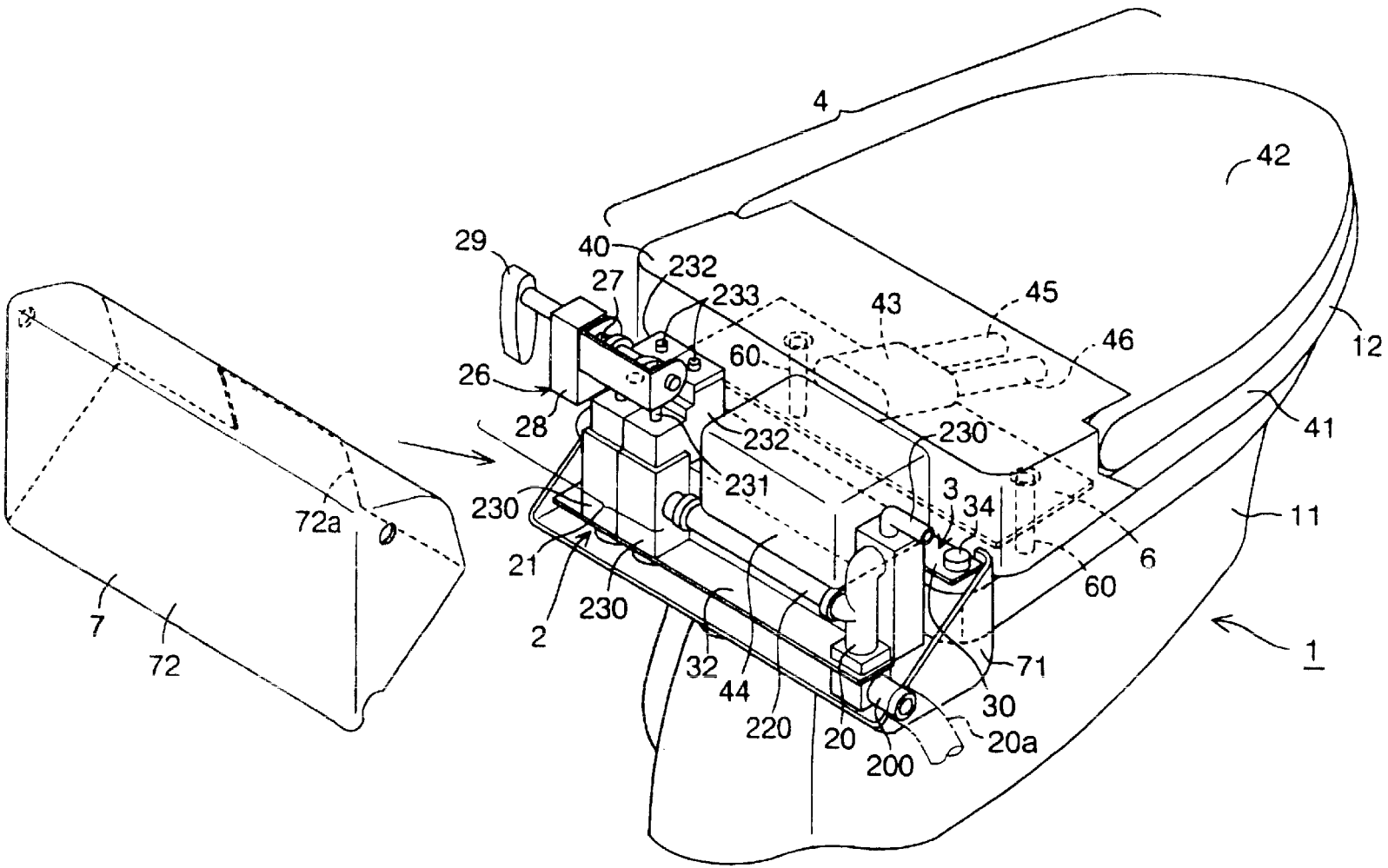
FIG. 20 is a perspective view showing a state in which a separate-type toilet flushing device and a toilet seat/toilet lid device are mounted on a western-style toilet body according to an embodiment in the third invention.

In this manner, as shown in FIG. 20, the separate-type toilet flushing device 2 is mounted by means of toilet seat mounting holes 17 of the western-style toilet body 1 and is positioned behind the toilet seat/toilet lid device 4. In this state, the hot water tank 44 which is held on the rear portion of the toilet seat/toilet lid device 4 is arranged in a tank housing space 37 on the common base plate 3. As a result, at the time of mounting the separate-type toilet flushing device 2, the hot water tank 44 of the toilet seat/toilet lid device 4 is arranged such that the hot water tank 44 does not interfere with the flushing mechanism 21 and the branch water supply device 20 which constitute main components of the separate-type toilet flushing device 2 on the common base plate 3. In this manner, the tankless toilet in which the toilet flushing device constitutes the separate-type toilet flushing device 2 can be manufactured.

Here, since the upper cover portion 72 and the under cover portion 71 of the inner cover 7 are detachably engaged with each other, when the engagement is released, it becomes possible to disengage the upper cover portion 72 from the under cover portion 71 and hence, the maintenance and inspection of the separate-type toilet flushing device 2 become possible. Further, at the time of mounting, the hot water tank 44 of the toilet seat/toilet lid device 4 and the branch pipe 230 of the branch water supply device 20 are connected by a pipe passage such as a hose not shown in the drawing so that water is supplied from the branch pipe 230 to the hot water tank 44.

Figure 21:
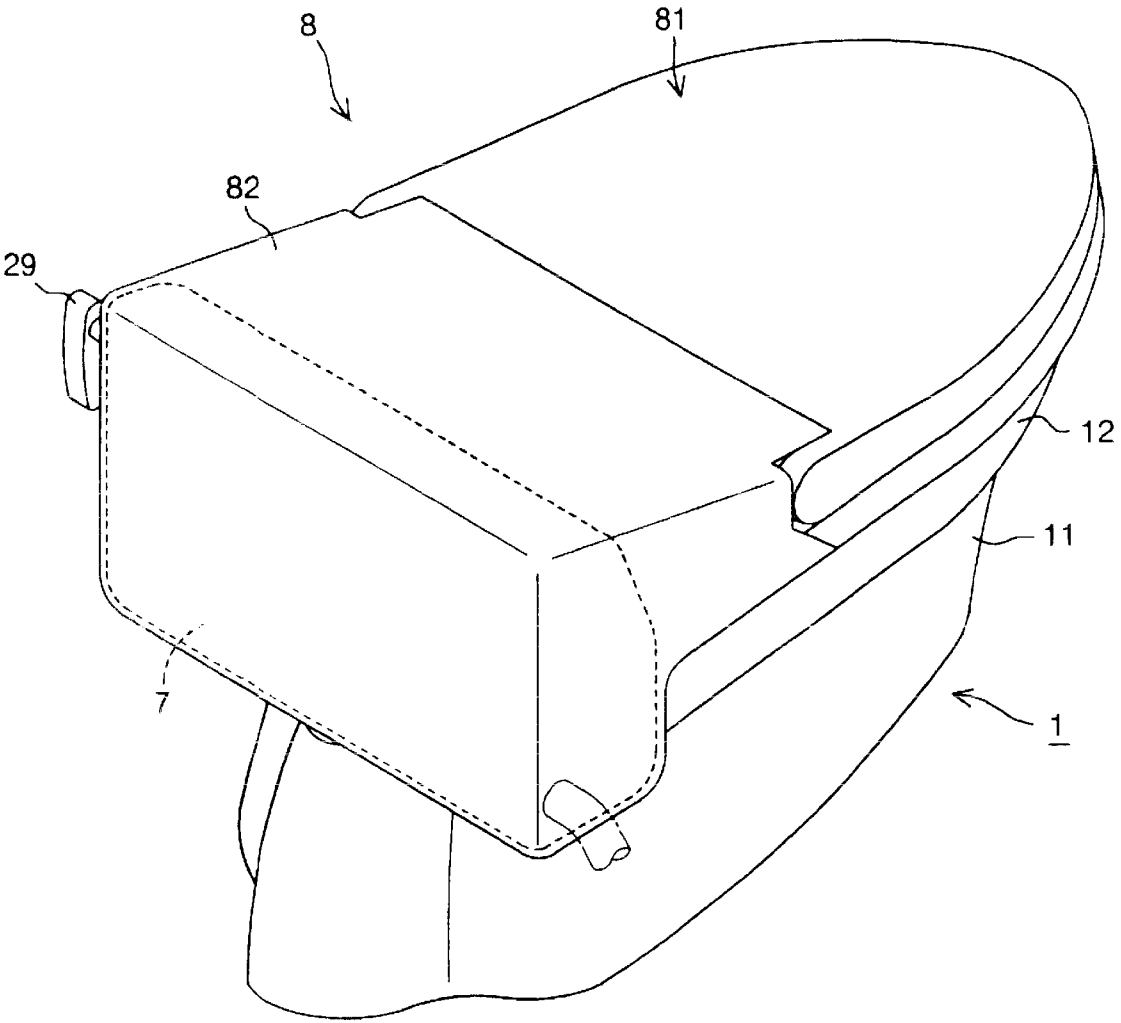
FIG. 21 is a perspective view showing a state in which a unitary-type toilet flushing device is mounted on a western-style toilet body of a tankless toilet according to an embodiment in the third invention.

As described above, in a line which manufactures the tankless toilet which adopts the separate-type toilet flushing device 2 as the toilet flushing device, after the assembling is advanced to the state shown in FIG. 18, as shown in FIG. 21, the tankless toilet which adopts the unitary-type toilet flushing device 8 as the toilet flushing device can be manufactured.

Here, the unitary-type toilet flushing device 8 is integrally provided with the toilet seat/toilet lid device 81 and an outer cover 82 which conceals the inner cover 7 together with the hot water tank 44 is provided behind the toilet seat/toilet lid device 81. When compared with the tankless toilet which adopts the separate-type toilet flushing device 2 as the toilet flushing device, the tankless toilet which adopts the unitary-type toilet flushing device 8 as the toilet flushing device is in common with respect to the western-style toilet body 1, the branch water supply device 20, the flushing mechanism 21, the common base plate 3 and the inner cover 7 of the unitary-type toilet flushing device 8. In this manner, the tankless toilet which adopts the unitary-type toilet flushing device 8 as the toilet flushing device is manufactured.

Since the tankless toilet which is manufactured in this manner adopts either the separate-type toilet flushing device 2 or the unitary-type toilet flushing device 8 as the toilet flushing device, a purchaser of a tankless toilet who is considering the installment of the tankless toilet in a toilet room can freely select the tankless toilet adopting the separate-type toilet flushing device 2 or the tankless toilet adopting the unitary-type toilet flushing device 8 depending on a budget or the like at the time of purchasing.

Further, with respect to the tankless toilet of this embodiment, since the western-style toilet body 1 is commonly used, it is sufficient to manufacture only one kind of western-style toilet body land hence, the highly-efficient mass production becomes possible whereby the reduction of the manufacturing cost of the western-style toilet body 1 and eventually the manufacturing cost of the tankless toilet can be realized.

Further, according to the tankless toilet of the embodiment, the separate-type toilet flushing device 2 and the unitary-type toilet flushing device 8 are in common with respect to the branch water supply device 20, the flushing mechanism 21, the common base plate 3 and the inner cover 7 and hence, parts at the time of manufacturing can be used in common whereby the reduction of the manufacturing cost of the tankless toilet can be further enhanced.

Further, according to the tankless toilet of the embodiment, since they are common in these components, the common manufacturing line can be used until the inner cover 7 is mounted on the western-style toilet body 1. That is, according to the tankless toilet of the embodiment, since the flushing mechanism 21 can be mounted on the western-style toilet body 1 without interfering with the hot water tank 44 in the unitary-type toilet flushing device 8, it is possible to mount only the flushing mechanism 21 on the western-style toilet body 1 by way of the common base plate 3 and thereafter the inner cover 7 is mounted whereby the tankless toilet provided with only the flushing mechanism 21 can be manufactured. Here, although not illustrated, it is also possible to mount the toilet seat/toilet lid device which is provided with only the toilet seat and the toilet lid. It is also possible to mount the toilet seat/toilet lid device 4 having a part washing device. Due to such constitutions, it becomes possible to manufacture the tankless toilet provided with the separate-type toilet flushing device 2. In the tankless toilet provided with the separate-type toilet flushing device 2, when the tankless toilet provided with only the flushing mechanism 21 is initially purchased because of a budget or the like and the toilet seat/toilet lid device having a heating function, for example, is mounted on the tankless toilet and thereafter a purchaser wants to mount the toilet seat/toilet lid device 4 which is provided with other mechanism such as a part washing mechanism, the replacement of toilet seat/toilet lid device 4 can be easily performed.

Further, by mounting the toilet seat/toilet lid device 81 and the outer cover 82 after mounting the flushing device 21, the tankless toilet having the unitary-type toilet flushing device 8 can be manufactured.

In this manner, the common manufacturing line can be used until the inner cover 7 is mounted so that the reduction of the manufacturing cost of the tankless toilet can be further enhanced.

In this manner, according to the tankless toilet of the embodiment, the free selection by the purchaser becomes possible and the reduction of the manufacturing cost can be realized.

Fourth and Fifth Inventions

Embodiments 1, 2 which embody the fourth and fifth inventions are explained hereinafter in conjunction with drawings.

Embodiment 1

Figure 22:
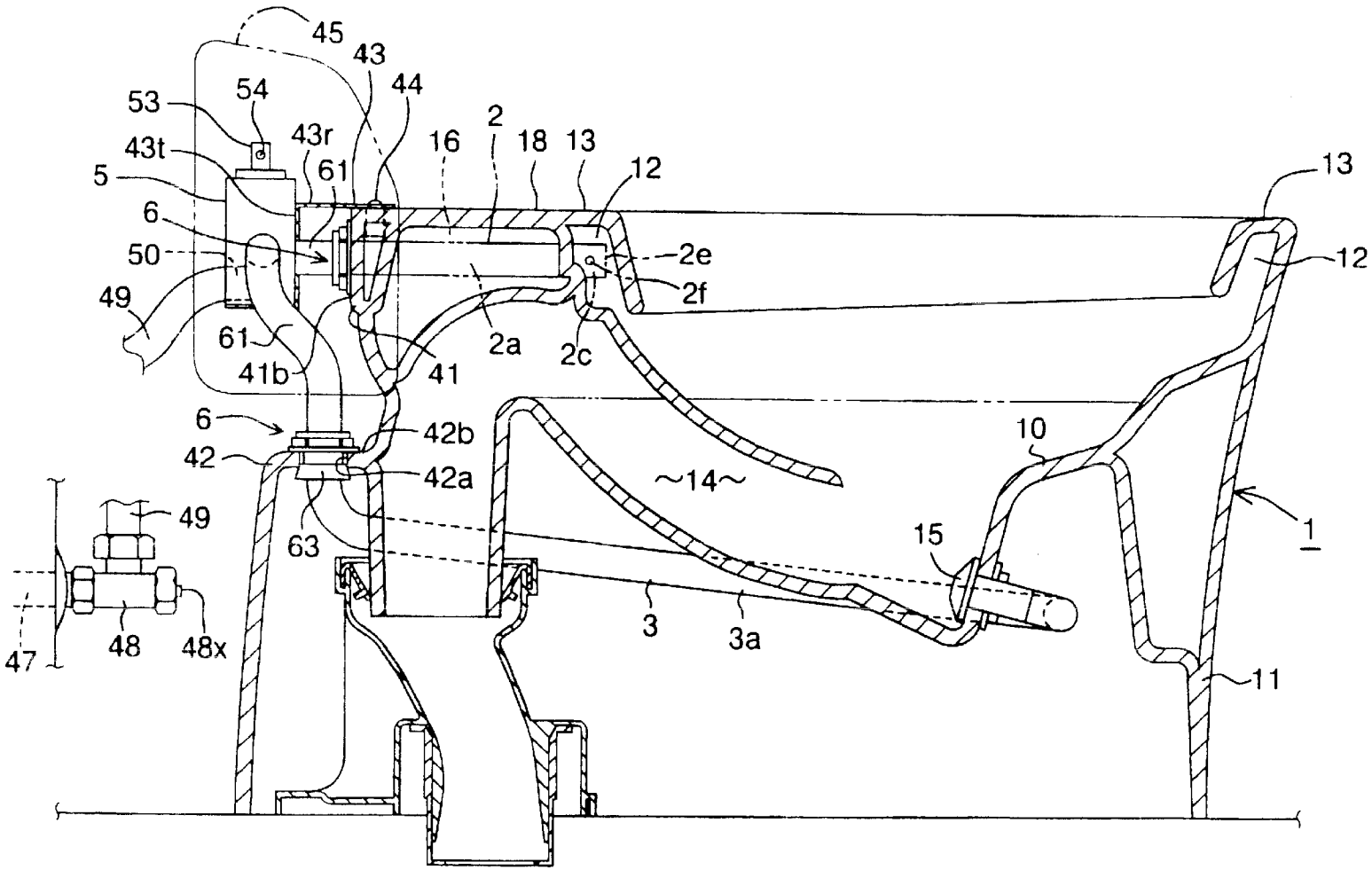
FIG. 22 is a cross-sectional view showing a western-style toilet body of a tankless toilet or the like according to an embodiment 1 in the fourth and fifth inventions.

The tankless toilet of the embodiment 1 is of a tankless type which is not provided with a water tank. As shown in FIG. 22, a western-style toilet body 1 of the tankless toilet is made of porcelain and includes a toilet bowl 11 having a bowl portion 10 which receives a waste, a rim 13 having a rim channel 12 which is formed on an upper periphery of the bowl portion 10, and a trap portion 14 which is communicated with a bottom of the bowl portion 10 and makes the waste pass therethrough. A jet nozzle 15 which generates a siphon action is provided to an inlet of the trap portion 14. A toilet lid and a toilet seat are omitted from the drawing.

The western-style toilet body 1 is provided with a rim conduit 2 which supplies water to the rim channel 12 and a jet conduit 3 which supplies water to the jet nozzle 15.

Figure 23:
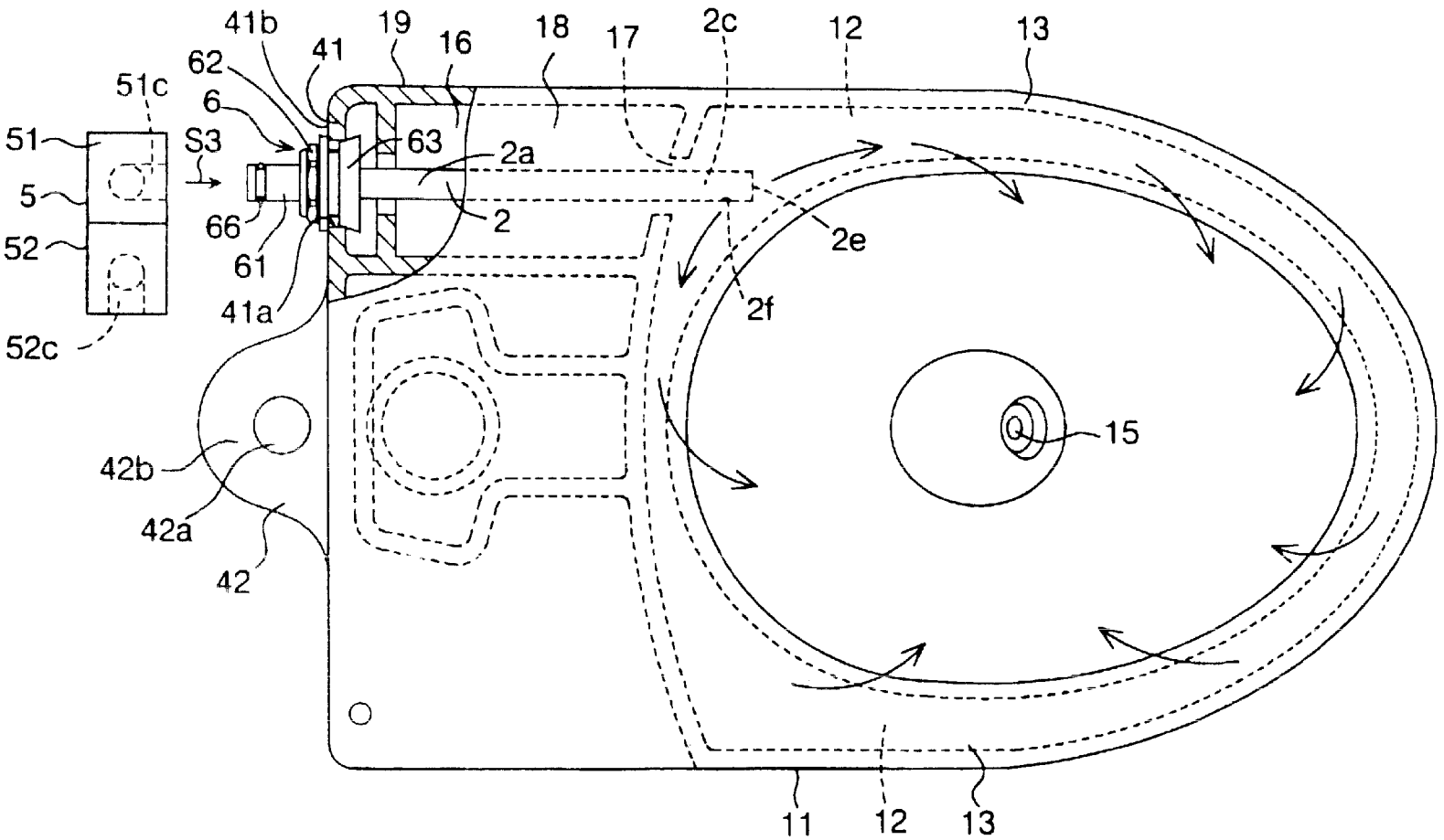
FIG. 23 is a plan view with a part in cross section showing a western-style toilet body of a tankless toilet or the like according to an embodiment 1 in the fourth and fifth inventions.

A rim water guide passage 16 is formed in an upper portion side of a rear portion of the western-style toilet body 1 as a cavity. The rim water guide passage 16 is, as shown in FIG. 23, communicated with the rim channel 12 by way of the thruogh hole 17. The rim water guide passage 16 is concealed by an upper wall face 18 and a side wall face 19 which constitute the wall face of the western-style toilet body 1 and cannot be visually recognized from outside in the usual use mode.

Figure 24:
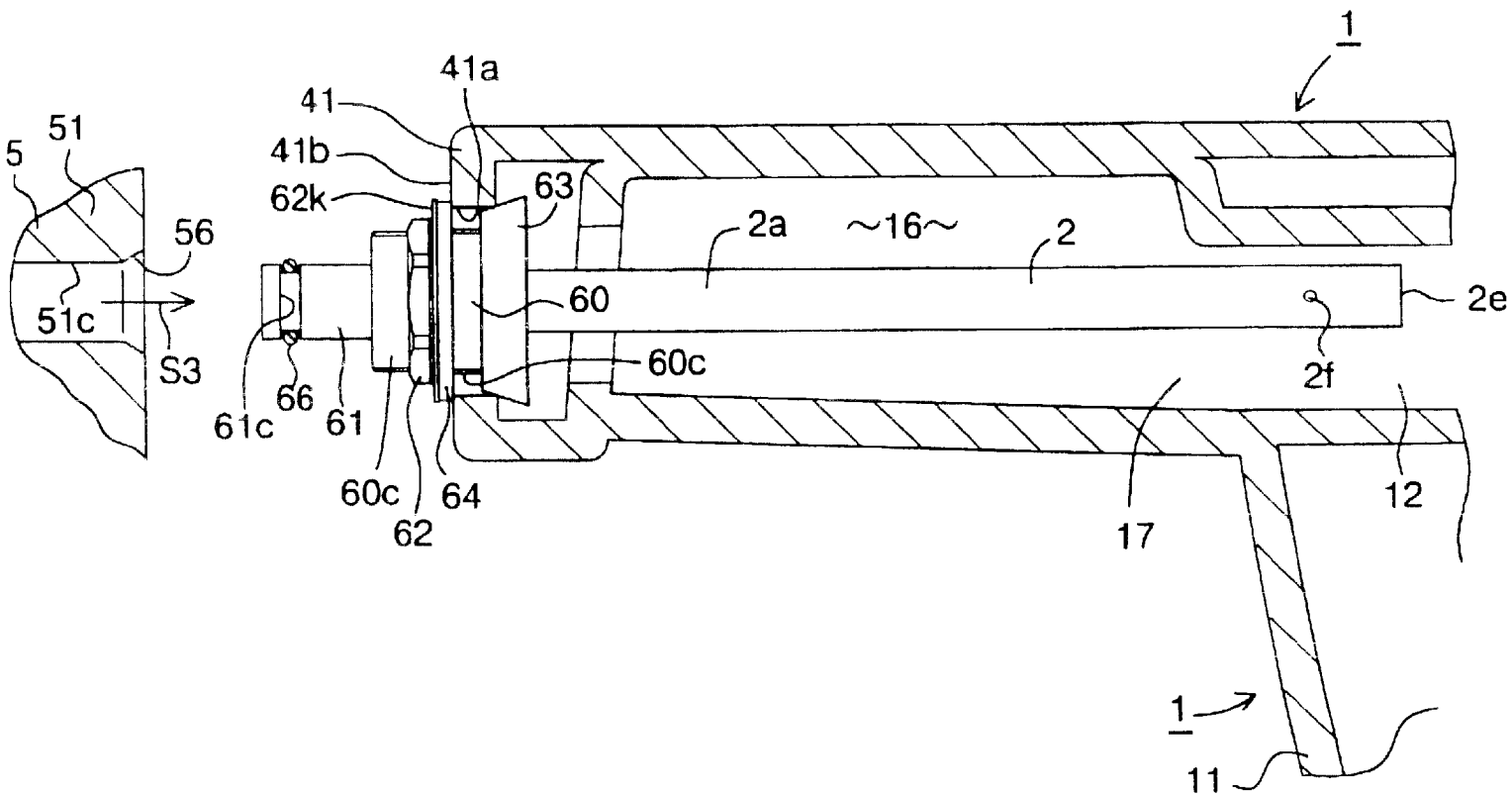
FIG. 24 is a cross-sectional view showing a western-style toilet body, a rim conduit and the like of a tankless toilet according to an embodiment 1 in the fourth and fifth inventions.
Figure 25:
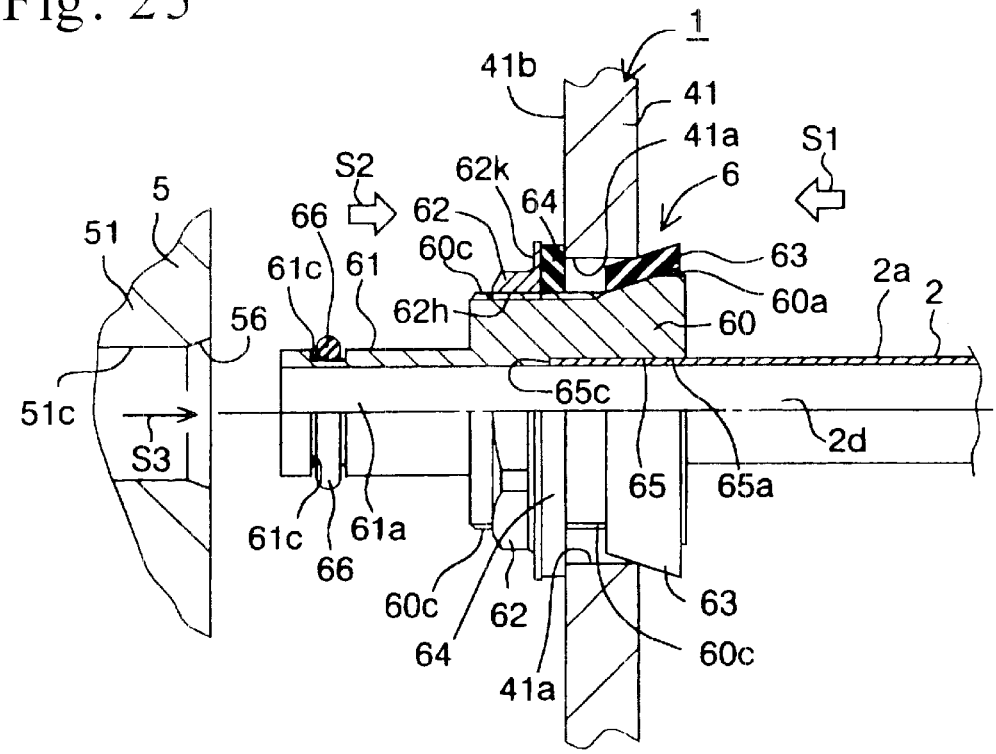
FIG. 25 is a side view showing an essential portion in cross section before a rim open/close valve and a rim conduit are inserted into each other according to an embodiment 1 in the fourth and fifth inventions.
Figure 26:
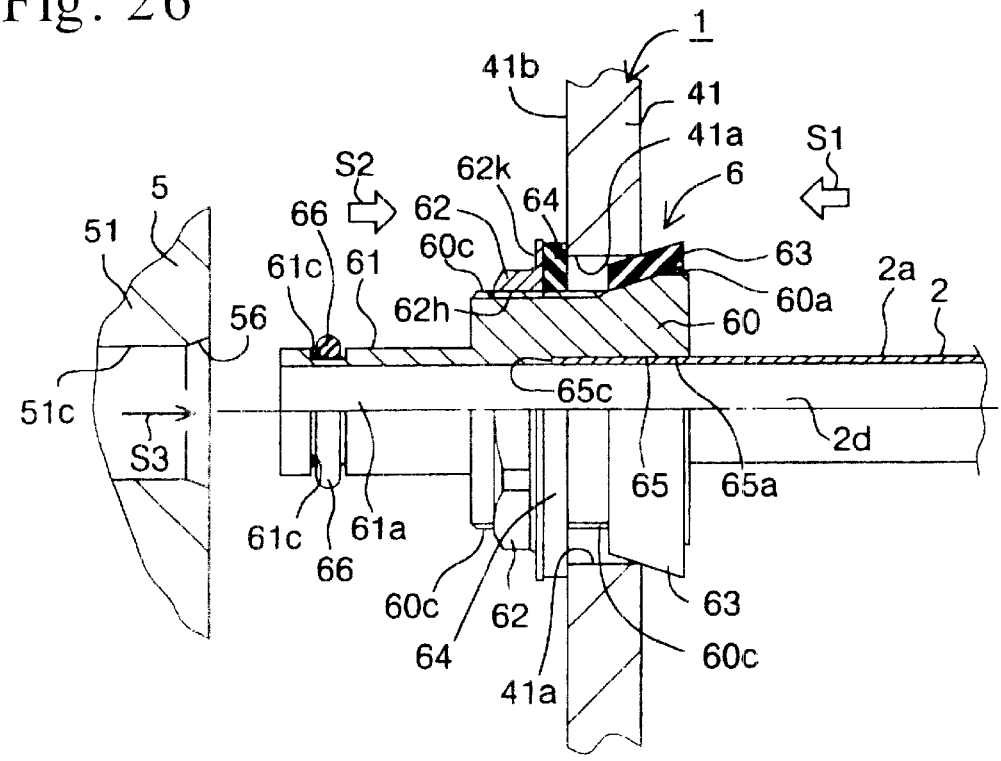
FIG. 26 is a side view showing an essential portion in cross section after a rim open/close valve and a rim conduit are inserted into each other according to an embodiment 1 in the fourth and fifth inventions.
Figure 27:
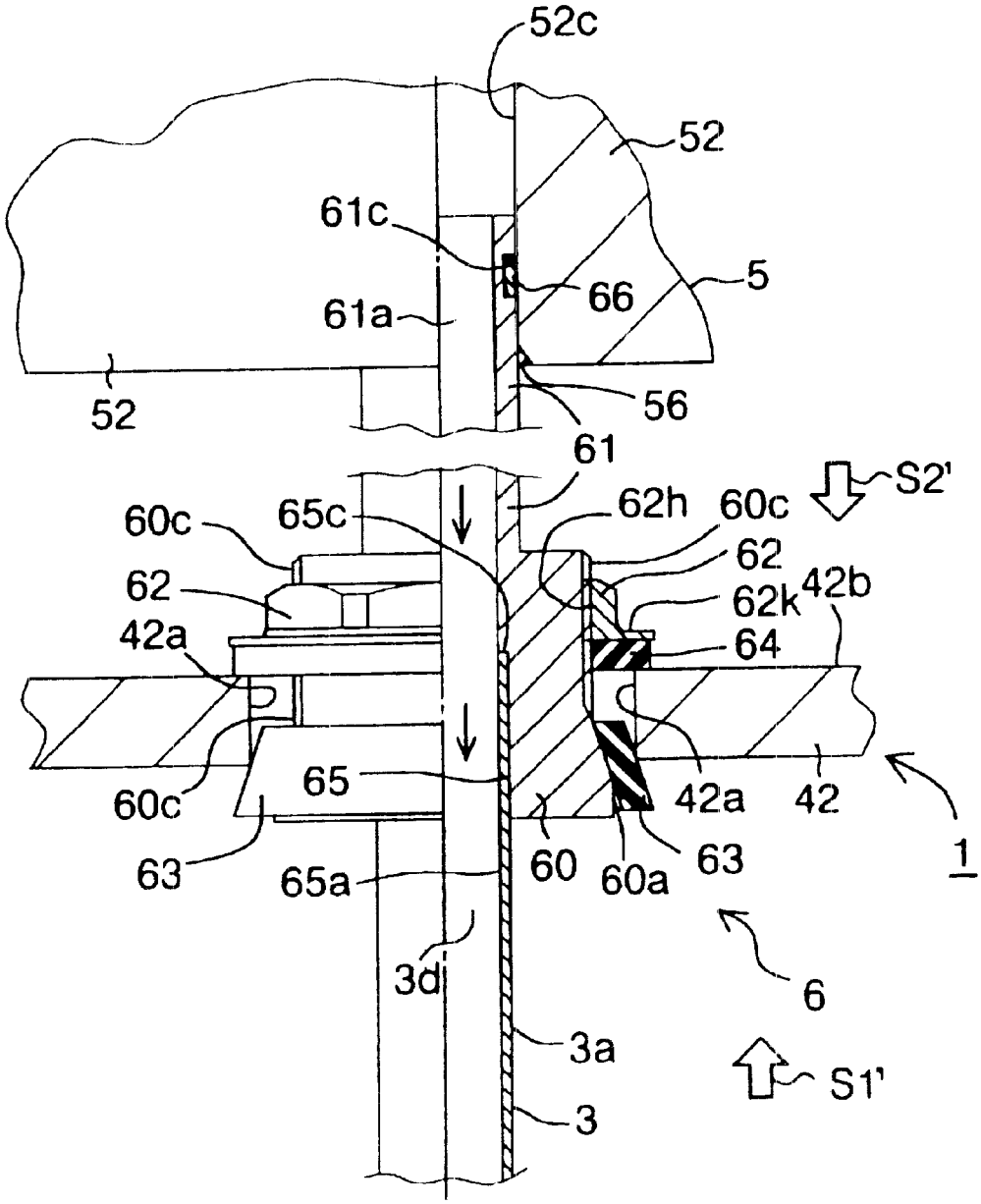
FIG. 27 is a side view showing an essential portion in cross section after a jet open/close valve and a jet conduit are inserted into each other according to an embodiment 1 in the fourth and fifth inventions.

On the rear portion of the western-style toilet body 1, a first mounting portion 41 for mounting the rim conduit 2 and a second mounting portion 42 for mounting the jet conduit 3 are formed. As shown in FIG. 24 to FIG. 26, a first mounting hole 41*a* is formed in the first mounting portion 41 such that the first mounting hole 41*a* penetrates the first mounting portion 41 in front and back directions and as shown in FIG. 27 and a second mounting hole 42*a* is formed in the second mounting portion 42 such that the second mounting hole 42*a* penetrates the second mounting portion 42 vertically.

As shown in FIG. 24 and FIG. 25, in the state that an open/close valve 5 is not yet mounted on the western-style toilet body 1, a first mounting wall face 41*b* which constitutes a wall face of the first mounting portion 41 of the western-style toilet body 1 is exposed rearwardly. Further, as shown in FIG. 27, a second mounting wall face 42*b* which constitutes a wall face of the second mounting portion 42 of the western-style toilet body 1 is exposed upwardly at a rear portion thereof.

At the rear portion of the western-style toilet body 1, as shown in FIG. 22, a base plate 43 having a lateral plate portion 43*r* and a vertical plate portion 43*t* is detachably fixedly secured to the western-style toilet body 1 by means of mounting bolts 44. The open/close valve 5 which functions as a water supply device is detachably fixedly secured to the vertical plate portion 43*t* of the base plate 43. Here, the open/close valve 5 and the like are concealed by a cover 45.

A water supply pipe 47 such as a city water service pipe or the like is mounted in a wall of a toilet room and a stop valve 48 having an open/close manipulation portion 48*x* is mounted on an end portion of the water supply pipe 47. The stop valve 48 and an inlet port 50 of the open/close valve 5 are connected with each other by means of a flexible hose 49 having flexibility which functions as a connecting pipe. Due to such a constitution, water in the water supply pipe 47 is supplied to the inlet port 50 of the open/close valve 5 by way of the stop valve 48.

The open/close valve 5 is, as shown in FIG. 23, constituted of a rim open/close valve 51 and a jet open/close valve 52 which is arranged close to the rim open/close valve 51. Although not shown in the drawings, the rim open/close valve 51 and the jet open/close valve 52 respectively have valve chambers which are connected to each other, valve mechanisms which are disposed in the valve chambers in an open/close operable manner, and drive mechanisms which open/close the valve mechanisms. Accordingly, the water supplied to the inlet port 50 of the open/close valve 5 is supplied to both of the rim open/close valve 51 and the jet open/close valve 52. On the upper portion of the open/close valve 5, as shown in FIG. 22, a vacuum breaker 53 for preventing the backflow of water is mounted. An atmosphere communication hole 54 which is communicated with the atmosphere is formed in the vacuum breaker 53 above an uppermost surface of the rim channel 12. Due to such a constitution, it becomes possible to suppress the backflow of the water due to the generation of negative pressure in the flow passage at the upstream of the vacuum breaker 53.

As shown in FIG. 25 and FIG. 26, the rim conduit 2 is constituted of a conduit body 2*a* which forms a main body and defines a passage 2*d* in the inside thereof and a spud 6 which is coaxially and integrally connected to an axial end of the conduit body 2*a*.

The spud 6 is constituted of a large-diameter portion 60 having an approximately columnar shape having a short axial length and a relatively thick wall thickness and an inserting end portion 61 having a cylindrical pipe shape which is coaxially extended with the conduit body 2*a* at one end side of the large-diameter portion 60.

On an outer peripheral portion of the large-diameter portion 60, the inclined surface 60*a* having a conical surface shape which has an outer diameter thereof gradually enlarged as the distance from the inserting end portion 61 is increased and a male thread 60*c* which is formed between the inserting end portion 61 and the inclined surface 60*a* are formed. A fitting hole 65 having a circular cross section is coaxially formed in a central region of the large-diameter portion 60. The fitting hole 65 includes a flattened inner peripheral surface 65*a* and a stepped positioning portion 65*c*. An axial end of the conduit body 2*a* is inserted into the fitting hole 65 of the large-diameter portion 60 under pressure and is integrally fixedly secured. Here, the axial end of the conduit body 2*a* is brought into contact with the positioning portion 65*c* and is positioned.

The inserting end portion 61 is communicated with the passage 2*d* of the conduit body 2*a* and is formed in a cylindrical shape having a central hole 61*a* of an inner diameter equal to the inner diameter of the passage 2*d*. The inserting end portion 61 has an outer diameter thereof made smaller than that of the large-diameter portion 60. Further, a ring groove 61*c* is formed on a front end side of an outer periphery of the inserting end portion 61 and an O ring 66 having a ring shape which works as a seal member made of resilient material is mounted in the ring groove 61*c*. The outer diameter of the inserting end portion 61 is set such that the diameter corresponds to the inner diameter of a first outlet port 51*c* of the rim open/close valve 51.

Further, a washer faced nut 62 which functions as a fastening member, a skirt-shaped first packing 63 which functions as a seal member made of resilient material and a second packing 64 having a flat-plate ring-like shape which functions as a seal member made of resilient material are provided. The washer faced nut 62 includes a seat portion 62*k* which is extended radially and outwardly in a ring shape and a female thread 62*h* which is formed in an inner periphery of the nut 62 and is engaged with a male thread 60*c* of the large-diameter portion 60.

The rim conduit 2 is detachably fixedly secured to the first mounting wall face 41*b* of the first mounting portion 41 at the rear portion of the western-style toilet body 1. The manner of fixing the rim conduit 2 to the first mounting wall face 41*b* is explained. First of all, the first packing 63 is applied to the inclined surface 60*a* of the large-diameter portion 60 of the spud 6 and while holding this state, the large-diameter portion 60 is fitted into the first mounting hole 41*a* from the direction of an arrow S1. In this state, the second packing 64 is fitted on the outer periphery of the large-diameter portion 60 from the direction of an arrow S2, and the female thread 62*h* of the washer faced nut 62 is engaged with the male thread 60*c* of the large-diameter portion 60 thus fastening the washer faced nut 62. In this manner, the rim conduit 2 can be detachably fixedly secured to the western-style toilet body 1.

In this manner, in the state that the rim conduit 2 is fixedly secured to the western-style toilet body 1, due to the compression deformation of the first and the second packing 63, 64, the sealing performance between the large-diameter portion 60 of the spud 6 and the first mounting hole 41*a* and eventually the sealing performance of the rim conduit 2 is ensured.

Further, as shown in FIG. 27, the jet conduit 3 which forms other conduit is constituted of a conduit body 3*a* which occupies a main body and forms a passage 3*d* in the inside thereof and a spud 6 which is coaxially and integrally connected to an axial end of the conduit body 3*a*. The spud 6 is of a kind equal to that of the spud 6 shown in FIG. 25 and hence, same symbols are given to identical portions.

The axial end of the conduit body 3*a* is inserted under pressure and is fixedly secured to a fitting hole 65 formed in a large-diameter portion 60 of the spud 6. The jet conduit 3 is detachably fixedly secured to the second mounting wall face 42*b* of the second mounting portion 42 at the rear portion of the western-style toilet body 1.

The manner of fixedly securing the jet conduit 3 to the second mounting wall face 42*b* is similar to the fixing of the rim conduit 2 to the first mounting portion 41*b*. In this manner, in the state that the jet conduit 3 is fixedly secured to the western-style toilet body 1, due to the compression deformation of the first and the second packings 63, 64, the sealing performance between the large-diameter portion 60 of the spud 6 and the second mounting hole 42*a* and eventually the sealing performance of the jet conduit 3 is ensured.

Then, in this state, as shown in FIG. 25, the inserting end portion 61 of the spud 6 is protruded outwardly from the first mounting wall face 41*b*, that is, in the rearward direction from the western-style toilet body 1. Further, as shown in FIG. 27, the inserting end portion 61 of the spud 6 is protruded upwardly from the second mounting wall face 42*b* of the second mounting portion 42 of the western-style toilet body 1. On the other hand, the rim open/close valve 51 is fixedly secured to the vertical plate portion 43*t* of the base plate 43.

Accordingly, the rim open/close valve 51 and the jet open/close valve 52 are moved from the rear side of the western-style toilet body 1 toward the inserting end portion 61 of the spud 6 together with the base plate 43. That is, as shown in FIG. 25, the rim open/close valve 51 is inserted from the direction of an arrow S3 along the axial length direction of the inserting end portion 61, while as shown in FIG. 27, in the same manner, the jet open/close valve 52 is inserted along the axial length direction of the inserting end portion 61. Due to such a constitution, as shown in FIG. 26, the inserting end portion 61 is fitted and inserted into the first outlet port 51*c* of the rim open/close valve 51. Further, as shown in FIG. 27, the inserting end portion 61 is fitted and inserted into the first outlet port 52*c* of the jet open/close valve 52.

As shown in FIG. 26 and FIG. 27, conical-faced guide surfaces 56 which have inner diameters thereof gradually enlarged toward the outside are formed at the inlets of the first outlet ports 51*c*, 52*c*. Due to such a constitution, at the time of inserting the inserting end portions 61, the O rings 66 are favorably subjected to the resilient deformation by the guide surfaces 56 so that the damages on the O rings 66 can be suppressed.

In this state, the inner wall surfaces of the first outlet ports 51*c*, 52*c* are fitted on the outer peripheral surfaces of the inserting end portions 61 such that the inner wall surfaces face the outer peripheral surfaces in an opposed manner, while the O ring 66 is subjected to the resilient deformation by the inner wall surfaces of the first outlet ports 51*c*, 52*c* of the rim open/close valve 61 or the jet open/close valve 52, whereby the sealing performance between the inserting end portion 61 of the spud 6 and the first outlet ports 51*c*, 52*c* of the rim open/close valve 51 or the jet open/close valve 52 is ensured.

Thereafter, as shown in FIG. 22, the base plate 43 is detachably fixedly secured to the western-style toilet body 1 by means of the mounting bolts 44. Accordingly, the connection between the rim conduit 2 and the rim open/close valve 51 is completed and the connection between the jet conduit 3 and the jet open/close valve 52 is completed.

In this manner, in this tankless toilet, the rim conduit 2 is fixedly secured to the first mounting wall face 41*b* of the western-style toilet body 1 and this rim conduit 2 can be inserted into the rim open/close valve 51 of the open/close valve 5 which is fixedly secured to the base plate 43. Further, the jet conduit 3 is fixedly secured to the second mounting wall face 42*b* of the western-style toilet body 1 and this jet conduit 3 can be inserted into the jet open/close valve 52 of the open/close valve 5 which is fixedly secured to the base plate 43. Accordingly, at the time of assembling, even before the base plate 43 is fixedly secured to the western-style toilet body 1, the rim conduit 2 and the jet conduit 3 can be mounted on the western-style toilet body 1 in a stable manner and hence, the tankless toilet can sufficiently exhibit the easiness of assembling.

In the tankless toilet obtained in this manner, the water from the water supply pipe 47 is supplied to the inlet port 50 of the open/close valve 5 by way of the stop valve 48, and the flexible hose 49. Unless a user who wants to wash the toilet bowl 11 performs the switch manipulation, the rim open/close valve 51 and the jet open/close valve 52 of the open/close valve 5 are both closed so that the water is not supplied from the water supply pipe 47 to the tankless toilet.

When the washing of the western-style toilet body 1 is to be performed, based on the switch manipulation by the user, the rim open/close valve 51 is opened. Accordingly, the inlet port 50 and the first outlet port 51*c* of the rim open/close valve 51 are communicated with each other and hence, the water supplied from the water supply pipe 47 is discharged from the first outlet port 51*c* and is supplied to the rim channel 12 of the western-style toilet body 1 by way of the rim conduit 2. Here, as shown in FIG. 23, the rim conduit 2 is housed in the inside of the rim water guide passage 16 having a wide width and the other end portion 2*c* of the rim conduit 2 which constitutes a portion opposite to the spud 6 penetrates the through hole 17 and is opened in the rim channel 12. Further, in the other end portion 2*c* of the rim conduit 2, a first opening 2*e* which is opened at the front end side and is capable of discharging the water in the clockwise direction and a second opening 2*f* which is opened at the side face and is capable of discharging the water in the counter-clockwise direction are formed. Accordingly, when the water is supplied from the first outlet port 51*c* of the rim open/close valve 51 to the rim conduit 2, the water is discharged from the first opening 2*e* in the clockwise direction in FIG. 23 and is discharged from the second opening 2*f* in the counter-clockwise direction in FIG. 23. In this manner, the inner wall surface of the bowl portion 10 is washed. That is, since this tankless toilet adopts the rim conduit 2 which is connected to the rim open/close valve 51, the water flows in the inside of the rim channel 12 at a high speed whereby the ability to wash the toilet bowl 11 can be ensured.

Further, when the jet open/close valve 52 is opened, the inlet port 50 and the second outlet port 52*c* of the jet open/close valve 52 is communicated with each other and hence, the water discharged from the second outlet port 52*c* of the jet open/close valve 52 is supplied to the jet nozzle 15 by way of the jet conduit 3. Accordingly, in this tankless toilet, the water is blown off from the jet nozzle 15 at a high speed thus ensuring the generation of an effective siphon effect. Accordingly, the waste can be discharged from the western-style toilet body 1.

Further, in this tankless toilet, since the rim conduit 2 is concealed by the first mounting wall face 41*b* and the jet conduit 3 is concealed by the second mounting wall face 42*b*, the appearance can be enhanced.

Further, in this tankless toilet, since the base plate 43 is interposed between the western-style toilet body 1 and the open/close valve 5, the highly accurate contour dimensions can be ensured.

Accordingly, in this tankless toilet, the large washing ability, the favorable appearance including the contour and the assurance of reliable easiness of assembling can be realized.

Embodiment 2

A tankless toilet of the embodiment 2 has substantially the same constitution as that of the tankless toilet of the embodiment 1 and can obtain the same operation and effect. The tankless toilet of this embodiment is explained focusing on parts different from those of the embodiment 1.

Figure 28:
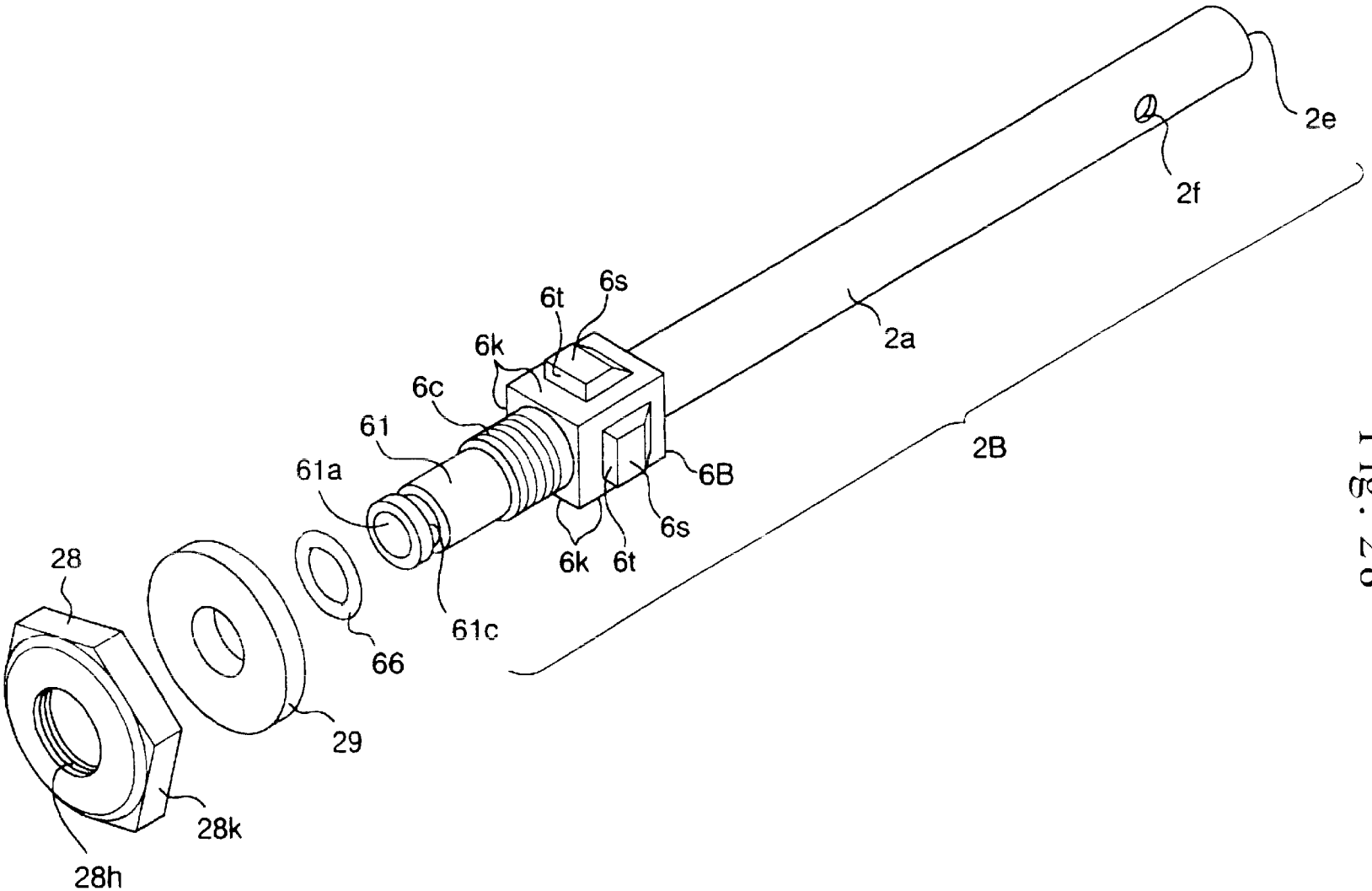
FIG. 28 is an exploded perspective view showing a rim conduit and the like according to an embodiment 2 in the fourth and fifth inventions.
Figure 29:
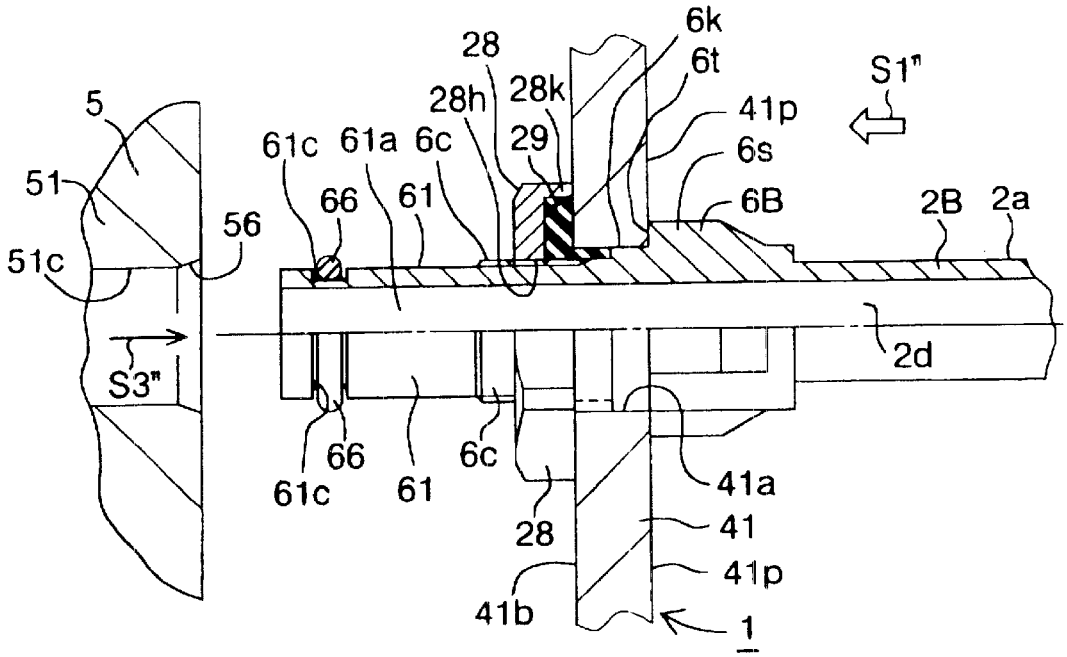
FIG. 29 is a side view showing an essential portion in cross section before a rim open/close valve and a rim conduit are inserted into each other according to an embodiment 2 in the fourth and fifth inventions.

As shown in FIG. 28 and FIG. 29, a rim conduit 2B is constituted of a conduit body 2*a* which forms a main body and is formed of a cylindrical pipe and a spud 6B having a quadrangular columnar shape having a relatively large thickness which is integrally formed with the conduit body 2*a*.

The spud 6B has four flat fitting surfaces 6*k* and four engaging protrusions 6*s* protruded outwardly from these fitting surfaces 6*k*. Each engaging protrusion 6*s* has a contact surface 6*t* for positioning which is erected in the direction approximately perpendicular to the axis of an inserting end portion 61. At the front end side of the spud 6B, the inserting end portion 61 is coaxially and integrally formed on one end side of the spud 6B in an extended manner. A male thread 6*c* is formed on the inserting end portion 61.

Further, a ring groove 61*c* is formed in the front end side of an outer periphery of the inserting end portion 61 and an O ring 66 having a ring shape which functions as a seal member made of resilient material is mounted in the ring groove 61*c*. A cap nut 28 which functions as a fastening member includes a cap portion 28*k* which is extended in a ring shape and a female thread 28*h* which is formed on an inner peripheral portion and is engaged with a male thread 6*c* of the inserting end portion 61.

The manner of fixedly securing the rim conduit 2B to the first mounting wall face 41*b* of the first mounting portion 41 at the rear portion of the western-style toilet body 1 is explained. In the embodiment 2, the first mounting hole 41*a* is formed in a quadrangular hole shape such that the first mounting hole 41*a* is aligned or registered with the spud 6B. Due to such a constitution, the rotation of the rim conduit 2B can be prevented. First of all, as shown in FIG. 29, the spud 6B which constitutes the rim conduit 2B is fitted into the first mounting hole 41*a* of the western-style toilet body 1 from the direction of an arrow S1". In this state, the innerwall surface of the first mounting hole 41*a* and the fitting surface 6*k* of the spud 6B directly face each other in an opposed manner and the contact surfaces 6*t* of the spud 6B are brought into contact with wall surfaces 41*p* of the first mounting portion 41. Accordingly, the conduit body 2*a* of the rim conduit 2B is positioned in the axial length direction of the rim conduit 2B. Subsequently, the nut 28 into which a third packing 29 which functions as a seal member made of resilient material is fitted is used to perform the fastening by engaging the female thread 28*h* of the nut 28 with the male thread 6*c* of the spud 6. Accordingly, the conduit body 2*a* of the rim conduit 2B can be detachably fixedly secured to the first mounting hole 41*a* of the western-style toilet body 1.

In this state, due to the third packing 29 which is subjected to the compression deformation, the sealing performance of the first mounting hole 41*a* is ensured. Further, the inserting end portion 61 of the rimconduit 2B is, in the same manner as mentioned above, protruded outwardly from the first mounting wall surface 41*b* of the western-style toilet body 1, that is, in the rearward direction. Accordingly, the rim open/close valve 51 can be moved from the rear side, that is, from the direction of an arrow S3" toward the inserting end portion 61 together with the base plate 43. In this manner, the inserting end portion 61 of the rim conduit 2B is inserted into the first outlet port 51*c* of the rim open/close valve 51. The jet conduit can be inserted into the jet open/close valve in the same manner. Thereafter, the base plate 43 is fixedly secured to the western-style toilet body 1 by means of the mounting bolts 44.

Accordingly, the embodiment 2 can also obtain the same operation and advantageous effects as those of the embodiment 1.

Sixth Invention

An embodiment which embodies the sixth invention is explained hereinafter in conjunction with drawings.

Figure 30:
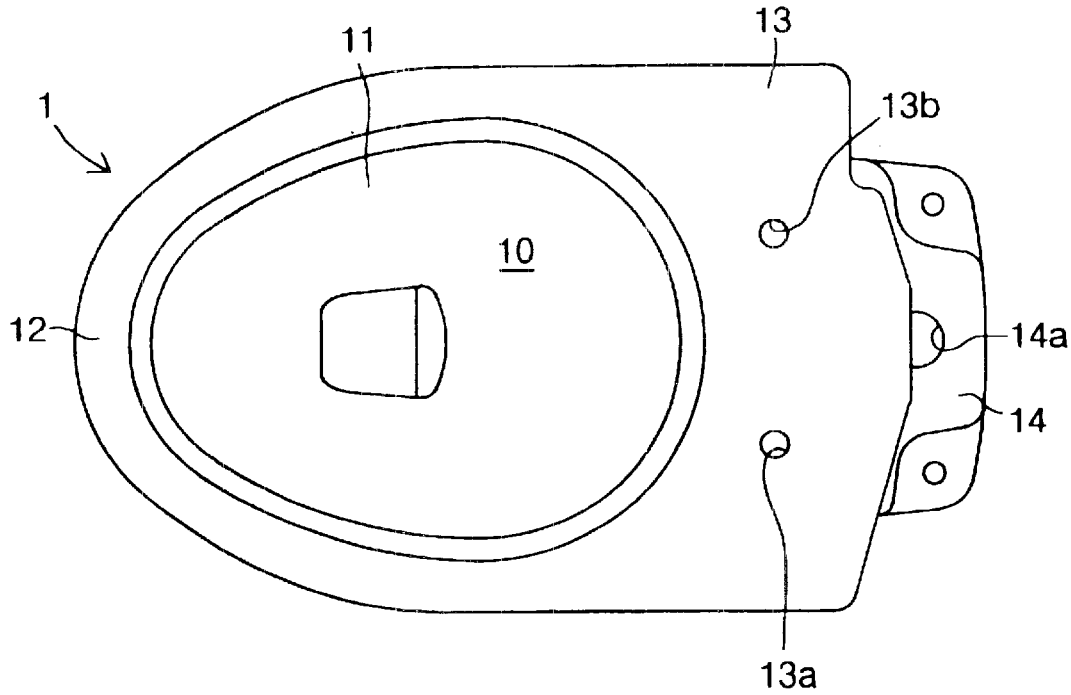
FIG. 30 is a plan view of a western-style toilet body of a tankless toilet according to an embodiment in the sixth invention.
Figure 31:
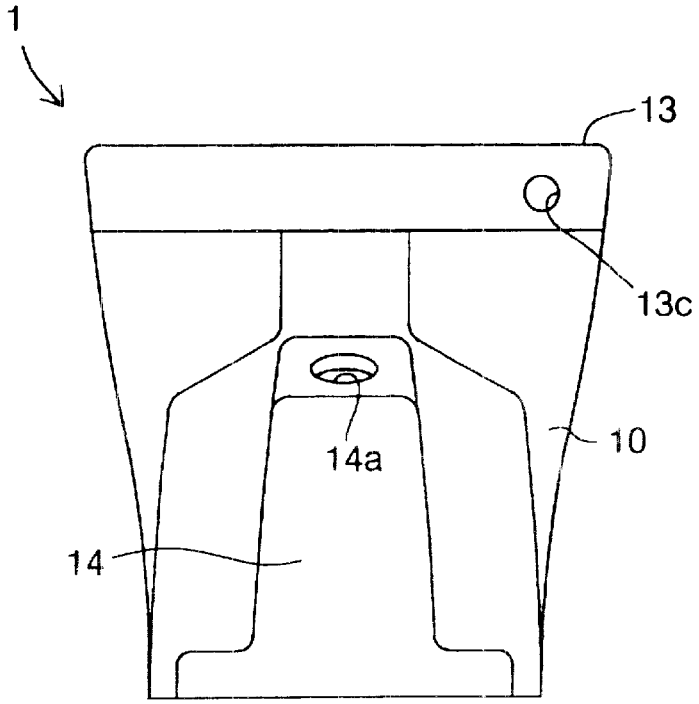
FIG. 31 is a back view of a western-style toilet body of a tankless toilet according to an embodiment in the sixth invention.

A tankless toilet according to this embodiment relates to a western-style flush toilet which is not provided with a water tank. This tankless toilet is provided with a western-style toilet body 1 made of porcelain which is shown in FIG. 30 and FIG. 31. The western-style toilet body 1 includes a toilet bowl portion 11 having a bowl portion 10 which receives a waste, a rim 12 which is formed around an upper periphery of a front portion side of the toilet bowl 11 and forms a rim channel not shown in the drawing in the inside thereof and a mounting surface 13 which is formed at the rear portion of the toilet bowl 11 with a flat horizontal surface having a wide area. A jet nozzle mounting hole not shown in the drawing is formed on a bottom of the bowl portion 10. As shown in FIG. 30, a pair of toilet seat mounting holes 13*a*, 13*b* are formed in the mounting surface 13 in the vertical direction as through holes. The distance between these toilet seat mounting holes 13*a*, 13*b* is set to 140 mm. Further, as shown in FIG. 31, a rim opening 13*c* which is communicated with the rim channel is formed in a rear wall of the mounting surface 13. A jet nozzle not shown in the drawing is mounted in the jet nozzle mounting hole. Further, a rear pedestal 14 having a jet opening 14*a* at an upper end thereof is integrally formed on a rear portion of the toilet bowl 11.

Figure 32:
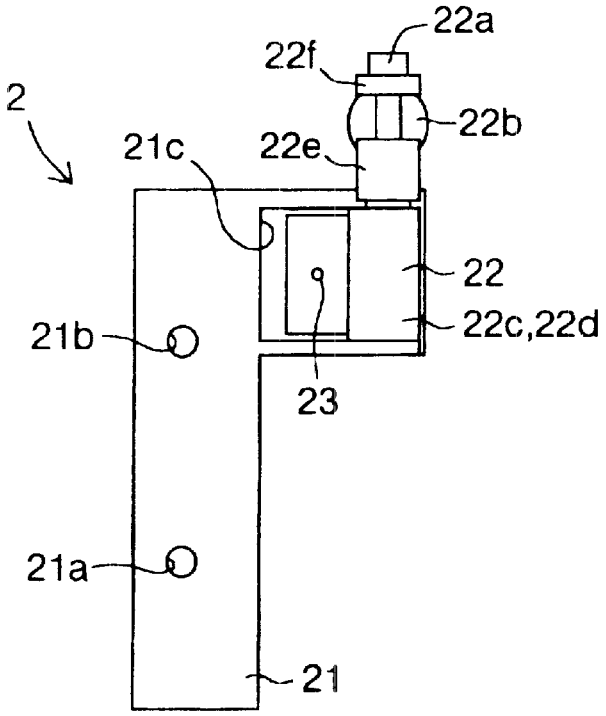
FIG. 32 is a plan view of a toilet flushing device of a tankless toilet according to an embodiment in the sixth invention.
Figure 33:
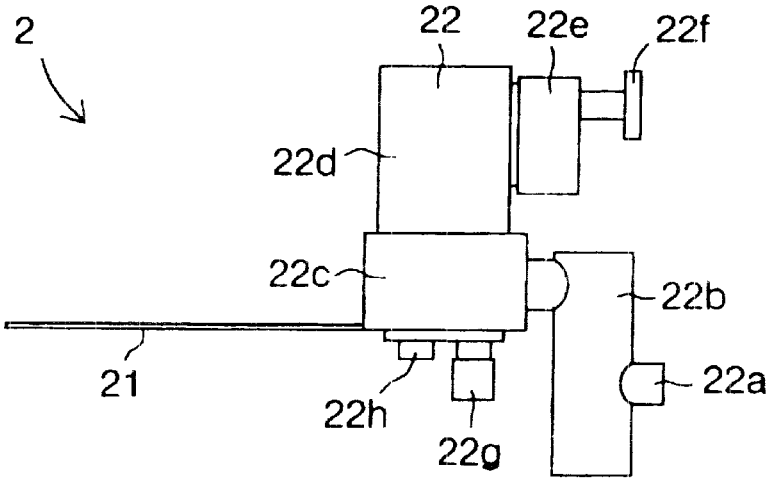
FIG. 33 is a back view of a toilet flushing device of a tankless toilet according to an embodiment in the sixth invention.

Further, as shown in FIG. 32 and FIG. 33, in a toilet flushing device 2, a toilet flushing mechanism 22 is fixedly secured to a toilet flushing base plate 21. Mounting holes 21*a*, 21*b* which are aligned with the toilet seat mounting holes 13*a*, 13*b* are formed in the toilet flushing base plate 21 in the vertical direction as through holes. Further, the toilet flushing mechanism 22 includes a check valve 22*b* which has a water supply opening 22*a* and incorporates a strainer therein, a rim and jet open/close valve 22*c* which is communicated with the check valve 22*b*, a cam device 22*d* which is disposed above the open/close valve 22*c* and opens or closes the open/close valve 22*c*, a motor device 22*e* which is disposed at the side of the cam device 22*d* and drives the cam device 22*d* and a manual handle 22*f* which is further protruded in the sideward direction from the motor device 22*e* and is capable of manually driving the cam device 22*d*. The toilet flushing base plate 21 is provided with a notch 21*c* which exposes a lower end of the open/close valve 22*c*. At the rear lower end of the open/close valve 22*c*, a rim water supply opening 22*g* which is connected to the rim opening 13*c* of the western-style toilet body 1 is largely extended downwardly from the notch 21*c* and a jet water supply opening 22*h* which is connected to the jet nozzle is slightly extended downwardly from the notch 21*c*. On the other hand, a vacuumn breaker 23 which is communicated with the rim water supply port 22*g* and the jet water supply port 22*h* is fixedly secured to the front upper end of the open/close valve 22*c*.

Figure 34:
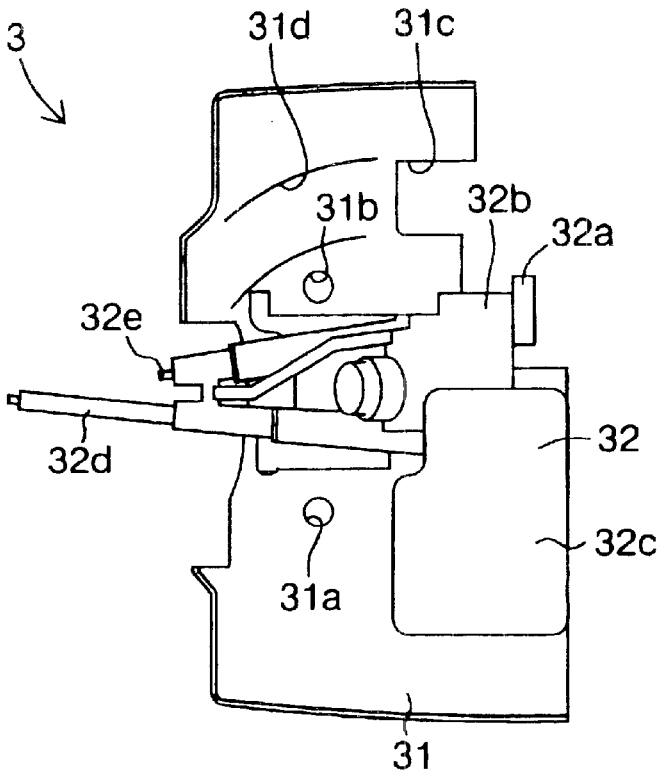
FIG. 34 is a partial plan view of a toilet seat/toilet lid device of a tankless toilet according to an embodiment in the sixth invention.
Figure 35:
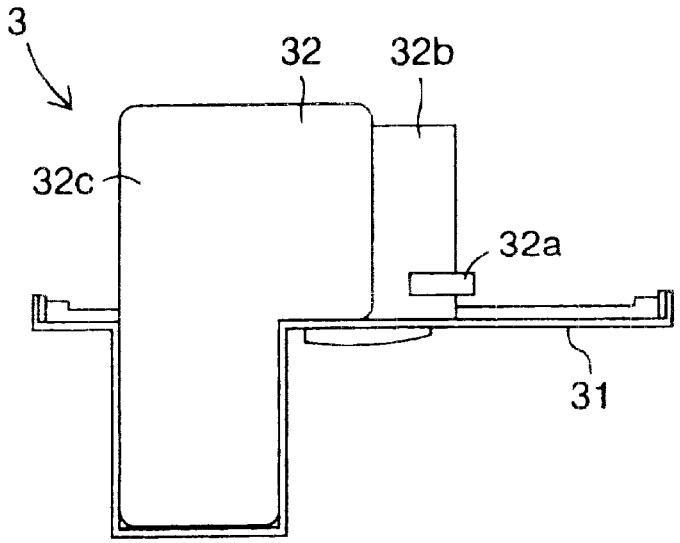
FIG. 35 is a partial back view of a toilet seat/toilet lid device of a tankless toilet according to an embodiment in the sixth invention.

Further, as shown in FIG. 34 and FIG. 35, in a shower toilet 3 which constitutes a toilet seat/toilet lid device, a part washing mechanism 32 which is capable of washing a human part is fixedly mounted on a toilet seat base plate 31. In the toilet seat base plate 31, mounting holes 31*a*, 31*b* which are aligned with the toilet seat mounting holes 13*a*, 13*b* and the mounting holes 21*a*, 21*b* are formed in the vertical direction. Further, the toilet seat base plate 31 is provided with a notch 31*c* which exposes the vacuum breaker 23 and a guide passage 31*d* which guides water leaked from the vacuum breaker 23 into the inside of the toilet bowl 11 of the western-style toilet body 1 is recessed in the toilet seat base plate 31 in the frontward direction from the notch 31*c*. On the other hand, the part washing mechanism 32 includes a body 32*b* which includes a water supply opening 32*a*, a hot water tank 32*c* which is connected to the body 32*b* and an anus nozzle 32*d* and a bidet nozzle 32*e* which can be extended in the frontward direction from the body 32*b*.

Figure 36:
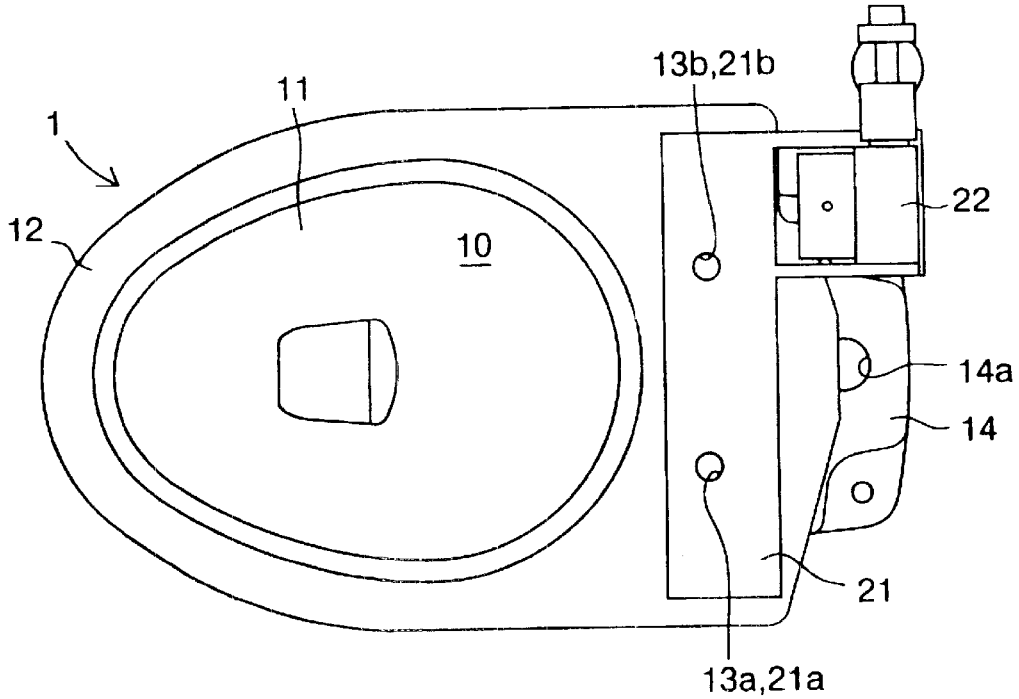
FIG. 36 is a plan view showing a state in which a toilet flushing device is aligned with a western-style toilet body of a tankless toilet according to an embodiment in the sixth invention.
Figure 37:
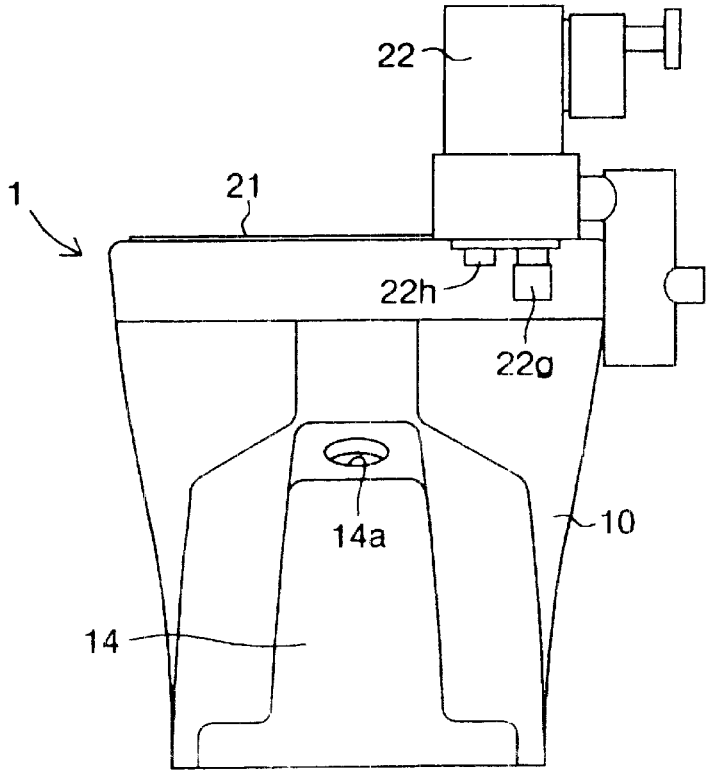
FIG. 37 is a back view showing a state in which a toilet flushing device is aligned with a western-style toilet body of a tankless toilet according to an embodiment in the sixth invention.
Figure 38:
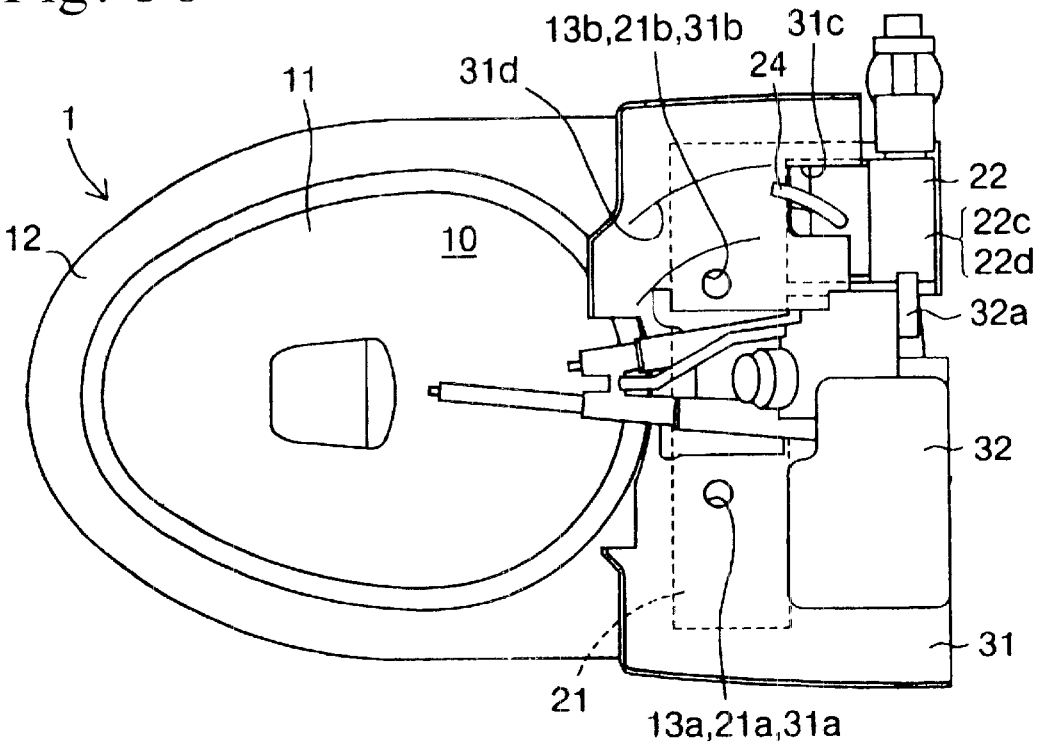
FIG. 38 is a plan view showing a state in which a part of toilet flushing device and a part of a toilet seat/toilet lid device are fixedly secured to a western-style toilet body of a tankless toilet according to an embodiment in the sixth invention.
Figure 39:
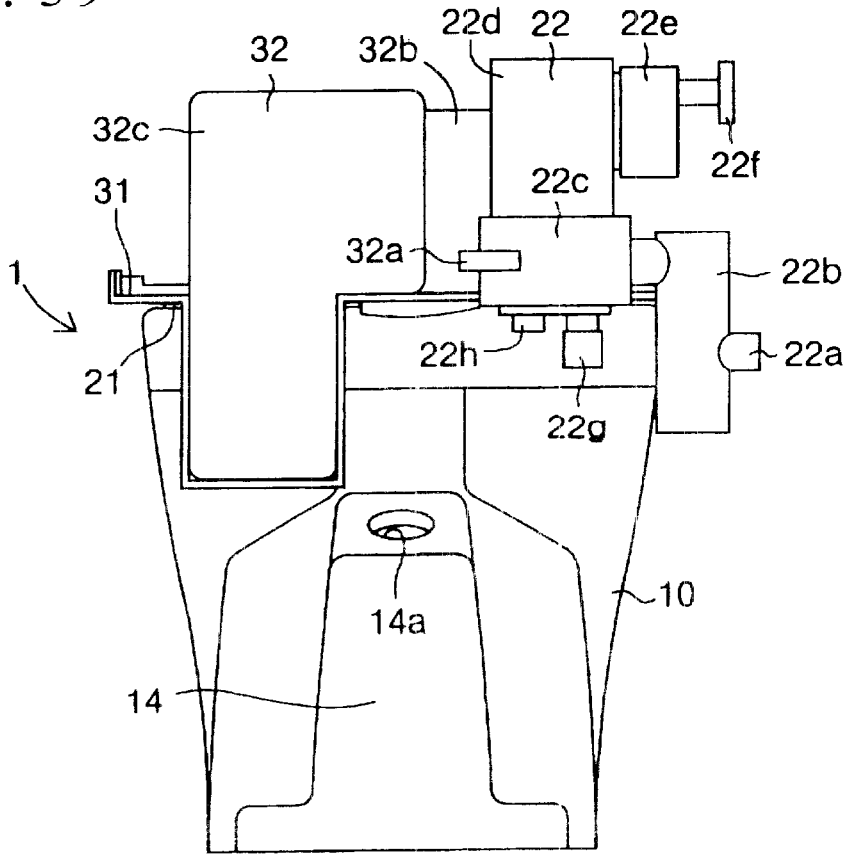
FIG. 39 is a back view showing a state in which a part of toilet flushing device and a part of a toilet seat/toilet lid device are fixedly secured to a western-style toilet body of a tankless toilet according to an embodiment in the sixth invention.

Such a tankelss toilet is assembled in a following manner. First of all, as shown in FIG. 36 and FIG. 37, the mounting holes 21*a*, 21*b* formed in the toilet flushing base plate 21 of the toilet flushing device 2 are made to take the status in which these mounting holes 21*a*, 21*b* are aligned with the toilet seat mounting holes 13*a*, 13*b* of the western-style toilet body 1. In this state, as shown in FIG. 38 and FIG. 39, bolts not shown in the drawings are inserted into the mounting holes 31*a,* 31*b* of the toilet seat base plate 31 of the shower toilet 3 and these bolts are made to pass through the toilet seat mounting holes 13*a,* 13*b* of the western-style toilet body 1 by way of the mounting holes 21*a,* 21*b* of the toilet flushing base plate 21, and nuts not shown in the drawings are engaged with the bolts at a back surface of the western-style toilet body 1. Accordingly, the toilet flushing base plate 21 of the toilet flushing device 2 is sandwiched between the toilet seat base plate 31 and the western-style toilet body 1. Further, the body 32*b* of the part washing mechanism 32 is connected to the open/close valve 22*c* by means of the water supply opening 32*a*. Here, the interference between the part washing mechanism 32 of the shower toilet 3 and the toilet flushing mechanism 22 of the toilet flushing device 2 can be obviated.

Figure 40:
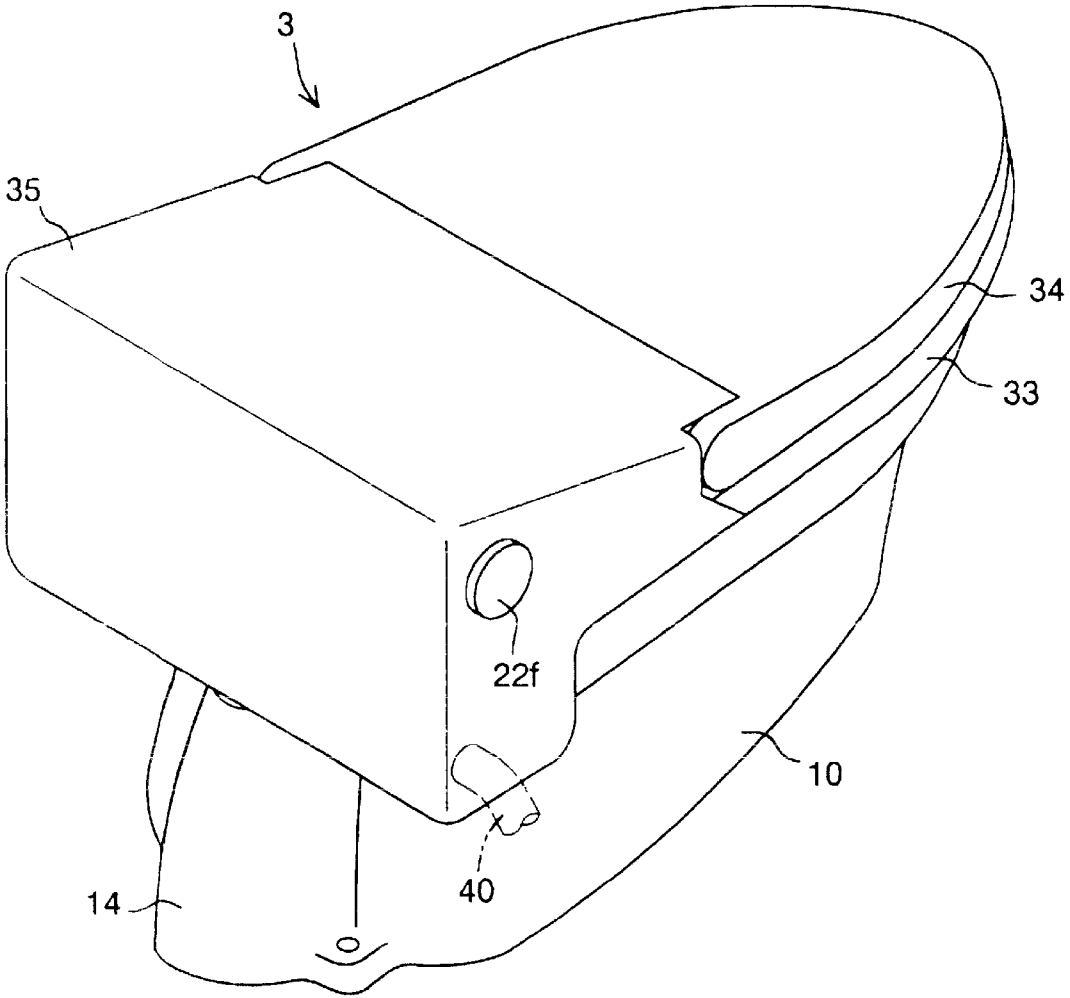
FIG. 40 is a perspective view of a tankless toilet according to an embodiment in the sixth invention.

Then, a rubber hose 24 which is directed toward a guide passage 31*d* is fitted on the vacuum breaker 23. Further, the rim water supply opening 22*g* is connected to the rim opening 13*c* of the western-style toilet body 1 and the jet water supply opening 22*h* and the jet nozzle are connected to each other by a jet conduit. Thereafter, as shown in FIG. 40, a toilet seat 33 and a toilet lid 34 which constitute remaining parts of the shower toilet 3 are tiltably supported on the toilet seat base plate 31 and similarly a cover 35 which constitutes a remaining part of the shower toilet 3 is mounted on the toilet seat base plate 31. In this manner, the part washing mechanism 32 is concealed in the inside of the cover 35. A flexible hose 40 having flexibility is connected to the water supply opening 22*a* of the toilet flushing mechanism 22 and the flexible hose 40 is connected to a water supply pipe such as a city water service pipe or the like by way of a stop valve not shown in the drawings.

In this manner, in this tankless toilet, the part washing mechanism 32 of the shower toilet 3 is mounted on the western-style toilet body 1 and hence, the tankless toilet can meet the demand of the user that the user wants to wash the part after passing stools. Further, with respect to this tankless toilet, even when the part washing mechanism 32 is mounted on the tankless toilet, since the toilet seat base plate 31 and the toilet flushing base plate 21 are partially overlapped, the tankless toilet can be miniaturized.

Accordingly, in this tankless toilet, the assurance of the installation space can be facilitated by miniaturizing the tankless toilet and the tankless toilet can meet the demand of the user that the user wants to wash the part after passing stools.

Seventh and Eighth Inventions

An embodiment which embodies the seventh and eighth inventions is explained hereinafter in conjunction with drawings.

Figure 41:
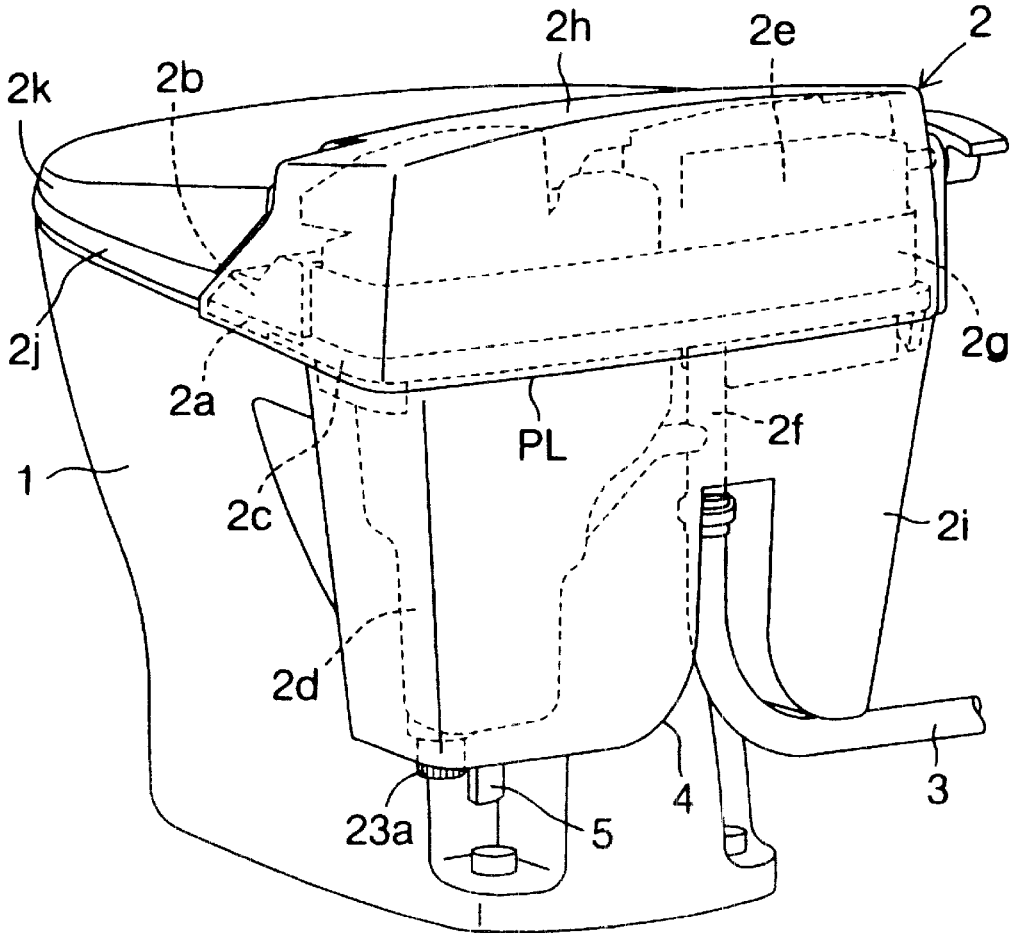
FIG. 41 is a perspective view of a tankless toilet according to an embodiment in the seventh and eighth inventions as seen from the back of the tankless toilet.

As shown in FIG. 41, a tankless toilet of this embodiment includes a western-style toilet body 1 made of porcelain and a shower toilet 2 which is constituted of a toilet flushing device and a part washing device which are mounted on a rear portion of the western-style toilet body 1.

Figure 42:
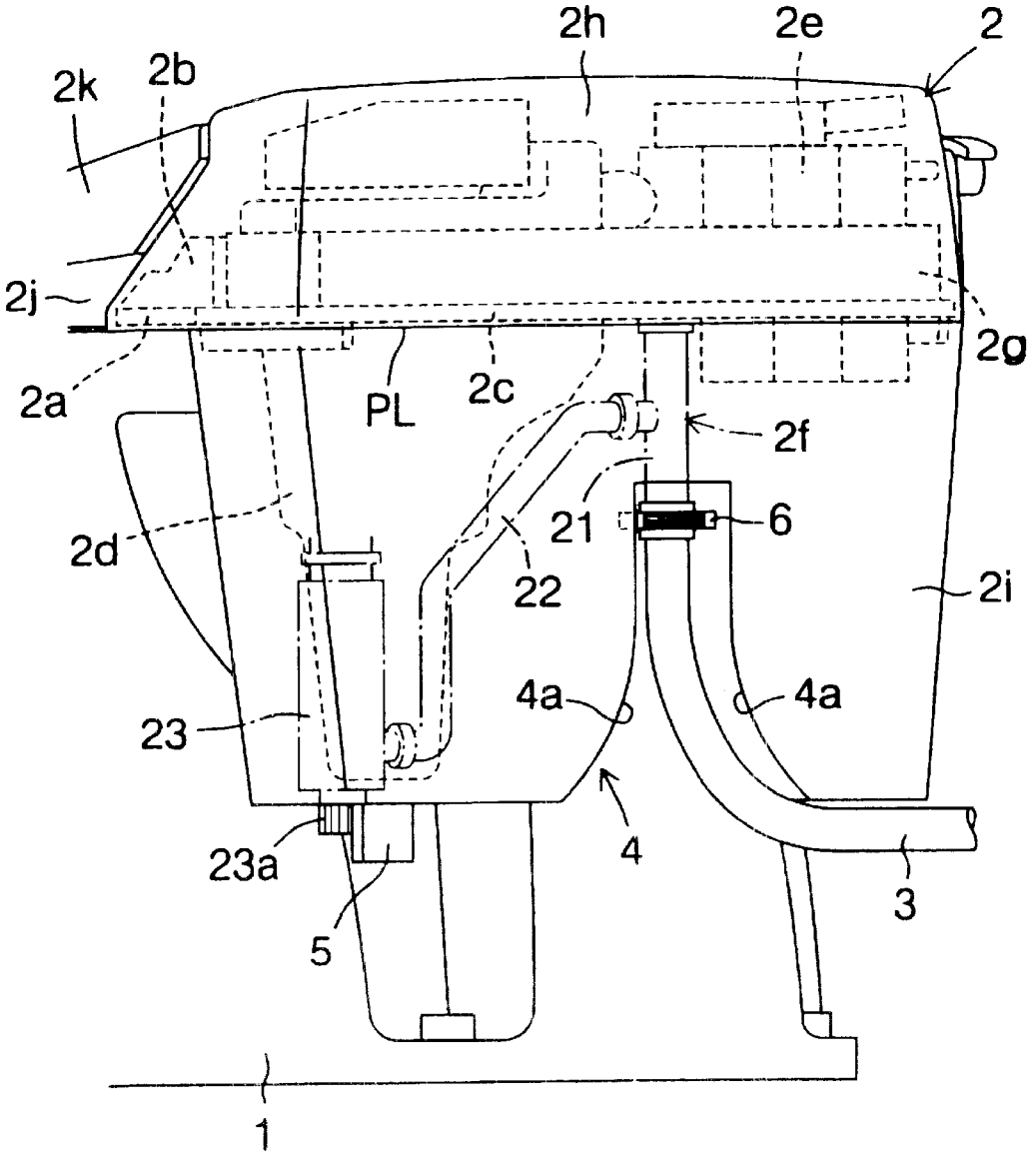
FIG. 42 is an enlarged perspective view of a tankless toilet according to an embodiment in the seventh and eighth inventions as seen from the back of the tankless toilet.

As shown in FIG. 42, the shower toilet 2 includes a front base plate 2*a,* a part washing mechanism 2*b* such as a nozzle and the like which are fixedly secured onto the front base plate 2*a,* a rear base plate 2*c,* a hot water tank 2*d* which constitutes a remaining portion of the part washing mechanism 2*b* fixedly secured onto the rear base plate 2*c,* a toilet flushing mechanism 2*e* such as a valve and the like which is fixedly secured onto the rear base plate 2*c,* a water supply mechanism 2*f* which is fixedly secured onto the rear base plate 2*c* and is capable of supplying water to the hot water tank 2*d* and the toilet flushing mechanism 2*e,* an elevation mechanism not shown in the drawing which is fixedly secured onto the rear base plate 2*c* and is capable of elevating the front base plate 2*a* relative to the rear base plate 2*c*, a concealing member 2*g* which is erected in all periphery in the horizontal direction of the rear base plate 2*c* and conceals the hot water tank 2*d*, the toilet flushing mechanism 2*e* and the elevating mechanism, an upper cover 2*h* and an under cover 2*i* which encase the part washing mechanism 2*b* and the like, a heating toilet seat 2*j* which is tiltably mounted on the upper cover 2*h*, and a toilet lid 2*k* which is tiltably mounted on the upper cover 2*h*.

Here, the upper cover 2*h* and the under cover 2*i* are made of resin. As shown in FIG. 41, the upper cover 2*h* and the under cover 2*i* can be divided in the vertical direction from a division line PL on a horizontal plane equal to an upper surface of a rim of the western-style toilet body 1.

The upper cover 2*h* is designed to be elevatable together with the heating toilet seat 2*j* and the toilet lid 2*k* to expose a rear portion of a bowl surface of the western-style toilet body 1 by means of an elevating mechanism. When descended, the upper cover 2*h* encases the front base plates 2*a*, the part washing mechanism 2*b* such as nozzles and the like, the rear base plate 2*c*, an upper portion of the hot water tank 2*d*, an upper portion of the toilet flushing mechanism 2*e*, the elevating mechanism and the concealing member 2*g*, while when ascended, among the above-mentioned components, the rear base plate 2*c*, the upper portion of the hot water tank 2*d*, the toilet flushing mechanism 2*e*, the elevating mechanism and the concealing mechanism 2*g* are exposed.

On the other hand, the under cover 2*i* is fixedly secured to the rear base plate 2*c* and houses a lower portion of the hot water tank 2*d*, a lower portion of the toilet flushing mechanism 2*e* and the water supply mechanism 2*f*.

As shown in FIG. 42, the water supply mechanism 2*f* includes a main pipe 21 which has one end thereof connected to a city water service pipe not shown in the drawing which supplies the water from outside by way of a flexible hose 3 and the other end thereof connected to the toilet flushing mechanism 2*e*, a branch pipe 22 which is branched from the main pipe 21, and a water supply device 23 which has the branch pipe 22 connected to a lower portion thereof and the lower portion connected to a bottom portion of the hot water tank 2*d*. The water supply device 23 includes an electromagnetic valve and a flow rate regulating valve which are mounted on a communication passage between the water supply device 23 and the hot water tank 2*d*. A cap 23*a* is threadedy engaged with a lower end of the water supply device 23 and a strainer not shown in the drawing which is disposed inside can be taken out by removing the cap 23*a*.

Figure 43:
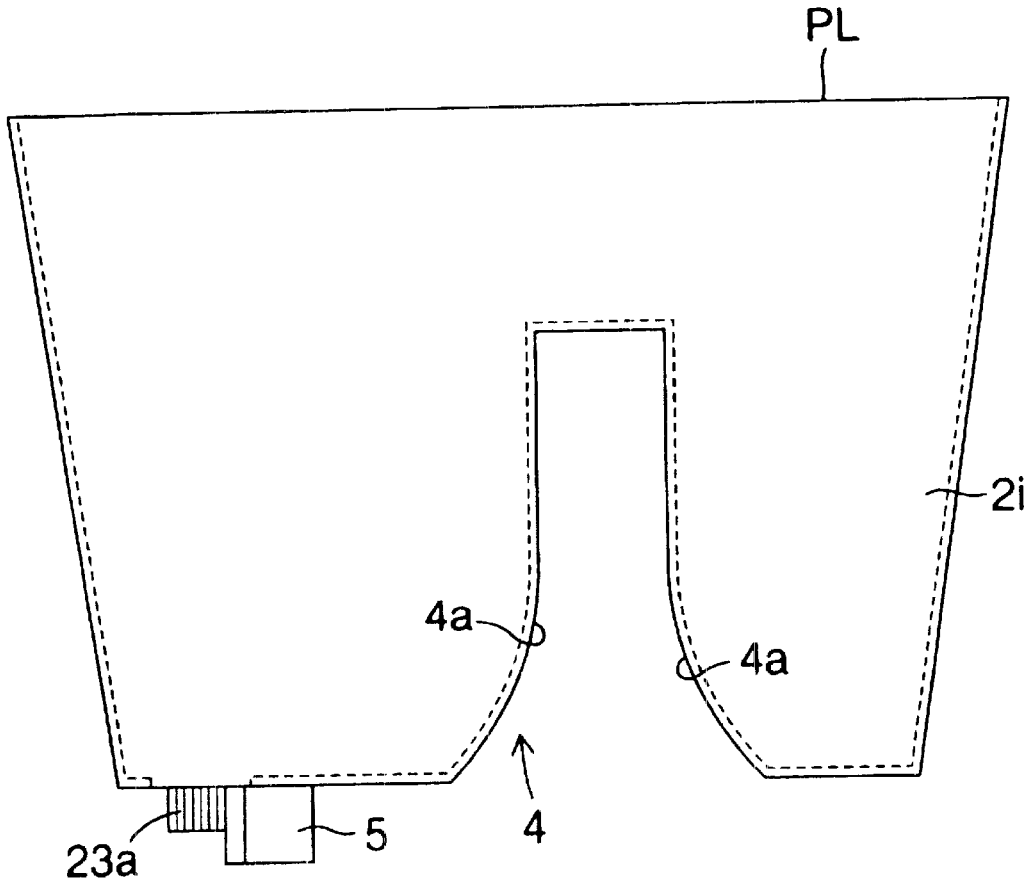
FIG. 43 is a back view of an under cover of a tankless toilet according to an embodiment in the seventh and eighth inventions.
Figure 44:
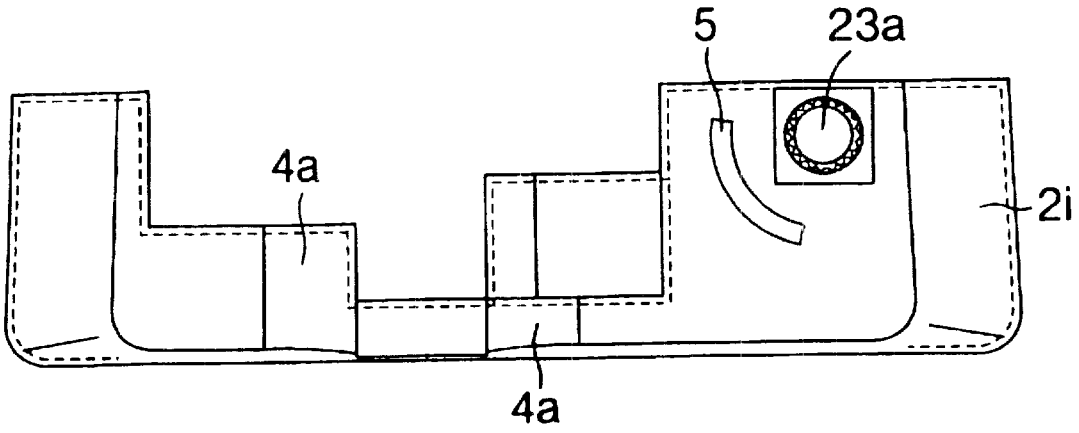
FIG. 44 is a bottom view of an under cover of a tankless toilet according to an embodiment in the seventh and eighth inventions.
Figure 45:
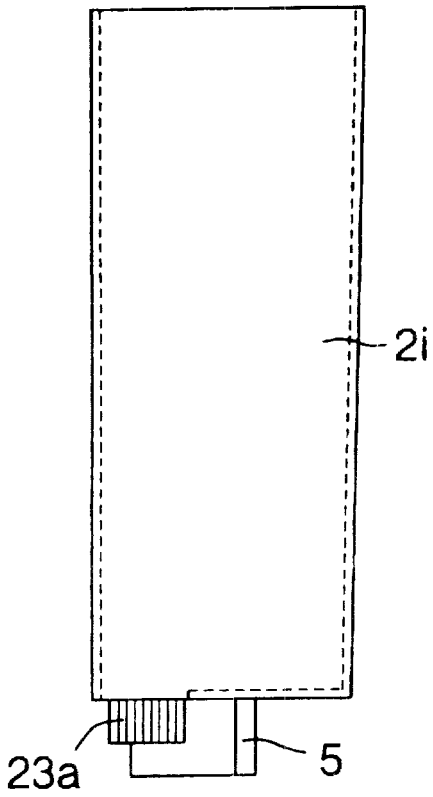
FIG. 45 is a side view of an under cover of a tankless toilet according to an embodiment in the seventh and eighth inventions.

As shown in FIG. 43 to FIG. 45, in an approximately central upper portion in the widthwise direction of the under cover 2*i*, a recessed portion 4 which is recessed upwardly from a bottom surface is formed. One end of a main pipe 21 of the water supply mechanism 2*f* is protruded downwardly from the upper end of the recessed portion 4 and the flexible hose 3 is connected to this end by means of a clip 6. Further, both side surfaces of the recessed portion 4 are designed to guide surfaces 4*a* which are formed in an arcuate shape to allow the bending of the flexible hose 3 which is connected in the above-mentioned manner.

Further, the cap 23*a* of the water supply device 23 is protruded downwardly from a bottom surface of one end side of the under cover 2*i* and a rib 5 which is close to the cap 23*a* and is protruded downwardly while exceeding the protruding length of the cap 23*a* is formed on the bottom surface.

In this tankless toilet, with the provision of the part washing mechanism 2*b* of the shower toilet 2, it is possible to wash a part of a person who sits on the tankless toilet by way of the heating toilet seat 2*j*. Further, in this tankless toilet, with the provision of the toilet flushing mechanism 2*e* of the shower toilet 2, it is possible to wash the western-style toilet body 1.

Further, in this tankless toilet, since the part washing 76 mechanism 2*b* and the toilet flushing mechanism 2*e* are concealed by the upper cover 2*h* and the under cover 2*i* which are made of resin, the manufacturing cost is increased by an amount corresponding to the upper cover 2*h* and the undercover 2*i*. However, it is no more necessary to consider the appearance of the part washing mechanism 2*b* and the toilet flushing mechanism 2*e* in the inside of the upper cover 2*h* and the under cover 2*i* and hence, the manufacture of the part washing mechanism 2*b* and the toilet flushing mechanism 2*e* is facilitated so that the reduction of the manufacturing cost can be realized. Particularly, in this tankless toilet, the toilet flushing mechanism 2*e* is directly connected to the city water service pipe by way of the flexible hose 3 and is capable of discharging the water by the open/close operation of the valve and hence, the tankless toilet can be miniaturized whereby the toilet flushing mechanism 2*e* can be easily concealed by the upper cover 2*h* and the under cover 2*i* thus realizing the further reduction of the manufacturing cost of the tankless toilet with the provision of the upper cover 2*h* and the under cover 2*i*.

Further, in this tankless toilet, by dividing the upper cover 2*h* and the under cover 2*i* in the vertical direction, it is possible to perform the inspection or the like of the part washing mechanism 2*b* and the toilet flushing mechanism 2*e*. In this case, since the division line PL between the upper cover 2*h* and the under cover 2*i* is extended horizontally thus exhibiting the favorable appearance.

Accordingly, this tankless toilet can surely exhibit the favorable appearance while realizing the reduction of the manufacturing cost.

Further, in this tankless toilet, since the other end of the flexible hose 3 is positioned at the approximately central upper portion in the widthwise direction of the under cover 2*i*, even when the city water service pipe is provided at either left or right side of the tankless toilet, the city water service pipe and the toilet flushing mechanism 2*e* can be easily directly connected. Accordingly, it is no more necessary to classify the tankless toilets between those for left-side water supply and those for right-side water supply. Accordingly, the number of kinds of products at the time of manufacturing and selling can be reduced so that the reduction of the manufacturing cost and the administration cost can be realized. Further, due to such advantageous effects, the freedom in designing a house is increased and the selection by a person who builds the house is also facilitated. Further, since the flexible hose 3 is flexible to a certain extent, the installation of the tankless toilet can be facilitated.

Further, in this tankless toilet, since the under cover 2*i* has the guide 4*a* which allows the bending of the flexible hose 3, no unnecessary gap is formed between the under cover 2*i* and the flexible hose 3 and hence, the appearance of the tankless toilet is enhanced.

Ninth Embodiment

Figure 46:
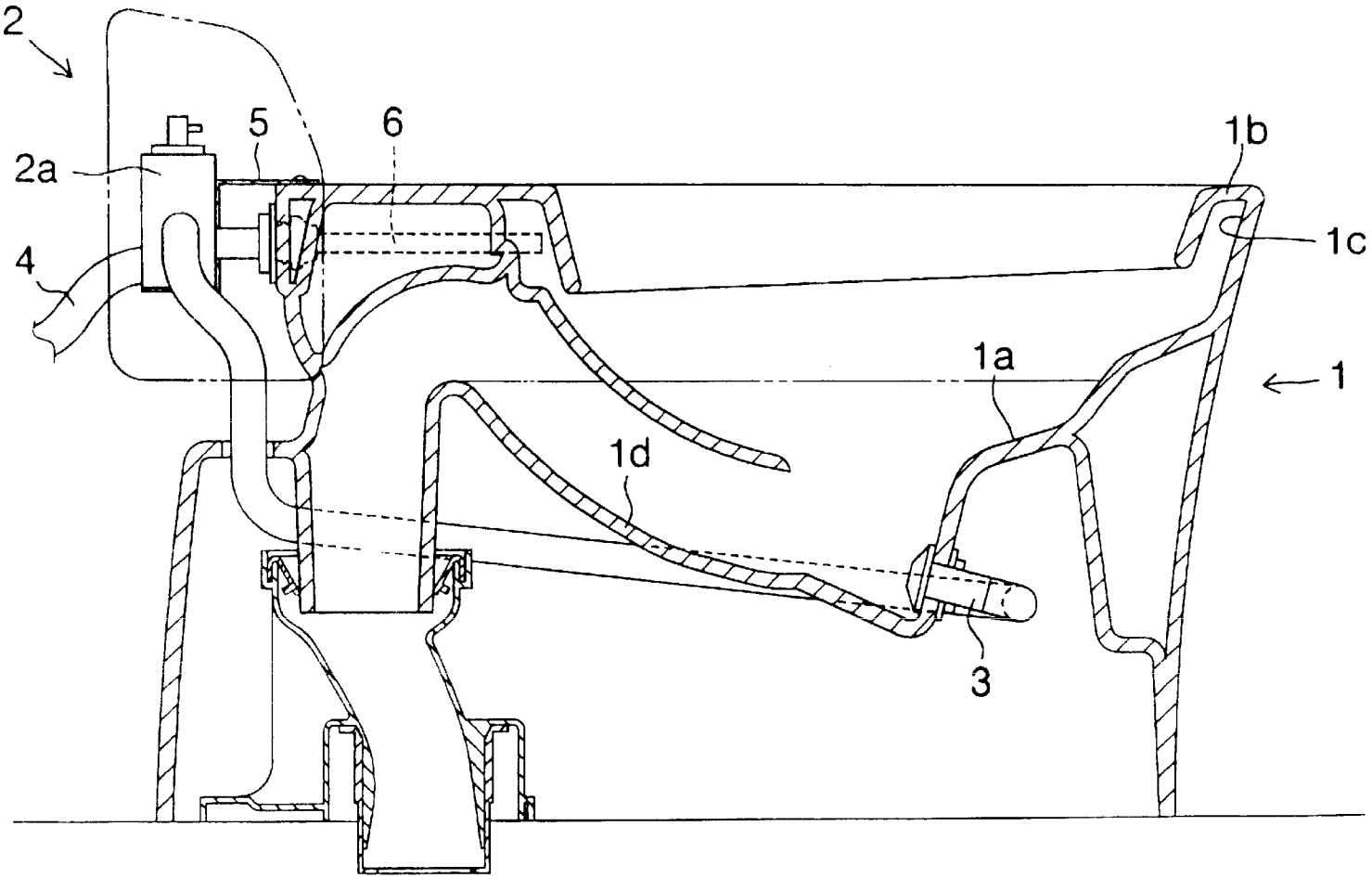
FIG. 46 is a cross-sectional view of a tankless toilet according to an embodiment in the ninth invention.

Hereinafter, an embodiment which embodies the ninth invention is explained in conjunction with the attached drawings. In this embodiment, as shown in FIG. 46, the spud for flush toilet of the present invention is embodied with respect to a rim nozzle 6 of the tankless toilet.

The tankless toilet includes a western-style toilet body 1 of a flush style which is made of porcelain and a toilet flushing device 2 which is mounted on a rear portion of the western-style toilet body 1. In FIG. 46, the illustration of a part washing device, a toilet seat and a toilet lid is omitted.

In the western-style toilet body 1, a rim 1*b* is formed on an upper periphery of a bowl portion 1*a* and a rim channel 1*c* is formed in the inside of the rim 1*b*. Further, a trap 1*d* is communicated with a bottom portion of the bowl portion 1*a* and a jet nozzle 3 is provided to the bowl portion 1*a* side of the trap 1*d*.

The toilet flushing device 2 is connected to a city water service pipe not shown in the drawing by way of a stop valve through a flexible hose 4 and is fixedly secured to a rear portion of the western-style toilet body 1 by means of a base plate 5. The toilet flushing device 2 includes an open/close valve 2*a* which is communicated with the flexible hose 4 and the open/close valve 2*a* is connected to a rim nozzle 6 and a jet nozzle 3.

Figure 47:
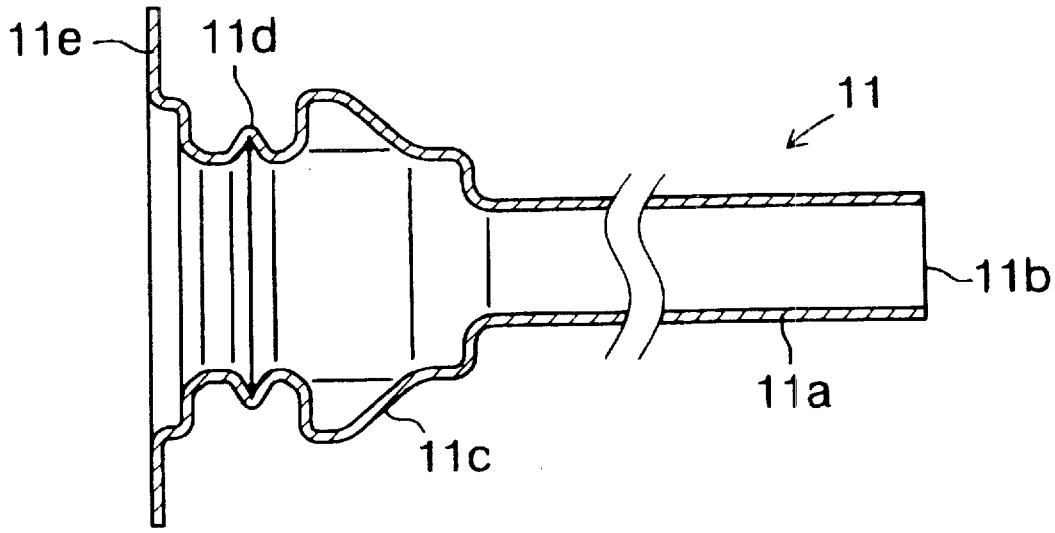
FIG. 47 is a cross-sectional view of a cylindrical member of a spud for flush toilet according to an embodiment in the ninth invention.
Figure 48:
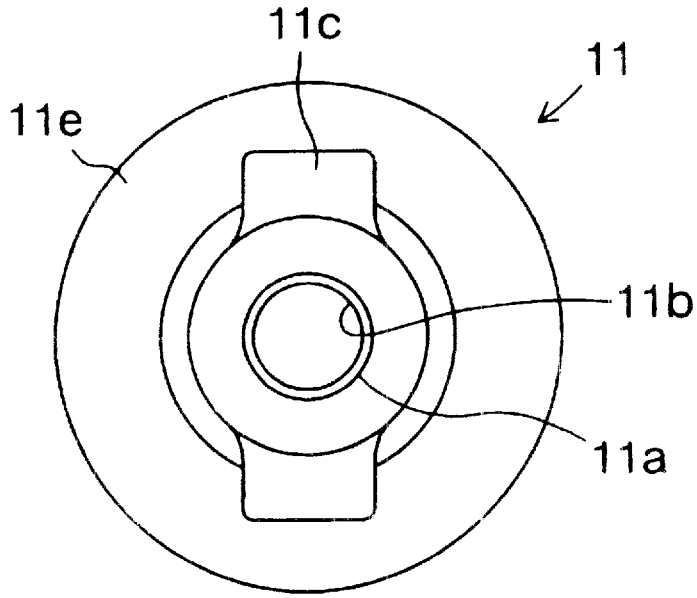
FIG. 48 is a front view of a cylindrical member of a spud for flush toilet according to an embodiment in the ninth invention.
Figure 49:
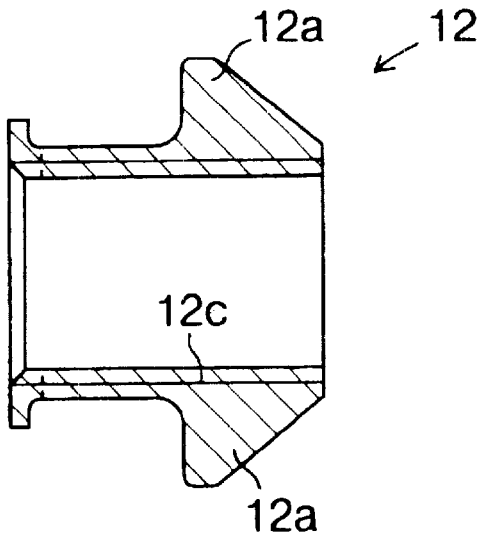
FIG. 49 is a cross-sectional view of a female thread member of a spud for flush toilet according to an embodiment in the ninth invention.
Figure 50:
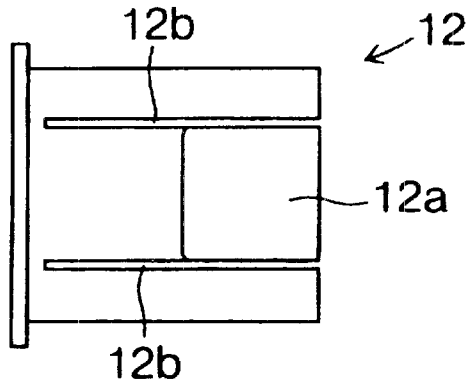
FIG. 50 is an upper plan view of a female thread member of a spud for flush toilet according to an embodiment in the ninth invention.
Figure 51:
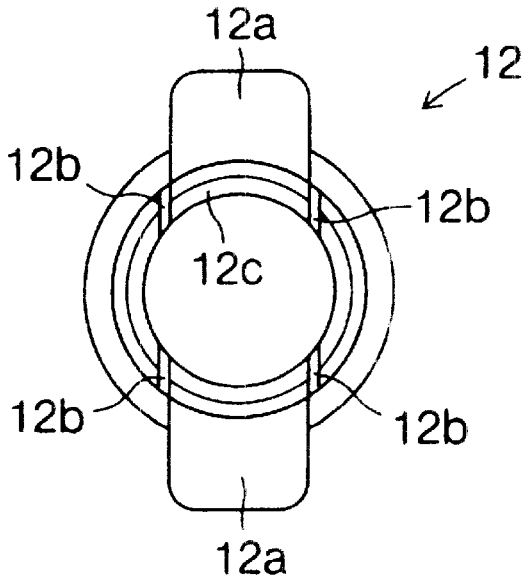
FIG. 51 is a front view of a female thread member of a spud for flush toilet according to an embodiment in the ninth invention.
Figure 52:
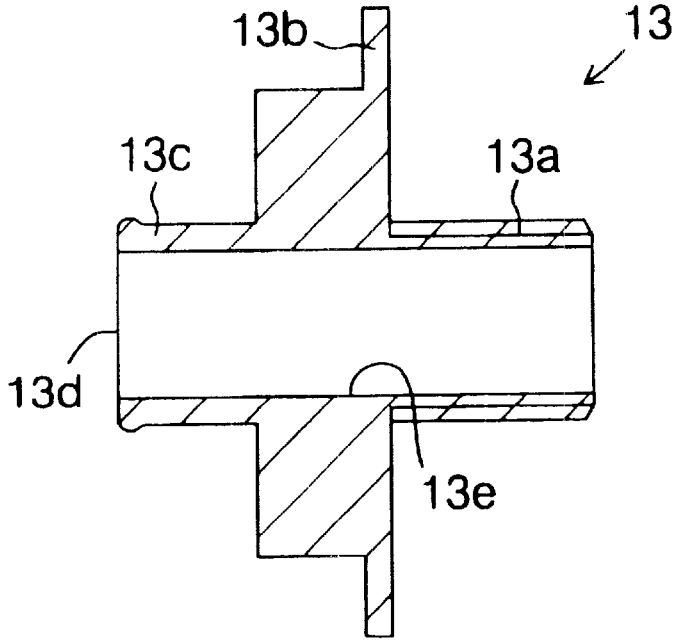
FIG. 52 is a cross-sectional view of a male thread member of a spud for flush toilet according to an embodiment in the ninth invention.
Figure 53:
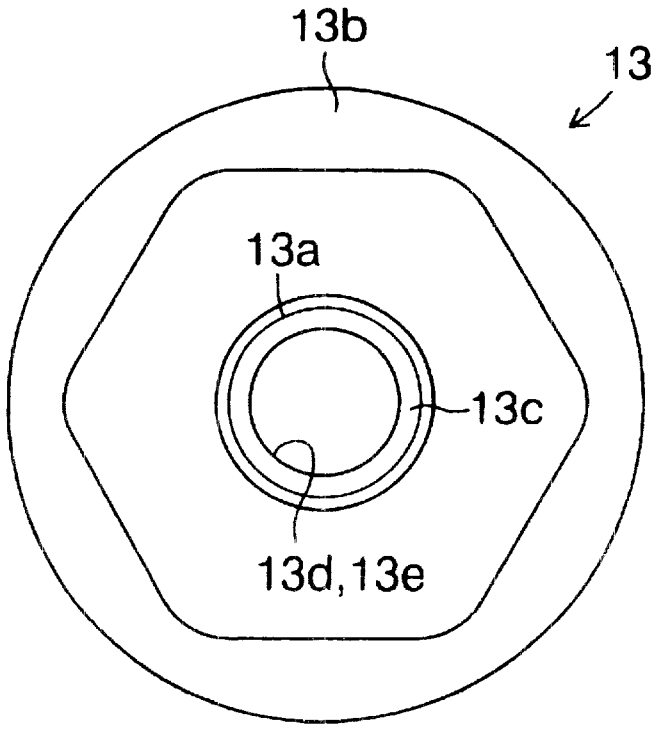
FIG. 53 is a front view of a male thread member of a spud for flush toilet according to an embodiment in the ninth invention.
Figure 54:
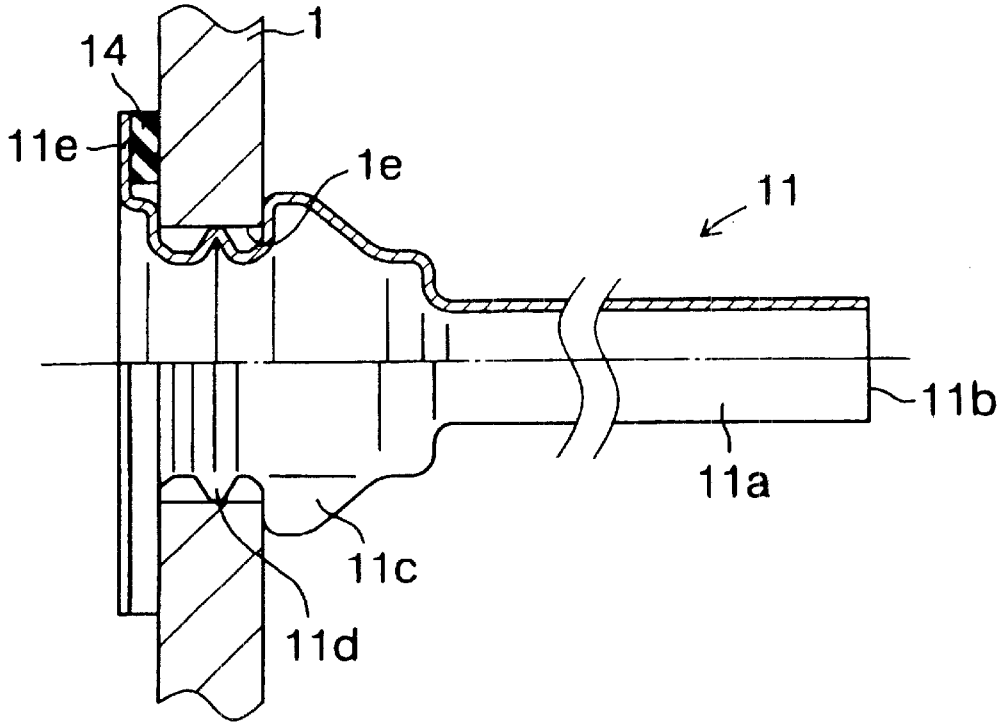
FIG. 54 is a cross-sectional view showing a step in which a spud for flush toilet is mounted according to an embodiment in the ninth invention.
Figure 55:
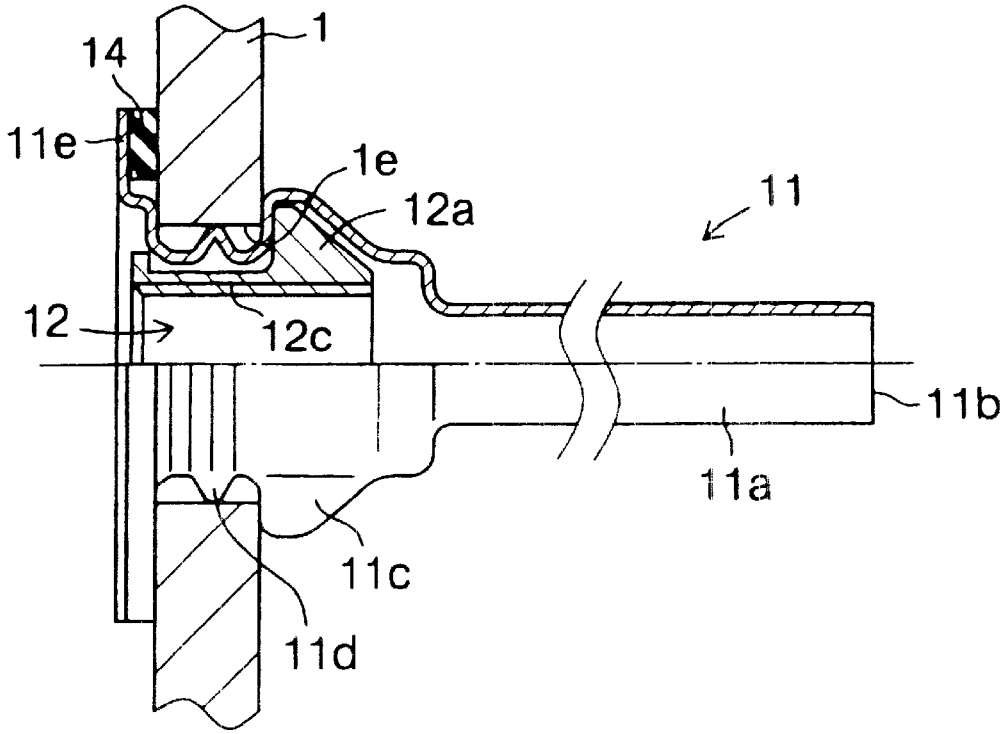
FIG. 55 is a cross-sectional view showing a step in which a spud for flush toilet is mounted according to an embodiment in the ninth invention.
Figure 56:
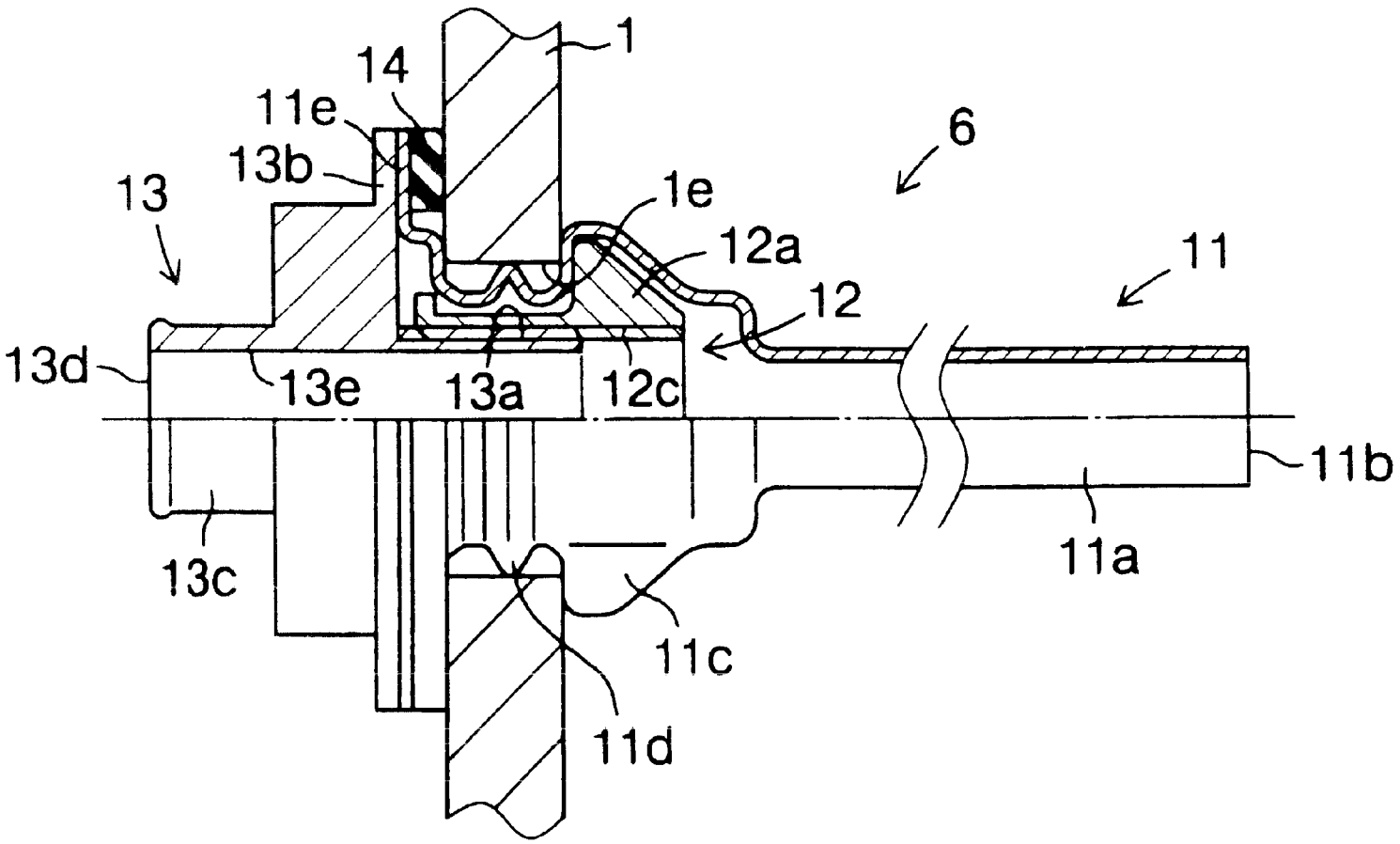
FIG. 56 is a cross-sectional view showing a step in which a spud for flush toilet is mounted according to an embodiment in the ninth invention.

The rim nozzle 6 is constituted of a cylindrical member 11 shown in FIG. 47 and FIG. 48, a female thread member 12 shown in FIG. 49 to FIG. 51, a male thread member 13 shown in FIG. 52 and FIG. 53 and a packing 14 shown in FIG. 54 to FIG. 56.

As shown in FIG. 47 and FIG. 48, the cylindrical member 11 is made of soft resin having resiliency such as polyethylene or the like and is formed in a cylindrical shape having a thin wall thickness. The cylindrical member 11 includes a nozzle portion 11*a* which has a narrow diameter and is protruded at one end thereof and a front end of the nozzle portion 11*a* constitutes an outlet port 11*b*. Further, the cylindrical member 11 includes a bulged portion 11*c* at other end side of the nozzle portion 11*a* wherein the bulged portion 11*c* is bulged in the radially outward direction perpendicular to the nozzle portion 11*a*. Further, the cylindrical member 11 includes a fourth flange 11*d* at the other end side of the bulged portion 11*c* and includes a third flange 11*e* which is extended perpendicular to the nozzle portion 11*a* at the other end side of the fourth flange 11*d*. The outer diameter of the fourth flange 11*d* is set slightly larger than the inner diameter of a through hole 1 which is formed in a wall portion of the western-style toilet body 1 and is explained later.

As shown in FIG. 49 to FIG. 51, the female thread member 12 includes a pair of first flanges 12*a* which are protruded in the direction perpendicular to the outer surface thereof and in the radially outward direction. These first flanges 12*a* have a wedge shape which has end side thereof formed in a small diameter. Slits 12*b* extending in the axial direction are formed at both sides of each first flange 12*a* and one end side of each slit 12*b* is opened. Further, a female thread 12*c* is formed on the inner surface of the female thread member 12.

As shown in FIG. 52 and FIG. 53, the male thread member 13 forms a male thread 13*a* which is engaged with the female thread 12*c* of the female thread member 12 on an outer surface of a front end side thereof and forms a second flange 13*b* on an outer surface of a rear end side thereof. Further, a nozzle portion 13*c* protruding with a narrow diameter is formed on a rear end of the male thread member 13 and front end of the nozzle 13*c* forms an inlet port 13*d*. In the inside of the male thread member 13, a water passage 13*e* which is extended in the axial direction and is communicated with the inlet port 13*d* is formed.

The rim nozzle 6 is mounted in the through hole 1*e* of the wall portion of the western-style toilet body 1. This through hole 1*e* is formed in a wall portion which faces the rim channel 1*c*. In this case, as shown in FIG. 54, first of all, the cylindrical member 11 is inserted into the inside of the through hole 1*e*. In this state, the fourth flange 11*d* of the cylindrical member 11 is brought into contact with the inner surface of the through hole 1*e*. Here, since the cylindrical member 11 is formed of soft resin having resiliency such as polyethylene, this operation can be easily performed. Simultaneously, a packing 14 is inserted between the third flange 11*e* of the cylindrical member 11 and the wall portion.

Then, as shown in FIG. 55, the first flange 12*a* of the female thread member 12 is pushed while gripping the first flange 12*a* of the female thread member 12 with a hand so as to form the female thread member 12 in a small-diameter state and, in this state, the female thread member 12 is inserted into the inside of the cylindrical member 11 disposed in the inside of the through hole 1*e* from the other end. After such an insertion, by releasing the hand from the first flange 12*a* of the female thread member 12, the first flange 12*a* of the female thread member 12 slightly returns to the original shape due to the resilient force and hence, the first flange 12*a* of the female thread member 12 is housed in the bulged portion 11*c* of the cylindrical member 11.

Thereafter, as shown in FIG. 56, the front end of the male thread member 13 is inserted into the inside of the female thread member 12 and the male thread 13*a* of the male thread member 13 is engaged with the female thread 12*c* of the female thread member 12. When the engagement between the female thread 12*c* of the female thread member 12 and the male thread 13*a* of the male thread member 13 advances, the female thread member 12 is maintained in the large-diameter state. Further, the first flange 12*a* of the female thread member 12 is brought into contact with one surface of the wall portion by way of the cylindrical member 11 and the second flange 13*b* of the male thread member 13 is brought into contact with the other surface of the wall portion by way of the third flange 11*e* of the cylindrical member 11 and the packing 14 while facing the first flange 12*a* in an opposed manner. In this manner, the rim nozzle 6 can be easily and firmly mounted in the through hole 1*e* of the wall portion.

In the rim nozzle 6, the inlet port 13*d* formed at the rear end of the male thread member 13 and the outlet port 11*b* formed at one end of the cylindrical member 11 are communicated through the water passage 13*e* of the male thread member 13 and the outlet port 11*b* is positioned in the rim channel 1*c* of the western-style toilet body 1. Accordingly, the water is supplied to the rim nozzle 6 from the open/close valve 2*a* and the water taken in from the inlet port 13*d* is discharged from the outlet port 11*b*.

Here, since the cylindrical member 11 forms a cylindrical shape in the inside of the through hole 1*e* of the wall portion, the sealing performance between the through hole 1*e* and the cylindrical member 11 is ensured. Further, since the first flange 12*a* and the second flange 13*b* are brought into contact with one surface and the other surface of the wall portion in the state that these flanges 12*a*, 13*b* sandwich the third flange 11*e* of the cylindrical member 11 and the packing 14, the sealing performance between the through hole 1*e* and the male thread member 13 can be also ensured.

Particularly, in this rim nozzle 6, the cylindrical member 11 surrounds the first flange 12*a* of the female thread member 12 and hence, the gap between the cylindrical member 11 and the female thread member 12 is completely sealed thus further enhancing the sealing performance.

Further, in the rim nozzle 6, since the packing 14 is mounted on the wall portion side of the third flange 11*e*, even when the cylindrical member 11 having a thin wall thickness is adopted for enhancing the mounting performance thereof, due to the resiliency of the packing 14, it is difficult for the water which leaks from the gap between the female thread 12*c* of the female thread member 12 and the male thread 13*a* of the male thread member 13 to pass through the gap between the second flange 13*b* of the male thread member 13 and the third flange 1*e* of the cylindrical member 11 thus further enhancing the sealing performance.

Further, in the rim nozzle 6, the rim nozzle 6 can be firmly mounted in the through hole 1*e* formed in the wall portion due to the resiliency of the packing 14. Further, in the rim nozzle 6, since the fourth flange 11*d* which is brought into contact with the inner surface of the through hole 1*e* is formed on the cylindrical member 11, the cylindrical member 11 can be firmly held in the inside of the through hole 1*e*. Accordingly, the rim nozzle 6 hardly vibrates against the western-style toilet body 1 and hence, the sealing performance between the rim nozzle 6 and other member such as the open/close valve 2*a* connected to the inlet port 13*d* or the like can be also enhanced.

In this manner, the water taken in through the inlet port 13*d* does not leak in the vicinity of the through hole 1*e* and is discharged from the outlet port 11*b*. Accordingly, this rim nozzle 6 can satisfy both of the mounting performance and the sealing performance.

The above-mentioned embodiments are only for illustrative purpose and the present invention can be carried out in modes including various modifications within a range without departing from the gist of the present invention.

Industrial Applicability

Accordingly, the tankless toilet of the first invention can realize the reduction of the manufacturing cost without deteriorating the washing ability of water in the inside of the rim channel.

The tankless toilet of the second invention does not necessitate many steps to wash the western-style toilet body and hence, the washing performance of the western-style toilet body can be enhanced.

The tankless toilet of the third invention allows the free selection of the purchaser and also can realize the reduction of the manufacturing cost.

The tankless toilet of the fourth and fifth inventions can realize the large washing ability, the favorable appearance including the contour and the assurance of the reliable easiness of assembling.

The tankless toilet of the sixth invention facilitates the assurance of the installation space due to the miniaturization of the tankless toilet and can meet the demand of the user that the user wants to wash the part after passing stools.

The western-style flush toilet of the seventh invention can realize the reduction of the manufacturing cost and can surely exhibit the favorable appearance.

The part washing device of the eighth invention does not give rise to the rupture of the water supply device at the time of mounting the part washing device on the western-style toilet body.

The spud for flush toilet of the ninth invention can satisfy both of the mounting performance and the sealing performance.

What is claimed is:

1. A tankless toilet including a western-style toilet body and a toilet flushing device which is mounted on the western-style toilet body, has no water tank and has a flushing mechanism capable of washing the western-style toilet body with water, the improvement being characterized in that in mounting a toilet seat/toilet lid device having a part washing mechanism capable of washing a part of human body on the western-style toilet body, as the toilet seat/toilet lid device, a toilet seat/toilet lid device having a toilet seat base plate on which the part washing mechanism is fixedly secured is adopted, as the toilet flushing device, a toilet flushing device having a toilet flushing base plate on which the toilet flushing mechanism is fixedly secured is adopted, the toilet base plate is mounted on the western-style toilet body using toilet seat mounting holes formed on the western-style toilet body, and the toilet flushing base plate is sandwiched between the toilet seat base plate and the western-style toilet body while obviating the interference between the part washing mechanism and the toilet flushing mechanism.

2. A tankless toilet according to claim 1, wherein the toilet seat mounting holes allow the mounting of a toilet seat/toilet lid device for general use.

3. A tankless toilet according to claim 1 or 2, wherein the toilet seat base plate has a guide passage which guides water leaked from the toilet flushing mechanism to the inside of the western-style toilet body.

4. A tankless toilet according to claim 1 or 2, wherein the toilet seat/toilet lid device includes a cover which conceals the part washing mechanism and the toilet flushing mechanism of the toilet flushing device is concealed by the cover.

5. A tankless toilet according to claim 3, wherein the toilet seat/toilet lid device includes a cover which conceals the part washing mechanism and the toilet flushing mechanism of the toilet flushing device is concealed by the cover.

* * * * *

UNITED STATES PATENT AND TRADEMARK OFFICE

CERTIFICATE OF CORRECTION

PATENT NO. : 6,675,399 B1
DATED : January 13, 2004
INVENTOR(S) : Katsunori Tomita et al.

It is certified that error appears in the above-identified patent and that said Letters Patent is hereby corrected as shown below:

Column 23,
Line 65, change “49a” to -- 41a --.

Column 33,
Line 16, change “land” to -- 1 and --.

Column 39,
Line 36, change “rimconduit” to -- rim conduit --.

Column 40,
Line 38, change “vacuumn” to -- vacuum --.

Column 43,
Line 11, change “washing 76 mechanism” to -- washing mechanism --.

Column 46,
Line 10, change “1e” to -- 11e --.

Signed and Sealed this

Twentieth Day of July, 2004

JON W. DUDAS
*Acting Director of the United States Patent and Trademark Office*